US006707442B2

(12) United States Patent
Watanabe

(10) Patent No.: US 6,707,442 B2
(45) Date of Patent: Mar. 16, 2004

(54) DRIVING APPARATUS AND DRIVING METHOD OF LIQUID CRYSTAL DISPLAY APPARATUS

(75) Inventor: Takuya Watanabe, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 101 days.

(21) Appl. No.: 09/927,360

(22) Filed: Aug. 13, 2001

(65) Prior Publication Data

US 2002/0041274 A1 Apr. 11, 2002

(30) Foreign Application Priority Data

Aug. 18, 2000 (JP) ..... 2000-248964

(51) Int. Cl.[7] ..... G09G 3/36
(52) U.S. Cl. ..... 345/100; 345/96
(58) Field of Search ..... 345/100, 96; 349/42, 349/54

(56) References Cited

U.S. PATENT DOCUMENTS

| | | | | |
|---|---|---|---|---|
| 5,892,494 A | * | 4/1999 | Kimura et al. | 345/96 |
| 5,959,599 A | * | 9/1999 | Hirakata | 345/92 |
| 6,304,241 B1 | * | 10/2001 | Udo et al. | 345/96 |
| 6,331,846 B1 | | 12/2001 | Nakao | |
| 6,335,719 B1 | * | 1/2002 | An et al. | 345/98 |
| 6,362,803 B1 | * | 3/2002 | Tomomura et al. | 345/94 |

FOREIGN PATENT DOCUMENTS

| | | |
|---|---|---|
| JP | 04-056888 A1 | 2/1992 |
| JP | 04-177292 A1 | 6/1992 |
| JP | 05-056374 A | 3/1993 |
| JP | 11-095729 A1 | 4/1999 |
| JP | 11-249623 | 9/1999 |
| JP | 11-249624 A | 9/1999 |

* cited by examiner

*Primary Examiner*—Richard Hjerpe
*Assistant Examiner*—M. Fatahiyar
(74) *Attorney, Agent, or Firm*—Birch, Stewart, Kolasch & Birch, LLP

(57) ABSTRACT

Driving apparatus and driving method of liquid crystal display apparatus of the present invention are provided with first and second amplifier circuits in an output circuit, switches a noninverted input signal and an inverted signal, and switches output signals of the respective first and second amplifier circuits so as to output the output signals that have been switched to pixels provided in a matrix manner. The driving apparatus and driving method are further provided with a changeover control circuit that switches the output signals of the first and second amplifier circuits so that an offset voltage applied to a pixel has a polarity that is reversed to a polarity of respective offset voltages applied to its surrounding pixels. This allows to provide driving apparatus and driving method of liquid crystal display apparatus in which the offset voltage of a pixel is canceled by the offset voltages of its surrounding pixels, without canceling the offset voltages in a several frames, thereby making the display unevenness indiscernible.

8 Claims, 41 Drawing Sheets

FIG. 4

(EVEN LINE PANEL)

FRAME ①

| | ① | ② | ③ | ④ | ⑤ | ⑥ | ⑦ | ⑧ | REV | SWP |
|---|---|---|---|---|---|---|---|---|---|---|
| ① | −A | −B | −A | −B | −A | −B | −A | −B | L | H |
| ② | +B | +A | +B | +A | +B | +A | +B | +A | H | L |
| ③ | −A | −B | −A | −B | −A | −B | −A | −B | L | H |
| ④ | +B | +A | +B | +A | +B | +A | +B | +A | H | L |
| ⑤ | −A | −B | −A | −B | −A | −B | −A | −B | L | H |
| ⑥ | +B | +A | +B | +A | +B | +A | +B | +A | H | L |
| ⑦ | −A | −B | −A | −B | −A | −B | −A | −B | L | H |
| ⑧ | +B | +A | +B | +A | +B | +A | +B | +A | H | L |

FRAME ②

| | ① | ② | ③ | ④ | ⑤ | ⑥ | ⑦ | ⑧ | | |
|---|---|---|---|---|---|---|---|---|---|---|
| ① | −B | −A | −B | −A | −B | −A | −B | −A | H | H |
| ② | +A | +B | +A | +B | +A | +B | +A | +B | L | L |
| ③ | −B | −A | −B | −A | −B | −A | −B | −A | H | H |
| ④ | +A | +B | +A | +B | +A | +B | +A | +B | L | L |
| ⑤ | −B | −A | −B | −A | −B | −A | −B | −A | H | H |
| ⑥ | +A | +B | +A | +B | +A | +B | +A | +B | L | L |
| ⑦ | −B | −A | −B | −A | −B | −A | −B | −A | H | H |
| ⑧ | +A | +B | +A | +B | +A | +B | +A | +B | L | L |

A:VOLTAGE HAVING POSITIVE POLARITY
B:VOLTAGE HAVING NEGATIVE POLARITY
+:POSITIVE OFFSET
−:NEGATIVE OFFSET

FIG. 5

(ODD LINE PANEL)

FRAME ①

| | ① | ② | ③ | ④ | ⑤ | ⑥ | ⑦ | ⑧ | REV | SWP |
|---|---|---|---|---|---|---|---|---|---|---|
| ① | −A | −B | −A | −B | −A | −B | −A | −B | L | H |
| ② | +B | +A | +B | +A | +B | +A | +B | +A | H | L |
| ③ | −A | −B | −A | −B | −A | −B | −A | −B | L | H |
| ④ | +B | +A | +B | +A | +B | +A | +B | +A | H | L |
| ⑤ | −A | −B | −A | −B | −A | −B | −A | −B | L | H |
| ⑥ | +B | +A | +B | +A | +B | +A | +B | +A | H | L |
| ⑦ | −A | −B | −A | −B | −A | −B | −A | −B | L | H |

FRAME ②

| | ① | ② | ③ | ④ | ⑤ | ⑥ | ⑦ | ⑧ | | |
|---|---|---|---|---|---|---|---|---|---|---|
| ① | +B | +A | +B | +A | +B | +A | +B | +A | H | L |
| ② | −A | −B | −A | −B | −A | −B | −A | −B | L | H |
| ③ | +B | +A | +B | +A | +B | +A | +B | +A | H | L |
| ④ | −A | −B | −A | −B | −A | −B | −A | −B | L | H |
| ⑤ | +B | +A | +B | +A | +B | +A | +B | +A | H | L |
| ⑥ | −A | −B | −A | −B | −A | −B | −A | −B | L | H |
| ⑦ | +B | +A | +B | +A | +B | +A | +B | +A | H | L |

A:VOLTAGE HAVING POSITIVE POLARITY
B:VOLTAGE HAVING NEGATIVE POLARITY
+:POSITIVE OFFSET
−:NEGATIVE OFFSET

FIG. 8

(EVEN LINE PANEL)

FRAME ① (EXTRACTION OF ONLY POSITIVE POLARITY A)

| | ① | ② | ③ | ④ | ⑤ | ⑥ | ⑦ | ⑧ | REV | SWP |
|---|---|---|---|---|---|---|---|---|---|---|
| ① | −A | | −A | | −A | | −A | | L | H |
| ② | | +A | | +A | | +A | | +A | H | L |
| ③ | −A | | −A | | −A | | −A | | L | H |
| ④ | | +A | | +A | | +A | | +A | H | L |
| ⑤ | −A | | −A | | −A | | −A | | L | H |
| ⑥ | | +A | | +A | | +A | | +A | H | L |
| ⑦ | −A | | −A | | −A | | −A | | L | H |
| ⑧ | | +A | | +A | | +A | | +A | H | L |

FRAME ② (EXTRACTION OF ONLY POSITIVE POLARITY A)

| | ① | ② | ③ | ④ | ⑤ | ⑥ | ⑦ | ⑧ | | |
|---|---|---|---|---|---|---|---|---|---|---|
| ① | | −A | | −A | | −A | | −A | H | H |
| ② | +A | | +A | | +A | | +A | | L | L |
| ③ | | −A | | −A | | −A | | −A | H | H |
| ④ | +A | | +A | | +A | | +A | | L | L |
| ⑤ | | −A | | −A | | −A | | −A | H | H |
| ⑥ | +A | | +A | | +A | | +A | | L | L |
| ⑦ | | −A | | −A | | −A | | −A | H | H |
| ⑧ | +A | | +A | | +A | | +A | | L | L |

FIG. 9

(EVEN LINE PANEL)

FRAME ① (EXTRACTION OF ONLY NEGATIVE POLARITY B)

| | ① | ② | ③ | ④ | ⑤ | ⑥ | ⑦ | ⑧ | REV | SWP |
|---|---|---|---|---|---|---|---|---|---|---|
| ① | | −B | | −B | | −B | | −B | L | H |
| ② | +B | | +B | | +B | | +B | | H | L |
| ③ | | −B | | −B | | −B | | −B | L | H |
| ④ | +B | | +B | | +B | | +B | | H | L |
| ⑤ | | −B | | −B | | −B | | −B | L | H |
| ⑥ | +B | | +B | | +B | | +B | | H | L |
| ⑦ | | −B | | −B | | −B | | −B | L | H |
| ⑧ | +B | | +B | | +B | | +B | | H | L |

FRAME ② (EXTRACTION OF ONLY NEGATIVE POLARITY B)

| | ① | ② | ③ | ④ | ⑤ | ⑥ | ⑦ | ⑧ | | |
|---|---|---|---|---|---|---|---|---|---|---|
| ① | −B | | −B | | −B | | −B | | H | H |
| ② | | +B | | +B | | +B | | +B | L | L |
| ③ | −B | | −B | | −B | | −B | | H | H |
| ④ | | +B | | +B | | +B | | +B | L | L |
| ⑤ | −B | | −B | | −B | | −B | | H | H |
| ⑥ | | +B | | +B | | +B | | +B | L | L |
| ⑦ | −B | | −B | | −B | | −B | | H | H |
| ⑧ | | +B | | +B | | +B | | +B | L | L |

FIG. 10

(ODD LINE PANEL)

FRAME ① (EXTRACTION OF ONLY POSITIVE POLARITY A)

| | ① | ② | ③ | ④ | ⑤ | ⑥ | ⑦ | ⑧ | REV | SWP |
|---|---|---|---|---|---|---|---|---|---|---|
| ① | −A | | −A | | −A | | −A | | L | H |
| ② | | +A | | +A | | +A | | +A | H | L |
| ③ | −A | | −A | | −A | | −A | | L | H |
| ④ | | +A | | +A | | +A | | +A | H | L |
| ⑤ | −A | | −A | | −A | | −A | | L | H |
| ⑥ | | +A | | +A | | +A | | +A | H | L |
| ⑦ | −A | | −A | | −A | | −A | | L | H |

FRAME ② (EXTRACTION OF ONLY POSITIVE POLARITY A)

| | ① | ② | ③ | ④ | ⑤ | ⑥ | ⑦ | ⑧ | | |
|---|---|---|---|---|---|---|---|---|---|---|
| ① | | +A | | +A | | +A | | +A | H | L |
| ② | −A | | −A | | −A | | −A | | L | H |
| ③ | | +A | | +A | | +A | | +A | H | L |
| ④ | −A | | −A | | −A | | −A | | L | H |
| ⑤ | | +A | | +A | | +A | | +A | H | L |
| ⑥ | −A | | −A | | −A | | −A | | L | H |
| ⑦ | | +A | | +A | | +A | | +A | H | L |

FIG. 11

(ODD LINE PANEL)

FRAME ① (EXTRACTION OF ONLY NEGATIVE POLARITY B)

| | ① | ② | ③ | ④ | ⑤ | ⑥ | ⑦ | ⑧ | REV | SWP |
|---|---|---|---|---|---|---|---|---|---|---|
| ① | | −B | | −B | | −B | | −B | L | H |
| ② | +B | | +B | | +B | | +B | | H | L |
| ③ | | −B | | −B | | −B | | −B | L | H |
| ④ | +B | | +B | | +B | | +B | | H | L |
| ⑤ | | −B | | −B | | −B | | −B | L | H |
| ⑥ | +B | | +B | | +B | | +B | | H | L |
| ⑦ | | −B | | −B | | −B | | −B | L | H |

FRAME ② (EXTRACTION OF ONLY NEGATIVE POLARITY B)

| | ① | ② | ③ | ④ | ⑤ | ⑥ | ⑦ | ⑧ | | |
|---|---|---|---|---|---|---|---|---|---|---|
| ① | +B | | +B | | +B | | +B | | H | L |
| ② | | −B | | −B | | −B | | −B | L | H |
| ③ | +B | | +B | | +B | | +B | | H | L |
| ④ | | −B | | −B | | −B | | −B | L | H |
| ⑤ | +B | | +B | | +B | | +B | | H | L |
| ⑥ | | −B | | −B | | −B | | −B | L | H |
| ⑦ | +B | | +B | | +B | | +B | | H | L |

FIG. 17 (a) PRIOR ART

FIG. 17 (b) PRIOR ART

FIG. 18 (a) PRIOR ART

FIG. 18 (b) PRIOR ART $$\text{AVERAGE OF PIXEL VOLTAGES} = \{(VH+A)+(VL-B)+(VH+A)+(VL-B)\} \div 4 = \frac{VH+VL}{2} + \frac{A-B}{2}$$

DRIVING APPARATUS AND DRIVING METHOD OF LIQUID CRYSTAL DISPLAY APPARATUS

FIELD OF THE INVENTION

The present invention relates to driving apparatus and driving method of liquid crystal display apparatus that is provided with a differential amplifier which outputs offset voltages, having positive and negative polarities whose amplitudes are equal to each other, that are happened to be generated due to the characteristic unevenness occurred by the manufacturing process.

BACKGROUND OF THE INVENTION

FIG. 6 is a block diagram showing a typical liquid crystal display apparatus, having TFTs, of active matrix type. 3801 shows a TFT liquid crystal panel, 3802 shows a source driver IC having a plurality of source drivers, 3803 shows a gate driver IC having a plurality of gate drivers, 3804 shows a control circuit, and 3805 shows a liquid crystal driving power source (a power source circuit).

The control circuit 3804 sends a vertical synchronizing signal to the gate driver IC 3803, and sends a horizontal synchronizing signal to the source driver IC 3802 and the gate driver IC 3803, respectively. Display data (respective display data that are separated to R, G, and B) that have been externally applied are sent to the source driver IC 3802 in a form of digital signal via the control circuit 3804. In the source driver IC 3802, the display data that have been inputted are latched in a time sharing manner, and then, are subjected to digital to analog conversion in synchronization with the horizontal synchronizing signal outputted from the control circuit 3804 so as to output an analog voltage for the gradation display via a liquid crystal driving output terminal.

FIG. 42 is a structural diagram of the TFT liquid crystal panel. 3901 shows a pixel electrode, 3902 shows a pixel capacity, 3903 shows a TFT switch (switching device), 3904 shows a source signal line, 3905 shows a gate signal line, and 3906 shows an opposite electrode.

To the source signal line 3904 a gradation display voltage that varies depending on the brightness of the display pixel is applied from the source driver IC 3802. To the gate signal lines 3905 scanning signals are applied from the gate driver IC 3803 so that the TFTs that are provided in a longitudinal direction are successively turned on. Voltages on the respective source signal lines 3904 are applied to the pixel electrodes 3901 that are connected with drains of the respective TFTs 3903 via the TFTs 3903 that are turned on. This causes the pixel capacity 3902 is formed between the pixel electrodes 3901 and the opposite electrode 3906, thereby resulting in that the light transmittance of the liquid crystal changes so as to carry out the display in accordance with the change in the light transmittance.

FIGS. 12 and 13 exemplify how the wave form of the liquid crystal driving voltage changes. 4001 and 4101 show wave forms of the driving voltages outputted from the source driver, respectively. 4002 and 4102 show wave forms of the driving voltages outputted from the gate driver, respectively. 4003 and 4103 show voltages (electric potentials) of the opposite electrodes. 4004 and 4104 show a voltage wave form of the pixel electrode.

The voltage (see the oblique lines in FIGS. 12 and 13) which is applied to the liquid crystal material is equal to the voltage difference between the pixel electrode 3901 and the opposite electrode 3906. It is necessary that the liquid crystal panel is driven by an alternating current voltage. FIG. 12 shows the following case. More specifically, when the output voltage of the source driver is greater than the voltage of the opposite electrode, the TFT 3903 is turned on in response to the output signal of the gate driver. A voltage showing a positive polarity with respect to the opposite electrode 3906 is applied to the pixel electrode 3901. Then, the TFT 3903 is turned off, so that such a voltage is maintained.

In contrast, FIG. 13 shows the following case More specifically, when the output voltage of the source driver is smaller than the voltage of the opposite electrode 3903, the TFT 3903 is turned on in response to the output signal of the gate driver. A voltage showing a negative polarity with respect to the opposite electrode 3906 is applied to the pixel electrode 3901. Then, the TFT 3903 is turned off, so that such a voltage is maintained. Thus, when the wave form voltages of FIGS. 12 and 13 are alternately applied, it is possible that the liquid crystal material is driven by the applied voltage that is an alternating voltage.

FIG. 14 exemplifies the polarity arrangement, on the liquid crystal panel 3801, for the alternating of the driving voltage. This is called as a dot reverse driving. According to this type of driving, within a single display screen (frame), the positive polarity and negative polarity are alternated in a right and left direction and in an up and down direction, and the polarities are reversed for every frame. According to the driving, in the source driver IC 3802, when the voltage having a positive polarity is outputted via the odd-numbered output terminal for example, the voltage having a negative polarity is outputted via the even-numbered output terminal. In contrast, when the voltage having a negative polarity is outputted via the odd-numbered output terminal, the voltage having a positive polarity is outputted via the even-numbered output terminal.

FIG. 15 exemplifies a driving wave form of the source driver in the dot reverse driving. In FIG. 15, 4301 shows the output voltage wave form of the odd-numbered output terminal. 4302 shows the output voltage wave form of the even-numbered output terminal. 4303 shows the voltage of the opposite electrode 3906. As shown in FIG. 15, the voltages showing reverse polarities with respect to the opposite electrode 3906 are always outputted from the odd-numbered output terminal and the even-numbered output terminal, respectively.

FIG. 16 is one example of the block showing a structure of the source driver IC 3802. Here, the following description only deals with the associated source driver. Note that since a well known gate driver is adopted, the explanation thereof is omitted here. The respective display data (R, G, B) of the digital signal that has been inputted are stored in a sampling memory 4404 in response to a shift register 4403 in a time sharing manner, and then are transmitted to a hold memory 4405 in synchronization with the horizontal synchronizing signal in a lump. The shift register 4403 operates in response to a start pulse and a clock (CK). The data of the hold memory 4405 are sent via a level shifter circuit 4406 to a D/A converter circuit 4407 so as to be converted into analog voltages, respectively. Such analog voltages are sent to an output circuit 4408 from which driving voltages for the gradation display (liquid crystal driving voltages) are outputted via respective liquid crystal output terminals. The respective display data are latched and maintained by the hold memory 4405 for a horizontal synchronizing period. Then, the display data are fetched and latched in synchronization with the next horizontal synchronizing signal.

FIGS. 17(*a*) and 17(*b*) are block diagrams exemplifying the output circuit of the source driver IC that carries out the dot reverse driving in accordance with a conventional art (the first conventional art) and showing the operation thereof. In FIGS. 17(*a*) and 17(*b*), only the blocks of the respective reference numerals 4405, 4407, and 4408 among the circuit elements shown in FIG. 16 are shown as circuits corresponding to two output terminals.

In FIGS. 17(*a*) and 17(*b*), 4501 shows a voltage follower which adopts operational amplifiers and is an output circuit that drives the odd-numbered output terminal. 4502 shows a voltage follower which adopts the same operational amplifiers as those of the voltage follower 4501 and is an output circuit that drives the even-numbered output terminal. Reference numerals 4503, 4504, 4505, and 4506 show switches for the output alternating that switches the polarity of the output voltage of the liquid crystal output, respectively. 4507 shows a D/A converter circuit in which a voltage having a positive polarity is subjected to the digital to analog conversion. 4508 shows a D/A converter circuit in which a voltage having a negative polarity is subjected to the digital to analog conversion. Reference numerals 4509 and 4510 show hold memories that hold the display data, respectively. 4511 shows the odd-numbered output terminal, and 4512 shows the even-numbered output terminal. In the operational amplifier 4501, a reference numeral 4513 is an operational amplifier of a N-channel MOS input type. In the operational amplifier 4502, a reference numeral 4514 is an operational amplifier of a N-channel MOS input type. In the operational amplifier 4501, a reference numeral 4515 is an operational amplifier of a P-channel MOS input type. In the operational amplifier 4502, a reference numeral 4516 is an operational amplifier of a P-channel MOS input type.

The following description deals with how the circuit having the foregoing structure carries out the alternating of the wave form of the liquid crystal driving.

When the switches 4503 through 4506 for the output alternating are in the states shown in FIG. 17(*a*), the display data for the odd-numbered output terminal 4511 that have been stored in the hold memory 4509 are sent to the D/A converter circuit 4507 for the positive polarity, and are subjected to the digital to analog conversion so as to output an analog voltage to a liquid crystal panel 3801 from the odd-numbered output terminal 4511 via the voltage follower 4501. In this case, the output voltage becomes a liquid crystal driving voltage having a positive polarity.

In contrast, when the switches 4503 through 4506 for the output alternating are in the states shown in FIG. 17(*b*), the display data for the odd-numbered output terminal 4511 that have been stored in the hold memory 4509 are sent to the D/A converter circuit 4508 for the negative polarity, and are subjected to the digital to analog conversion so as to output an analog voltage to the liquid crystal panel 3801 from the odd-numbered output terminal 4511 via the voltage follower 4501. In this case, the output voltage becomes a liquid crystal driving voltage having a negative polarity.

The polarity of the driving voltage of the even-numbered output terminal 4512 is reversed to that of the odd-numbered output terminal 4511. Namely, when the switches 4503 through 4506 for the output alternating are in the states shown in FIG. 17(*a*), the display data for the even-numbered output terminal 4512 that have been stored in the hold memory 4510 are sent to the D/A converter circuit 4508 for the negative polarity, and are subjected to the digital to analog conversion so as to output an analog voltage to the liquid crystal panel 3801 from the even-numbered output terminal 4512 via the voltage follower 4502. In this case, the output voltage becomes a liquid crystal driving voltage having a negative polarity.

In contrast, when the switches 4503 through 4506 for the output alternating are in the states shown in FIG. 17(*b*), the display data for the even-numbered output terminal 4512 that have been stored in the hold memory 4510 are sent to the D/A converter circuit 4507 for the positive polarity, and are subjected to the digital to analog conversion so as to output an analog voltage to the liquid crystal panel 3801 from the even-numbered output terminal 4512 via the voltage follower 4502. In this case, the output voltage becomes a liquid crystal driving voltage having a positive polarity. In FIGS. 17(*a*) and 17(*b*), the signal flowing of the odd-numbered output terminal is shown among the foregoing operations. Thus, the states shown in FIGS. 17(*a*) and 17(*b*) are alternately switched by the switches 4503 through 4506 for the output alternating in accordance with the frame reversion, thereby carrying out the alternating of the driving wave form required for driving the liquid crystal panel 3801.

According to the circuit configuration shown in FIGS. 17(*a*) and 17(*b*), a single output terminal is always driven by the same operational amplifiers both for the case of the output of the voltage having a positive polarity and the output of the voltage having a negative polarity. In general, as one of the important functions of the output terminal of the liquid crystal driving circuit, the output dynamic range having a full range of the operating power source voltages is required. When it is assumed to use MOS transistors of enhance type that are used in a general LSI, in order not to have areas in which the MOS transistors do not appropriately operate with their threshold voltages, it is necessary that a single output circuit 4501 has both the operational amplifier 4513 of N-channel MOS transistor input type and the operational amplifier 4515 of P-channel MOS transistor input type. This causes the scale of the circuit to become large so as to result in the increase of the chip size in the case where the output circuit is subjected to the LSI. Furthermore, the power consumption of the circuit becomes large because two operational amplifier circuits are provided per one output.

FIGS. 18(*a*) and 18(*b*) are block diagrams exemplifying the output circuit of the source driver IC that carries out the dot reverse driving in accordance with another conventional art (the second conventional art) and showing the operation thereof. In FIGS. 18(*a*) and 18(*b*), only the blocks of the respective reference numerals 4405, 4407, and 4408 among the circuit elements shown in FIG. 16 are shown as circuits corresponding to two output terminals.

In FIGS. 18(*a*) and 18(*b*), 4601 shows a voltage follower using an operational amplifier of N-channel MOS transistor input type. 4602 shows a voltage follower using an operational amplifier of P-channel MOS transistor input type. Reference numerals 4603, 4604, 4605, and 4606 show switches for switching the polarity of the liquid crystal driving output voltage. 4607 shows a D/A converter circuit in which a voltage having a positive polarity is subjected to the digital to analog conversion. 4608 shows a D/A converter circuit in which a voltage having a negative polarity is subjected to the digital to analog conversion. Reference numerals 4609 and 4610 show hold memories that hold the display data, respectively. 4611 shows the odd-numbered output terminal, and 4612 shows the even-numbered output terminal.

The alternating of the output voltage shown in FIGS. 18(*a*) and 18(*b*), like the case shown in FIGS. 17(*a*) and 17(*b*), is carried out by the switches 4503 through 4506 for the output alternating. The difference therebetween resides in the following points (a) through (c). Namely, (a) the output signal of the D/A converter circuit 4607 for the positive polarity is directly sent to the operational amplifier 4601 of N-channel MOS transistor input type, (b) the output signal of the D/A converter circuit 4608 for the negative polarity is directly sent to the operational amplifier 4602 of P-channel MOS transistor input type, and (c) the output signals of the respective operational amplifiers are sent to target output terminals via the switches 4603 and 4604.

Note that it is necessary to only provide a circuit of N-channel input type as the operational amplifier because the D/A converter circuit 4607 for the positive polarity outputs a signal having a voltage of not less than the half of the operating power source voltage. Similarly, it is necessary to only provide a circuit of P-channel input type as the operational amplifier because the D/A converter circuit 4608 for the positive polarity outputs a signal having a voltage of not more than the half of the operating power source voltage. According to the structure shown in FIGS. 18(*a*) and 18(*b*), the number of the operational amplifiers for each output terminal is reduced to half of the structure shown in FIGS. 17(*a*) and 17(*b*). This allows to reduce the size of a chip and ensure the low power consumption.

However, according to the structure shown in FIGS. 18(*a*) and 18(*b*), the operational amplifier that drives a single output has a configuration that varies depending on whether it is of positive polarity type or of negative polarity type. More specifically, the output terminal for the liquid crystal driving shown in FIGS. 18(*a*) and 18(*b*) is driven by the operational amplifier 4601 when a voltage having positive polarity should be outputted (see FIG. 18(*a*)), while the output terminal is driven by the operational amplifier 4602 when a voltage having negative polarity should be outputted (see FIG. 18(*b*)). The following description deals with a case where the operational amplifiers 4601 and 4602 have offset voltages that happen to be generated due to the reason such as the unevenness of the characteristics occurred by the manufacturing process, respectively.

FIG. 19 shows wave forms of the liquid crystal voltage in the case where the operational amplifier 4601 has an offset voltage A that happens to be generated and the operational amplifier 4602 has an offset voltage B that happens to be generated. As shown in FIG. 19, the deviations from respective expectation voltages vary depending on whether a voltage having positive or negative polarity should be outputted. Accordingly, the average voltage of the driving voltages that are applied to the liquid crystal display pixel contains a component of (A–B) indicative of the difference between the two deviations as an error voltage. The error voltage happens to be generated for every driving output terminals. This allows to occur the difference in the voltages applied to the respective pixels in the liquid crystal display apparatus. This causes the unevenness of display.

For comparison, FIG. 20 shows the wave form of the liquid crystal driving voltage for the structure shown in FIGS. 17(*a*) and 17(*b*). According to the structure shown in FIGS. 17(*a*) and 17(*b*), a single output circuit drives the voltages having positive and negative polarities, respectively. This results in that the deviations from the respective expectation voltages are always equal to each other. The deviations are functioned to be canceled between the voltages having positive and negative polarities which are applied to the pixel. According to the structure shown in FIGS. 17(*a*) and 17(*b*), the unevenness of the deviations among the output terminals for the liquid crystal driving is averaged in the display pixel. Thus, no problem arises during the display.

The foregoing second conventional art (see FIG. 18) deals with the case where the voltages having positive and negative polarities should be outputted by the separate operational amplifier circuits, respectively. In contrast, well known is the third conventional art (for example, see Japanese unexamined patent publication No. 11-305735 in which a further circuit scale and power consumption are reduced. The following description deals with the third conventional art with reference to FIG. 21.

FIG. 21 exemplifies the structure of a differential amplifier circuit in accordance with the third conventional art. Note that FIG. 21 shows the case where N-channel MOS transistors are used as the inputting transistors.

In FIG. 21, the reference numerals 101 and 102 indicate the input transistors of N-channel MOS type, respectively. The reference numeral 103 indicates a constant current source that supplies the differential amplifier circuit with the operational current. The reference numeral 104 indicates a load resistor (resistor element) of the input transistor 101. The reference numeral 105 indicates a load resistor (resistor element) of the input transistor 102. The reference numerals 106 and 107 indicate switches for respectively switching the input signal. The reference numerals 108 and 109 indicate switches for respectively switching the output signal. The reference numeral 110 indicates a noninverted input terminal (common-mode input terminal). The reference numeral 111 indicates an inverted input terminal (reverse-phase input terminal). The reference numeral 112 indicates a noninverted output terminal. The reference numeral 113 indicates an inverted output terminal. The reference numeral 114 indicates a changeover signal input terminal via which a signal for simultaneously switching the switches 106 through 109 is inputted.

A differential amplifier circuit is composed of the input transistor 101, the load resistor 104, the input transistor 102, and the load resistor 105. The input transistors 101 and 102 constitute a differential pair. The switches 106 through 109 are controlled by the changeover signal 114 in an interlocking manner.

FIG. 22 shows one example of operation of the circuit shown in FIG. 21. FIG. 23 shows another example of operation of the circuit shown in FIG. 21. The following description deals with the operation of the differential amplifier circuit with reference to FIGS. 22 and 23.

According to the operation shown in FIG. 22, the noninverted input terminal 110 is connected with the gate of the input transistor 101 via the switch 106. An input signal inputted via the noninverted input terminal 110 is outputted by the function of the load resistor 104, that is connected with the drain of the input transistor 101, from an inverted output terminal 113 as an inverted output signal via the switch 109. The inverted input terminal 111 is connected with the gate of the input transistor 102 via the switch 107. An input signal inputted via the inverted input terminal 111 is outputted by the function of the load resistor 105, that is connected with the drain of the input transistor 102, from a noninverted output terminal 112 as a noninverted output signal via the switch 108. Namely, the noninverted input signal is amplified by the input transistor 101 and the load resistor 104, while the inverted input signal is amplified by the input transistor 102 and the load resistor 105.

In contrast, according to the operation shown in FIG. 23, the noninverted input terminal 110 is connected with the gate of the input transistor 102 via the switch 107. An input signal inputted via the noninverted input terminal 110 is outputted by the function of the load resistor 105, that is connected with the drain of the input transistor 102, from the inverted output terminal 113 as an inverted output signal via the switch 109. The inverted input terminal 111 is connected with the gate of the input transistor 101 via the switch 106. An input signal inputted via the inverted input terminal 111 is outputted by the function of the load resistor 104, that is connected with the drain of the input transistor 101, from the noninverted output terminal 112 as a noninverted output signal via the switch 108. Namely, the noninverted input signal is amplified by the input transistor 102 and the load resistor 105, while the inverted input signal is amplified by the input transistor 101 and the load resistor 104.

As mentioned above, the amplifier circuits for the noninverted input signal and for the inverted input signal are entirely changed and used according to the operations shown in FIGS. 22 and 23.

With reference to FIGS. 24 and 25, the following description deals with the case where there exists the discrepancy of the characteristics, that happens to occur due to the reason of the manufacturing process or other reasons, between the input transistors 101 and 102 and/or the load resistors 104 and 105 that constitute the differential amplifier circuit.

When the difference between the two circuit elements that should have originally the same characteristic occurs, each output voltage deviates from its ideal voltage, so that an offset voltage occurs. Such deviations can be explained by a model in which one of the input terminals is connected with a constant voltage source. FIGS. 24 and 25 show an example. The reference numeral 115 shown in FIG. 24 and 25 is the model of the offset voltage that is realized by a single constant voltage source. Note that the switching device shown in FIG. 24 is in the same conditions as those shown in FIG. 22, and that the switching device shown in FIG. 25 is in the same conditions as those shown in FIG. 23.

In FIG. 24, the constant voltage source 115 is connected with the inverted input terminal 111 via the switch 107. In FIG. 25, the constant voltage source 115 is connected with the noninverted input terminal 110 via the switch 107. Thus, the differential amplifier circuit uses the switches 106 through 109. This allows to switch between (a) the condition in which an offset that happens to occur due to the unevenness in the differential amplifier circuit is inputted to the inverted input terminal 111 and (b) the condition in which such an offset is inputted to the noninverted input terminal 110. According to such two kinds of conditions, the offsets of the noninverted output terminal 110 and the inverted output terminal 111 have a same absolute value and have polarities that are reversed to each other.

Thus, in the case where the operational amplifier has an offset voltage that happens to be generated due to the reasons such as the characteristic unevenness occurred by the manufacturing process, (a) the deviation from the expectation voltage when the offset voltage having positive polarity should be outputted and (b) the deviation from the expectation voltage when the offset voltage having negative polarity should be outputted are equal to each other.

FIG. 26 shows another example of the differential amplifier circuit in accordance with the second conventional art. FIG. 26 shows the case in which P-channel MOS transistors are used as the input transistors.

In FIG. 26, the reference numerals 601 and 602 indicate the input transistors of P-channel MOS type, respectively. The reference numeral 603 indicates a constant current source that supplies the differential amplifier circuit with the operational current. The reference numeral 604 indicates a load resistor (resistor element) of the input transistor 601. The reference numeral 605 indicates a load resistor (resistor element) of the input transistor 602. The reference numerals 606 and 607 indicate switches for respectively switching the input signals. The reference numerals 608 and 609 indicate switches for respectively switching the output signals. The reference numeral 610 indicates a noninverted input terminal (common-mode input terminal). The reference numeral 611 indicates an inverted input terminal (reverse-phase input terminal). The reference numeral 612 indicates a noninverted output terminal. The reference numeral 613 indicates an inverted output terminal. The reference numeral 614 indicates a changeover signal input terminal via which a signal for simultaneously switching the switches 606 through 609 is inputted.

The following description deals with the operation of FIG. 26 with reference to FIGS. 27 and 28.

According to the operation shown in FIG. 27, the noninverted input terminal 610 is connected with the gate of the input transistor 601 via the switch 606. An input signal inputted via the noninverted input terminal 610 is outputted by the function of the load resistor 604, that is connected with the drain of the input transistor 601, from an inverted output terminal 613 as an inverted output signal via the switch 609. The inverted input terminal 611 is connected with the gate of the input transistor 602 via the switch 607. An input signal inputted via the inverted input terminal 611 is outputted by the function of the load resistor 605, that is connected with the drain of the input transistor 602, from a noninverted output terminal 612 as a noninverted output signal via the switch 608. Namely, the noninverted input signal is amplified by the input transistor 601 and the load resistor 604, while the inverted input signal is amplified by the input transistor 602 and the load resistor 605.

In contrast, according to the operation shown in FIG. 28, the noninverted input terminal 610 is connected with the gate of the input transistor 602 via the switch 607. An input signal inputted via the noninverted input terminal 610 is outputted by the function of the load resistor 605, that is connected with the drain of the input transistor 602, from the inverted output terminal 613 as an inverted output signal via the switch 609. The inverted input terminal 611 is connected with the gate of the input transistor 601 via the switch 606. An input signal inputted via the inverted input terminal 611 is outputted by the function of the load resistor 604, that is connected with the drain of the input transistor 601, from the noninverted output terminal 612 as a noninverted output signal via the switch 608. Namely, the noninverted input signal is amplified by the input transistor 602 and the load resistor 605, while the inverted input signal is amplified by the input transistor 601 and the load resistor 604.

As mentioned above, the amplifier circuits for the noninverted input signal and for the inverted input signal are entirely changed and used according to the operations shown in FIGS. 27 and 28.

With reference to FIGS. 29 and 30, the following description deals with the case where there exists the discrepancy of the characteristics, that happens to occur due to the reason of the manufacturing process or other reasons, between the input transistors 601 and 602 and/or the load resistors 604 and 605 that constitute the differential amplifier circuit.

When the difference between the two circuit elements that should have originally the same characteristic occurs, each output voltage deviates from its ideal voltage, so that an offset voltage occurs. Such deviations can be explained by a model in which one of the input terminals is connected with a constant voltage source. FIGS. 29 and 30 show an example. The reference numeral 615 shown in FIG. 29 and 30 is the model of the offset voltage that is realized by a single constant voltage source. Note that the switching device shown in FIG. 29 is in the same conditions as those shown in FIG. 27, and that the switching device shown in FIG. 30 is in the same conditions as those shown in FIG. 28.

In FIG. 29, the constant voltage source 615 is connected with the inverted input terminal 611 via the switch 607. In FIG. 30, the constant voltage source 615 is connected with the noninverted input terminal 610 via the switch 607. Thus, the differential amplifier circuit uses the switches 606 through 609. This allows to switch between (a) the condition in which an offset that happens to occur due to the unevenness in the differential amplifier circuit is inputted to the inverted input terminal 611 and (b) the condition in which such an offset is inputted to the noninverted input terminal. According to such two kinds of conditions, the offsets of the noninverted output terminal 610 and the inverted output terminal 611 have a same absolute value and have polarities that are reversed to each other.

Thus, in the case where the operational amplifier has an offset voltage that happens to be generated due to the reasons such as the characteristic unevenness occurred by the manufacturing process, (a) the deviation from the expectation voltage when the offset voltage having positive polarity should be outputted and (b) the deviation from the expectation voltage when the offset voltage having negative polarity should be outputted are equal to each other.

FIG. 31 shows a circuit configuration in which the load element of the differential amplifier circuit shown in FIG. 21 is replaced with an active load having a current mirror structure. FIG. 31 shows the case where N-channel MOS transistors are used as the input transistors.

In FIG. 31, the reference numerals 1101 and 1102 indicate the input transistors of N-channel MOS type, respectively. The reference numeral 1103 indicates a constant current source that supplies the differential amplifier circuit with the operational current. The reference numeral 1104 indicates a load transistor, made of P-channel MOS, of the input transistor 1101. The reference numeral 1105 indicates a load transistor, made of P-channel MOS, of the input transistor 1102. The reference numerals 1106 and 1107 indicate switches for respectively switching the input signals. The reference numerals 1108 and 1109 indicate switches for respectively switching the output signals. The reference numeral 1110 indicates a noninverted input terminal (common-mode input terminal). The reference numeral 1111 indicates an inverted input terminal (reverse-phase input terminal). The reference numeral 1112 indicates a noninverted output terminal. The reference numeral 1113 indicates an inverted output terminal. The reference numeral 1114 indicates a changeover signal input terminal via which a signal for simultaneously switching the switches 1106 through 1109 is inputted.

The differential amplifier circuit is different from the structure (passive load) shown in FIG. 21 in that the load element is an active load having such a current mirror structure made of transistors. In the operation corresponding to the operation shown in FIG. 22, a noninverted input signal is amplified by the input transistor 1101 and the load transistor 1104, while an inverted input signal is amplified by the input transistor 1102 and the load transistor 1105. In contrast, in the operation corresponding to the operation shown in FIG. 23, a noninverted input signal is amplified by the input transistor 1102 and the load transistor 1105, while an inverted input signal is amplified by the input transistor 1101 and the load transistor 1104.

According to any one of the foregoing cases, the load transistors 1104 and 1105 constitute a current mirror structure. This allows that the current flowing through the load transistors 1104 and 1105 are always equal to each other even when the characteristic unevenness occurs between the two load transistors 1104 and 1105. This results in that the noninverted input signal and the inverted input signal are amplified in accordance with the same amplification, thereby ensuring to obtain an output wave form that is bisymmetry.

As mentioned above, the amplifier circuits for the noninverted input signal and for the inverted input signal are entirely changed and used even in the case of the structure shown in FIG. 31.

Even in the case where there exists the discrepancy of the characteristics, that happens to occur due to the reason of the manufacturing process or other reasons, between the input transistors 1101 and 1102 that constitute the differential amplifier circuit, the structure similar to that shown in FIG. 21 is realized although the detail is not described here. Thus, the differential amplifier circuit uses the switches 1106 through 1109. This allows to switch between (a) the condition in which an offset that happens to occur due to the unevenness in the differential amplifier circuit is inputted to the inverted input terminal 1111 and (b) the condition in which such an offset is inputted to the noninverted input terminal 1110. According to such two kinds of conditions, the offsets of the noninverted output terminal 1110 and the inverted output terminal 1111 have a same absolute value and have polarities that are reversed to each other.

Thus, in the case where the operational amplifier has an offset voltage that happens to be generated due to the reasons such as the characteristic unevenness occurred by the manufacturing process, (a) the deviation from the expectation voltage when the offset voltage having positive polarity should be outputted and (b) the deviation from the expectation voltage when the offset voltage having negative polarity should be outputted are equal to each other.

FIG. 32 shows a circuit configuration in which the load element of the differential amplifier circuit shown in FIG. 26 is replaced with an active load having a current mirror structure. FIG. 32 shows the case in which P-channel MOS transistors are used as the input transistors.

In FIG. 32, the reference numerals 1201 and 1202 indicate the input transistors of P-channel MOS type, respectively. The reference numeral 1203 indicates a constant current source that supplies the differential amplifier circuit with the operational current. The reference numeral 1204 indicates a load transistor (resistor element) of the input transistor 1201. The reference numeral 1205 indicates a load transistor (resistor element) of the input transistor 1202. The reference numerals 1206 and 1207 indicate switches for respectively switching the input signals. The reference numerals 1208 and 1209 indicate switches for respectively switching the output signals. The reference numeral 1210 indicates a noninverted input terminal (common-mode input terminal). The reference numeral 1211 indicates an inverted input terminal (reverse-phase input terminal). The reference numeral 1212 indicates a noninverted output terminal. The reference numeral 1213 indicates an inverted output terminal. The reference numeral 1214 indicates a changeover signal input terminal via which a signal for simultaneously switching the switches 1206 through 1209 is inputted.

The circuit configuration shown in FIG. 32 is different from the structure (passive load) shown in FIG. 26 in that the load element is an active load having such a current mirror structure made of transistors. In the operation corresponding to the operation shown in FIG. 27, a noninverted input signal is amplified by the input transistor 1201 and the load transistor 1204, while an inverted input signal is amplified by the input transistor 1202 and the load transistor 1205. In contrast, in the operation corresponding to the operation shown in FIG. 28, a noninverted input signal is amplified by the input transistor 1202 and the load transistor 1205, while an inverted input signal is amplified by the input transistor 1201 and the load transistor 1204.

According to any one of the foregoing cases, the load transistors 1204 and 1205 constitute a current mirror structure. This allows that the current flowing through the load transistors 1204 and 1205 are always equal to each other even when the characteristic unevenness occurs between the two load transistors 1204 and 1205. This results in that the noninverted input signal and the inverted input signal are amplified in accordance with the same amplification, thereby ensuring to obtain an output wave form that is bisymmetry.

As mentioned above, the amplifier circuits for the noninverted input signal and for the inverted input signal are entirely changed and used even in the case of the structure shown in FIG. 32.

Even in the case where there exists the discrepancy of the characteristics, that happens to occur due to the reason of the manufacturing process or other reasons, between the input transistors 1201 and 1202 that constitute the differential amplifier circuit, the structure similar to that shown in FIG. 26 is realized although the detail is not described here. Thus, the differential amplifier circuit uses the switches 1206 through 1209. This allows to switch between (a) the condition in which an offset that happens to occur due to the unevenness in the differential amplifier circuit is inputted to the inverted input terminal 1211 and (b) the condition in which such an offset is inputted to the noninverted input terminal 1210. According to such two kinds of conditions, the offsets of the noninverted output terminal 1210 and the inverted output terminal 1211 have a same absolute value and have polarities that are reversed to each other.

Thus, in the case where the operational amplifier has an offset voltage that happens to be generated due to the reasons such as the characteristic unevenness occurred by the manufacturing process, (a) the deviation from the expectation voltage when the offset voltage having positive polarity should be outputted and (b) the deviation from the expectation voltage when the offset voltage having negative polarity should be outputted are equal to each other.

The following description deals with an example which embodies a differential amplifier circuit 1301 that is equivalent to the differential amplifier circuit shown in FIG. 31, switches, and an output section with reference to FIG. 33. Note that each of the operational amplifiers shown in FIG. 33 is of N-channel MOS input type.

In FIG. 33, the reference numeral 1302 indicates a noninverted input terminal, the reference numeral 1303 indicates an inverted input terminal. The reference numerals 1304 and 1305 indicate switch changeover input terminals, respectively. The reference numerals 1306 through 1309 indicate switches, respectively. The reference numerals 1310 through 1313 indicate switches, respectively. The reference numerals 1314 and 1315 are input transistors of N-channel MOS type, respectively. The reference numerals 1316 and 1317 indicate load transistors of P-channel MOS type that are active loads for the input transistors, respectively. The reference numeral 1318 indicates an output transistor of P-channel MOS type. The reference numeral 1319 indicates an output transistor of N-channel MOS type. The reference numeral 1320 indicates an output terminal. The reference numeral 1321 indicates a bias voltage input terminal for providing an operating point. A circuit in which the differential amplifier circuit 1301 is replaced with the load resistor shown in FIG. 21 carries out the same operations. Therefore, the detail explanation is omitted here.

In FIG. 33, the reference numerals 1304 and 1305 correspond to the switch changeover signal input terminal 1114. The terminals 1304 and 1305 receive respective signals whose polarities are reversed to each other. The following description deals with the circuit operation in accordance with the switch changeover signal that has been inputted with reference to FIGS. 34 and 35.

In FIG. 33, the input transistors 1314 and 1315 correspond to the input transistors 1101 and 1102 shown in FIG. 31, respectively. The load transistors 1316 and 1317 correspond to the load transistors 1104 and 1105 shown in FIG. 31, respectively.

In FIG. 33, the reference numerals 1307 and 1309 correspond to the switch 1106 shown in FIG. 31, the reference numerals 1306 and 1308 correspond to the switch 1107 shown in FIG. 31, the reference numerals 1310 and 1313 correspond to the switch 1108 shown in FIG. 31, the reference numerals 1311 and 1312 correspond to the switch 1109 shown in FIG. 31, and a transistor 1322 corresponds to the constant current source 1103 shown in FIG. 31.

When a signal of "L" level (low level) is applied to the switch changeover signal input terminal 1304, the switches 1306, 1307, 1310, and 1311 are turned on, because the switches are P-channel MOS transistors (see FIG. 34). In this case, since a signal of "H" level (high level) is applied to the switch changeover signal input terminal 1305, the switches 1308, 1309, 1312, and 1313 are turned off. A noninverted input signal 1302 is sent to the input transistor 1315 via the switch 1306. An inverted input signal 1303 is sent to the input transistor 1314 via the switch 1307. A gate signal is sent to the load transistors 1316 and 1317 via the switch 1310. A gate signal is sent to the output transistor 1318 via the switch 1311. In the case of FIG. 34, the noninverted input signal is amplified by the circuit that is constituted by the input transistor 1315 and the load transistor 1317, while the inverted input signal is amplified by the circuit that is constituted by the input transistor 1314 and the load transistor 1316.

When a signal of "L" level is applied to the switch changeover signal input terminal 1305, the switches 1308, 1309, 1312, and 1313 are turned on, in FIG. 35. In this case, since a signal of "H" level is applied to the switch changeover signal input terminal 1304, the switches 1306, 1307, 1310, and 1311 are turned off. The noninverted input signal 1302 is sent to the input transistor 1314 via the switch 1308. The inverted input signal 1303 is sent to the input transistor 1315 via the switch 1309. The gate signal is sent to the load transistors 1316 and 1317 via the switch 1313. The gate signal is sent to the output transistor 1318 via the switch 1312. In the case of FIG. 35, the noninverted input signal is amplified by the circuit that is constituted by the input transistor 1314 and the load transistor 1316, while the inverted input signal is amplified by the circuit that is constituted by the input transistor 1315 and the load transistor 1317.

As shown in FIGS. 34 and 35, the present differential amplifier circuit switches the switches 1306 through 1313 so that the amplifier circuits for the noninverted input signal and for the inverted input signal can be replaced with each other. This allows that even when offsets that happen to occur due to the unevenness in the manufacturing process of the differential amplifier circuit is generated, the offsets have a same absolute value and have polarities that are reversed to each other for the foregoing two conditions. Accordingly, it can be realized by changing the switches 1306 through 1313 that the offsets, having the unevenness, occurred in the operational amplifier have a same absolute value and have polarities that are reversed to each other.

The following description deals with an example which embodies a differential amplifier circuit 1601 that is equivalent to the differential amplifier circuit shown in FIG. 32, switches, and an output section with reference to FIG. 36. Note that each of the operational amplifiers shown in FIG. 36 is of N-channel MOS input type.

In FIG. 36, the reference numeral 1602 indicates a noninverted input terminal, the reference numeral 1603 indicates an inverted input terminal. The reference numerals 1604 and 1605 indicate switch changeover input terminals, respectively. The reference numerals 1606 through 1609 and 1610 through 1613 indicate switches, respectively. The reference numerals 1614 and 1615 are input transistors of P-channel MOS type, respectively. The reference numerals 1616 and 1617 indicate load transistors of N-channel oh MOS type that are active loads for the input transistors, respectively. The reference numeral 1618 indicates an output transistor of N-channel MOS type. The reference numeral 1619 indicates an output transistor of P-channel MOS type. The reference numeral 1620 indicates an output terminal. The reference numeral 1621 indicates a bias voltage input terminal for providing an operating point. A circuit in which the differential amplifier circuit 1601 is replaced with the load resistor shown in FIG. 26 carries out the same operations as follows. Therefore, the detail explanation is omitted here.

In FIG. 36, the reference numerals 1604 and 1605 correspond to the switch changeover signal input terminal 1214. The terminals 1604 and 1605 receive respective signals whose polarities are reversed to each other. The following description deals with the circuit operation in accordance with the switch changeover signal that has been inputted with reference to FIGS. 37 and 38.

In FIG. 36, the input transistors 1614 and 1615 correspond to the input transistors 1201 and 1202 shown in FIG. 32, respectively. The load transistors 1616 and 1617 correspond to the load transistors 1204 and 1205 shown in FIG. 32, respectively. In FIG. 36, the reference numerals 1607 and 1609 correspond to the switch 1206 shown in FIG. 32, the reference numerals 1606 and 1608 correspond to the switch 1207 shown in FIG. 32, the reference numerals 1611 and 1612 correspond to the switch 1209 shown in FIG. 32, and the reference numeral 1622 corresponds to the constant current source 1203 in FIG. 32.

When a signal of "H" level (high level) is applied to the switch changeover signal input terminal 1604, the switches 1606, 1607, 1610, and 1611 are turned on, because the switches are of N-channel MOS type transistors (see FIG. 37). In this case, since a signal of "L" level (low level) is applied to the switch changeover signal input terminal 1605, the switches 1608, 1609, 1612, and 1613 are turned off. A noninverted input signal 1602 is sent to the input transistor 1615 via the switch 1606. An inverted input signal 1603 is sent to the input transistor 1614 via the switch 1607. A gate signal is sent to the load transistors 1616 and 1617 via the switch 1610. A gate signal is sent to the output transistor 1618 via the switch 1611. In the case of FIG. 37, the noninverted input signal is amplified by the circuit that is constituted by the input transistor 1615 and the load transistor 1617, while the inverted input signal is amplified by the circuit that is constituted by the input transistor 1614 and the load transistor 1616.

When a signal of "H" level is applied to the switch changeover signal input terminal 1605, the switches 1608, 1609, 1612, and 1613 are turned on, in FIG. 38. In this case, since a signal of "L" level is applied to the switch changeover signal input terminal 1604, the switches 1606, 1607, 1610, and 1611 are turned off. The noninverted input signal 1602 is sent to the input transistor 1614 via the switch 1608. The inverted input signal 1603 is sent to the input transistor 1615 via the switch 1609. The gate signal is sent to the load transistors 1616 and 1617 via the switch 1613. The gate signal is sent to the output transistor 1618 via the switch 1612. In the case of FIG. 38, the noninverted input signal is amplified by the circuit that is constituted by the input transistor 1614 and the load transistor 1616, while the inverted input signal is amplified by the circuit that is constituted by the input transistor 1615 and the load transistor 1617.

As shown in FIGS. 37 and 38, the present differential amplifier circuit switches the respective switches 1606 through 1613 so that the amplifier circuits for the noninverted input signal and for the inverted input signal can be replaced with each other. This allows that even when offsets that happen to occur due to the unevenness in the manufacturing process of the differential amplifier circuit is generated, the offsets have a same absolute value and have polarities that are reversed to each other for the foregoing two conditions. Accordingly, it can be realized by changing the switches 1606 through 1613 that the offsets, having the unevenness, occurred in the operational amplifier have a same absolute value and have polarities that are reversed to each other. Note that a dotted line indicates the flow of the signals in FIGS. 37 and 38.

FIGS. 39 and 40 are block diagrams showing a liquid crystal driving circuit that adopts the foregoing differential amplifier circuit and carries out the dot reverse driving. FIGS. 39 and 40 respectively show only the part of two neighboring output circuits, and show the respective operations for the case where the polarity of the liquid crystal driving voltage is changed.

In FIGS. 39 and 40, the reference numeral 2101 indicates the operational amplifier of N-channel MOS transistor input type shown in FIG. 33, the reference numeral 2102 indicates the operational amplifier of P-channel MOS transistor input type shown in FIG. 36. The reference numeral 2103 indicates a D/A converter circuit that generates a liquid crystal driving voltage having a positive polarity. The reference numeral 2104 indicates a D/A converter circuit that generates a liquid crystal driving voltage having a negative polarity. The reference numerals 2105 through 2108 indicate switches by which the liquid crystal driving voltage is made to be an A. C. voltage. The reference numeral 2109 indicates a latch circuit that stores the display data of the odd-numbered output terminals, and the reference numeral 2110 indicates a latch circuit that stores the display data of the even-numbered output terminals. The reference numeral 2111 indicates the odd-numbered output terminal, and the reference numeral 2112 indicates the even-numbered output terminal. The reference numeral 2113 indicates an alternation switch changeover signal input, and the reference numeral 2114 indicates the switch changeover signal for the operational amplifier shown in FIGS. 33 and 36. Note that the latch circuits 2109 and 2110 indicate the hold memory shown in FIG. 16 and the explanation is made without a level shifter circuit (with omitting a level shifter circuit).

The following description deals with the operation of the odd-numbered output terminal with reference to these drawings. As to the even-numbered output terminal, the same operation is carried out except for the fact that the polarity of the driving voltage is reversed to that of the odd-numbered output terminal. Therefore, the detail explanation is omitted here.

FIG. 39 shows the case where (a) a driving voltage having positive polarity is outputted via the odd-numbered output terminal 2111 and (b) a driving voltage having negative polarity via the even-numbered output terminal 2112. In this case, the display data that has been inputted via the odd-numbered output terminal is sent from the latch circuit 2109 to the positive-polarity D/A converter circuit 2103 via the switch 2105. The output signal of the positive-polarity D/A converter circuit 2103 is sent to the operational amplifier 2101 so as to be outputted from the odd-numbered output terminal 2111 via the switch 2107 (see the thick line shown in FIG. 39).

FIG. 40 shows the case where (a) a driving voltage having negative polarity is outputted via the odd-numbered output terminal 2111 and (b) a driving voltage having positive polarity via the even-numbered output terminal 2112. In this case, the display data that has been inputted via the even-numbered output terminal is sent from the latch circuit 2109 to the negative-polarity D/A converter circuit 2104 via the switch 2106. The output signal of the negative-polarity D/A converter circuit 2104 is sent to the operational amplifier 2102 so as to be outputted from the odd-numbered output terminal 2111 via the switch 2107 (see the thick line shown in FIG. 40).

The following description deals with the case where each operational amplifier has an offset voltage that happens to be generated by the characteristic unevenness due to the reason occurred in the manufacturing process of the operational amplifier or other reasons. As has been described, the switch changeover signal allows the polarity of the offset voltage in the operational amplifier to be reversed. In this case, since the absolute values of the offset voltages are equal to each other, it is assumed that (a) the changing into an offset voltage A or an offset voltage −A is made by the operational amplifier 2101 and (b) the changing into an offset voltage B or an offset voltage −B is made by the operational amplifier 2102. Under the above assumptions (a) and (b), the output voltage of the odd-numbered output terminal has the offset voltage A or −A when an output voltage having positive polarity should be outputted from the odd-numbered output terminal, and the output voltage of the odd-numbered output terminal has the offset voltage B or −B when an output voltage having negative polarity should be outputted from the odd-numbered output terminal. The polarity of the offset voltage is selected in accordance with the switch changeover signal of the foregoing operational amplifier.

FIG. 7 shows a concrete example of the structure of the differential amplifier circuit 2115 shown in FIGS. 39 and 40. In FIG. 7, the reference numeral 2501 corresponds to the operational amplifier of N-channel MOS transistor input type shown in FIG. 33, the reference numeral 2502 corresponds to the operational amplifier of P-channel MOS transistor input type shown in FIG. 36. A switch circuit 2501*a* in the operational amplifier 2501 shown in FIG. 7 is constituted by the switches 1306 through 1309 shown in FIG. 33. A switch circuit 2501*b* in the operational amplifier 2501 shown in FIG. 7 is constituted by the switches 1310 through 1313 shown in FIG. 33. A switch circuit 2502*a* in the operational amplifier 2502 shown in FIG. 7 is constituted by the switches 1606 through 1609 shown in FIG. 36. A switch circuit 2502*b* in the operational amplifier 2502 shown in FIG. 7 is constituted by the switches 1610 through 1613 shown in FIG. 36.

In FIG. 7, the reference numerals 2507 and 2508 respectively correspond to the switches 2107 and 2108 shown in FIGS. 39 and 40. Output terminals 2511 and 2512 of FIG. 7 respectively correspond to the output terminals 2111 and 2112 shown in FIGS. 39 and 40.VBN and VBP shown in FIG. 7 indicate the bias voltage input terminals for providing the operating points of the operational amplifiers, respectively. In FIG. 7, the reference numerals 2513 corresponds to the reference numeral 2113 (the alternation switch changeover signal input), the reference numerals 2514 corresponds to the reference numeral 2114 (the switch changeover signal input terminal of the operational amplifier shown in FIGS. 33 and 36) shown in FIGS. 39 and 40.

FIG. 41 and Table 1 show the relation among an alternation switch changeover signal REV, a switch changeover signal SWP of the operational amplifier, and the outputs.

In FIG. 41, the reference numeral 2601 indicates an idealistic pixel voltage that is driven by the output voltage outputted from the odd-numbered output terminal. The reference numeral 2602 indicates an actual pixel voltage including an offset voltage. The alternation switch changeover signal REV is inverted for every frame, and the switch changeover signal SWP of the operational amplifier is inverted for every two frames. As a result, the difference between the idealistic pixel voltage and the actual pixel voltage changes for every frame, i.e., successively changes as A, B, −A, and −B in this order. Accordingly, it takes four frames for the difference to return to the original state.

The deviation between the first frame and the third frame and the deviation between the second frame and the fourth frame have a same value and have polarities that are reversed to each other, respectively. When the period of the frame is enough short compared to the reaction time of the liquid crystal material, (a) the deviations are canceled between the first and third frames and (b) the deviations are canceled between the second and fourth frames. At the even-numbered output terminals, similarly, the deviations are canceled for every four frames. Table 1 shows the fact.

TABLE 1

| INPUT SIGNAL | | OUTPUT TERMINAL | |
|---|---|---|---|
| SWP | REV | ODD-NUMBERED | EVEN-NUMBERED |
| LOW LEVEL | LOW LEVEL | POSITIVE POLARITY (DEVIATION A) | NEGATIVE POLARITY (DEVIATION B) |
| LOW LEVEL | HIGH LEVEL | NEGATIVE POLARITY (DEVIATION B) | POSITIVE POLARITY (DEVIATION A) |
| HIGH LEVEL | LOW LEVEL | POSITIVE POLARITY (DEVIATION −A) | NEGATIVE POLARITY (DEVIATION −B) |
| HIGH LEVEL | HIGH LEVEL | NEGATIVE POLARITY (DEVIATION −B) | POSITIVE POLARITY (DEVIATION −A) |

Thus, the unevenness of the deviations that are occurred for every liquid crystal driving output terminal is canceled in each display pixel, thereby ensuring that the display of high quality is carried out without being discerned as the display unevenness by the human eyes.

However, according to the foregoing conventional arts, each offset voltage happens to be generated due to the reasons such as the unevenness of the structural conditions in the differential amplifier (operational amplifier circuit) that constitutes the output circuit section (see FIG. 16) of the source driver. Each offset voltage is mainly generated in the differential section constituting the inputting stage of the differential amplifier. Each offset voltage causes an error with respect to an idealistic driving voltage to be applied to the liquid crystal display device, thereby resulting in that the display image is not appropriately displayed. This results in the display unevenness that causes the lowering of the display quality.

According to the first conventional art, the operational amplifier having an N-channel MOS transistor as its inputting stage and the operational amplifier having a P-channel MOS transistor as its inputting stage are provided so as to output a voltage having positive polarity and a voltage having negative polarity via a single output terminal (i.e., in a full range), respectively. This allows to cancel, in two frames, the deviations A and −A derived from the offset voltage as shown in FIG. 20. However, since the circuit configuration requires two operational amplifiers for each output terminal, the problem that the scale of the circuit becomes large and its chip size becomes large arises. In addition, since the number of the operational amplifier circuits whose power consumption is relatively large increases, the low power consumption is hard to be achieved.

Meanwhile, according to the second conventional art, (a) a voltage having positive polarity is outputted from the operational amplifier in which N-channel MOS transistors are adopted as its inputting stage, (b) a voltage having negative polarity is outputted from the operational amplifier in which P-channel MOS transistors are adopted as its inputting stage, and (c) the voltage having positive polarity and the voltage having negative polarity are switched by the changeover switch so as to output the output voltage in a full range. This allows that the number of the operational amplifiers is reduced by half, thereby realizing the reduction of the circuit scale and the low power consumption.

However, according to the second conventional art, as shown in FIG. 19, it is not possible to cancel (a) the deviation A derived from the offset voltage that is generated by the operational amplifier circuit adopting N-channel MOS transistors with (b) the deviation B derived from the offset voltage that is generated by the operational amplifier circuit adopting P-channel MOS transistors, and (c) it is not also possible to cancel the error with respect to the idealistic driving voltage to be applied to the liquid crystal display device. This causes that the display image is not appropriately displayed, i.e., a so-called display unevenness occurs. These deficiencies were main reasons why the display quality is lowered.

According to the third conventional art, (a) a voltage having positive polarity is outputted from the operational amplifier in which N-channel MOS transistors are adopted as its inputting stage, (b) a voltage having negative polarity is outputted from the operational amplifier in which P-channel MOS transistors are adopted as its inputting stage, (c) the voltage having positive polarity and the voltage having negative polarity are switched by the changeover switch so as to output the output voltage in a full range, and (d) the noninverted input signal or inverted input signal is switched and inputted as the input signal to the input terminals (noninverted input terminal or inverted terminal) so as to newly generate another voltage having positive polarity-and a further voltage having negative polarity (that are resultants of inversion of the foregoing respective voltages having positive and negative polarities) in accordance with the above changing of the input signals, in addition to the foregoing voltages having positive and negative polarities, thereby resulting in that the deviations A, B, −A, and −B are changed for every frame so as to cancel the deviations in four frames (see FIG. 41 and Table 1). The deviations A and −A are derived from the offset voltage that has been generated in the operational amplifier adopting the N-channel MOS transistors, and the deviations B and −B are derived from the offset voltage that has been generated in the operational amplifier adopting the P-channel MOS transistors. Thus, so-called display unevenness can be eliminated.

SUMMARY OF THE INVENTION

In view of the foregoing problem, the present invention is made. It is an object of the present invention to provide driving apparatus and driving method of liquid crystal display apparatus in which an operational amplifier for outputting an output voltage having a positive polarity and an operational amplifier for outputting an output voltage having a negative polarity are separately provided so that a noninverted input signal and an inverted input signal are changed and outputted via the operational amplifiers, and in which a deviation of a pixel is indiscernible by deviations of its surrounding pixels so as to eliminate the foregoing display unevenness, unlike the conventional art in which the deviation of a pixel is canceled in a several frames.

The following fact resides in the background of the invention. More specifically, development has been made so as to obtain a liquid crystal display panel having finely divided pixels and high precision. This causes the pixel size to be smaller, thereby making it harder to discern every pixel, so that a pixel and its surrounding pixels are sensed. Namely, an offset voltage applied to a pixel having a polarity that is reversed to a polarity of respective offset voltages applied to its surrounding pixels so that the deviations are uniformly dispersed in space (in a single frame). This allows that s so-called display unevenness is indiscernible by the sense of sight.

In order to achieve the foregoing object, a driving apparatus of liquid crystal display apparatus in accordance with the present invention in which first and second amplifier circuits are provided, a noninverted input signal and an inverted input signal are changed (switched), and output signals of the first and second amplifier circuits are respectively changed (switched) and outputted to pixels that are provided in a matrix manner, is characterized by the following. More specifically, the driving apparatus of liquid crystal display apparatus is further provided with a changeover control circuit that switches the output signals of the first and second amplifier circuits so that an offset voltage applied to a pixel has a polarity that is reversed to a polarity of respective offset voltages applied to its surrounding pixels.

With the present invention, the noninverted input signal and the inverted input signal are changed, and the output signals of the first and second amplifier circuits are respectively changed and outputted to the pixels that are provided in a matrix manner, thereby driving the liquid crystal display apparatus.

By the way, the first and second amplifier circuits originally should have the same circuit characteristic. However, it can not be avoided that there occurs a difference between the circuit characteristics due to the reasons such as the unevenness in the process of manufacturing the amplifier circuits. This causes the occurrence of an offset voltage.

Further, recently, development has been made so as to obtain a liquid crystal display panel having finely divided pixels and high precision. This causes the pixel size to be smaller, thereby making it harder to discern every pixel, so that a pixel and its surrounding pixels are sensed.

In view of the circumstances, according to the present invention, the output signals of the first and second amplifier circuits are suitably switched so that an offset voltage applied to a pixel has a polarity that is reversed to a polarity of respective offset voltages applied to its surrounding pixels. This allows that the offset voltages (the deviations) are uniformly dispersed in space, thereby resulting in that so-called display unevenness is discernible by the sense of sight.

According to the present invention, instead of canceling the offset voltages in a several frames, the offset voltage of a pixel is canceled by the offset voltages of its surrounding pixels, thereby making the display unevenness indiscernible. This allows to cope with the case where development is further made to obtain a liquid crystal display panel having much finely divided pixels and much higher precision, thereby ensuring to provide a driving apparatus of liquid crystal display apparatus with excellent high reliability.

It is preferable in the driving apparatus that the changeover control circuit switches respective first and second changeover circuits so that an offset voltage applied to a pixel has a polarity that is reversed to a polarity of pixels that are provided diagonally up to right and left and diagonally down to right and left with respect to such a pixel among other surrounding pixels and has a same absolute value as absolute values of the pixels diagonally provided. In this case, the offset voltage of a pixel is canceled by the four pixels that are provided diagonally up to right and left and diagonally down to right and left among other surrounding pixels and that have the polarity that is reversed to that of such a pixel and have the same absolute value as that of such a pixel. This ensures to further improve the display unevenness.

In order to achieve the foregoing object, a driving method of liquid crystal display apparatus in accordance with the present invention in which first and second amplifier circuits are provided, a noninverted input signal and an inverted input signal are changed in accordance with a changeover signal, and output signals of the first and second amplifier circuits are respectively changed in accordance with an alternation signal and outputted to pixels that are provided in a matrix manner, is characterized by the following.

More specifically, according to the driving method, the changeover signal and the alternation signal are controlled so that an offset voltage applied to a pixel has a polarity that is reversed to a polarity of pixels that are provided diagonally up to right and left and diagonally down to right and left among other surrounding pixels and has a same absolute value as absolute values of the pixels diagonally provided.

With the driving method, by controlling the changeover signal and the alternation signal, an offset voltage applied to a pixel has a polarity that is reversed to a polarity of pixels that are provided diagonally up to right and left and diagonally down to right and left among other surrounding pixels and has a same absolute value as absolute values of the pixels diagonally provided. This allows the offset voltage of a pixel to be canceled by the four pixels, so that the display unevenness can be further improved.

The following is preferable. More specifically, the changeover signal is controlled in accordance with a horizontal synchronizing signal or a signal that is outputted for every horizontal synchronizing period, an inverted signal and a noninverted signal of the changeover signal are respectively generated in accordance with a vertical synchronizing signal and a discrimination signal that discriminates whether the number of horizontal lines is an odd number or an even number. When it is discriminated that the number of the horizontal lines is an even number, the inverted signal and the noninverted signal of the changeover signal are alternately changed for every frame, respectively, and outputted as the alternation signal. In contrast, when it is discriminated that the number of the horizontal lines is an odd number, only the inverted signal is outputted as the alternation signal. In this case, the alternation signal can be generated in accordance with the changeover signal without a complicated circuit configuration.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, and thus, are not limitative of the present invention.

BRIEF DESCRIPTION OF THE DRAWINGS

FIG. 4 is an explanatory diagram showing how offset voltages, which are applied to pixels on a liquid crystal display panel, disperse when the number of the horizontal lines is an even number.

FIG. 5 is an explanatory diagram showing how offset voltages, which are applied to pixels on a liquid crystal display panel, disperse when the number of the horizontal lines is an odd number.

FIG. 8 is an explanatory diagram showing a resultant of extraction of only voltages having a positive polarity from the dispersion state shown in FIG. 4.

FIG. 9 is an explanatory diagram showing a resultant of extraction of only voltages having a negative polarity from the dispersion state shown in FIG. 4.

FIG. 10 is an explanatory diagram showing a resultant of extraction of only a voltage having a positive polarity from the dispersion state shown in FIG. 5.

FIG. 11 is an explanatory diagram showing a resultant of extraction of only a voltage having a negative polarity from the dispersion state shown in FIG. 4.

DESCRIPTION OF THE EMBODIMENTS

The following description deals with one embodiment of the present invention with reference to FIGS. 1 through 11.

Figure 6:
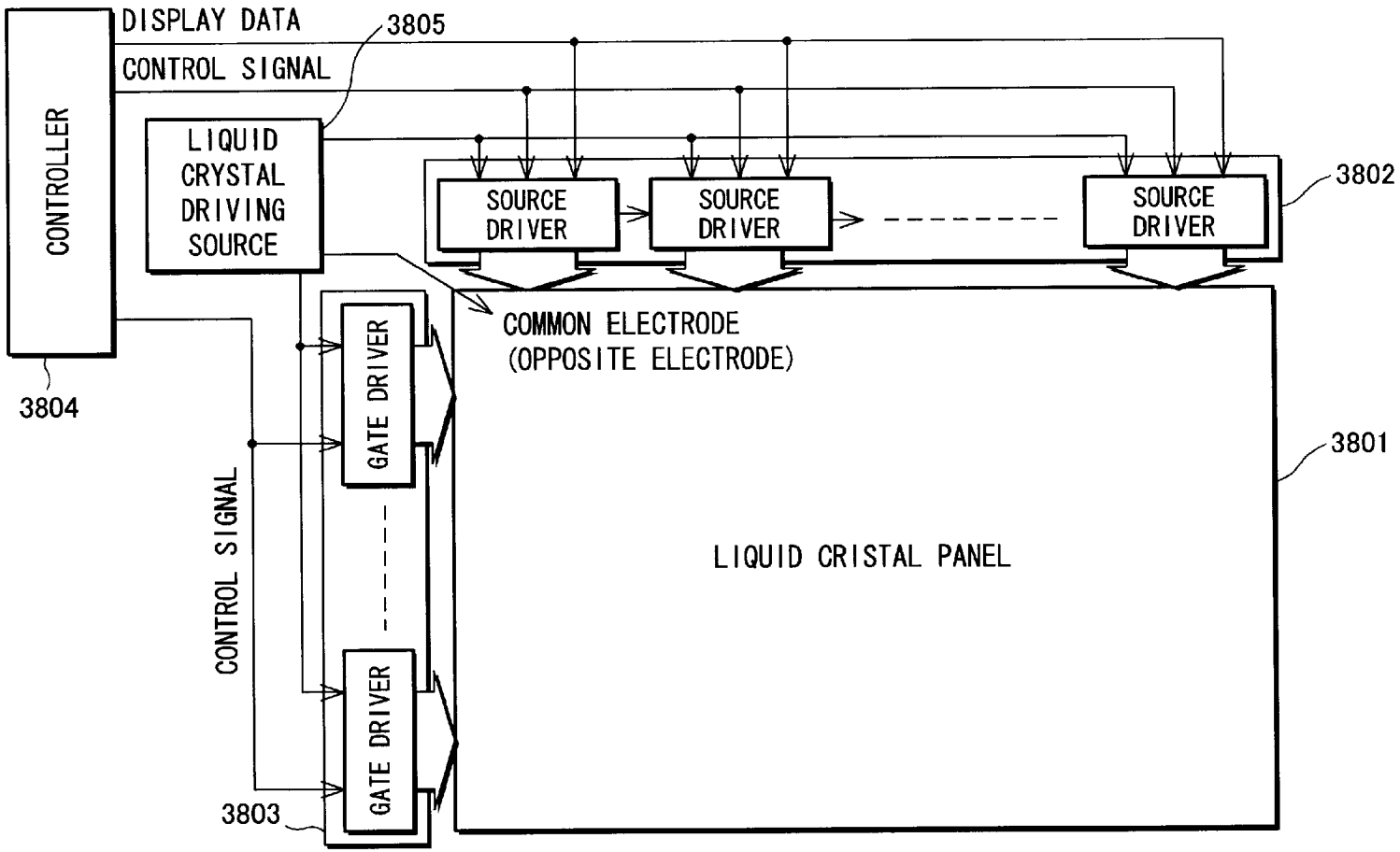
FIG. 6 shows both of the present invention and the conventional art, and is an example of a block diagram showing a TFT liquid crystal display apparatus that is a typical one of an active matrix type.

FIG. 6 is an explanatory diagram showing a liquid crystal display apparatus that adopts the TFTs in accordance with the present embodiment. The distinction over the conventional art resides in that a vertical synchronizing signal and an even/odd line discrimination signal are further added as the control signal to be outputted to the source driver. FIG. 6 is a block diagram of a source driver 3802 shown in FIG. 1.

Figure 16:
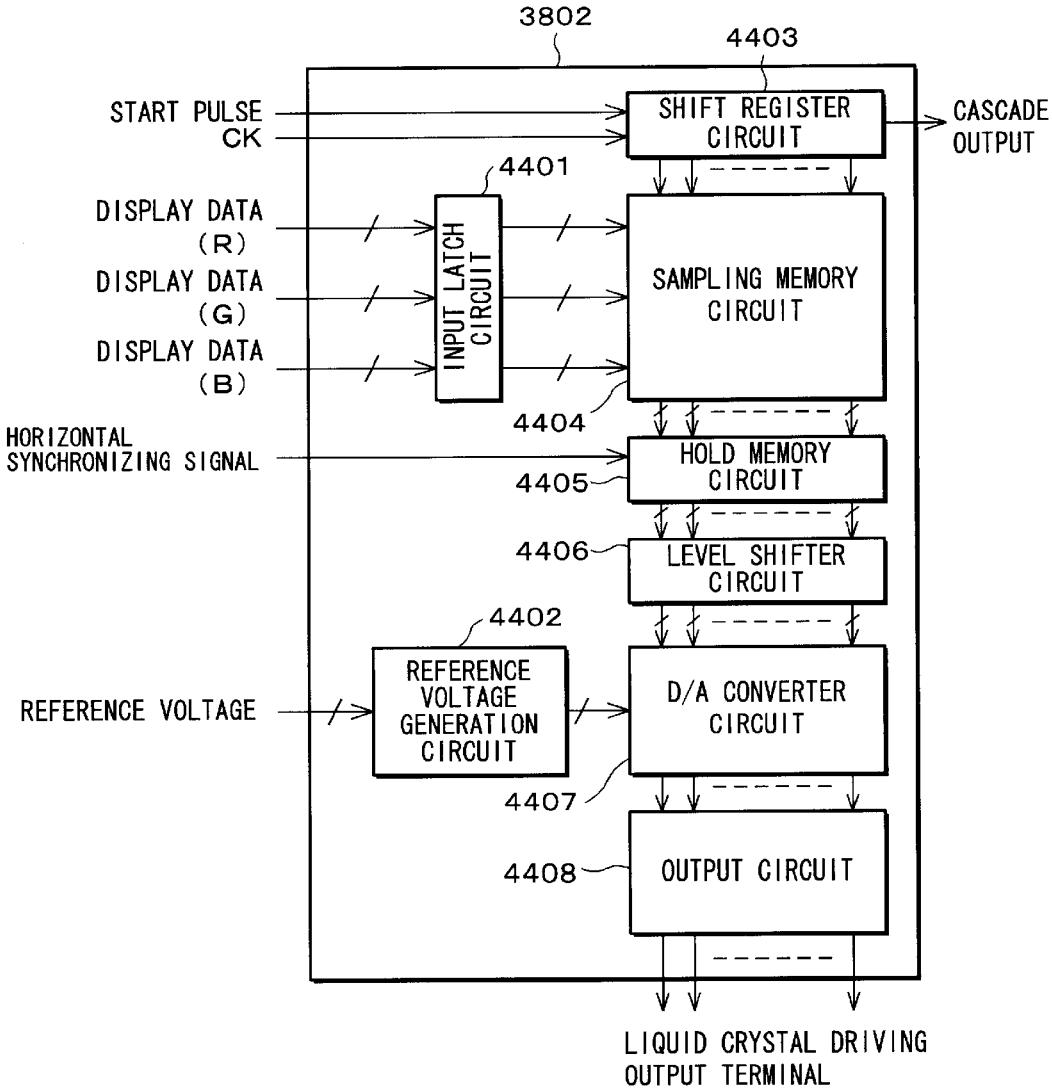
FIG. 16 is a block diagram of an example of the structure of a conventional source driver IC.
Figure 17:
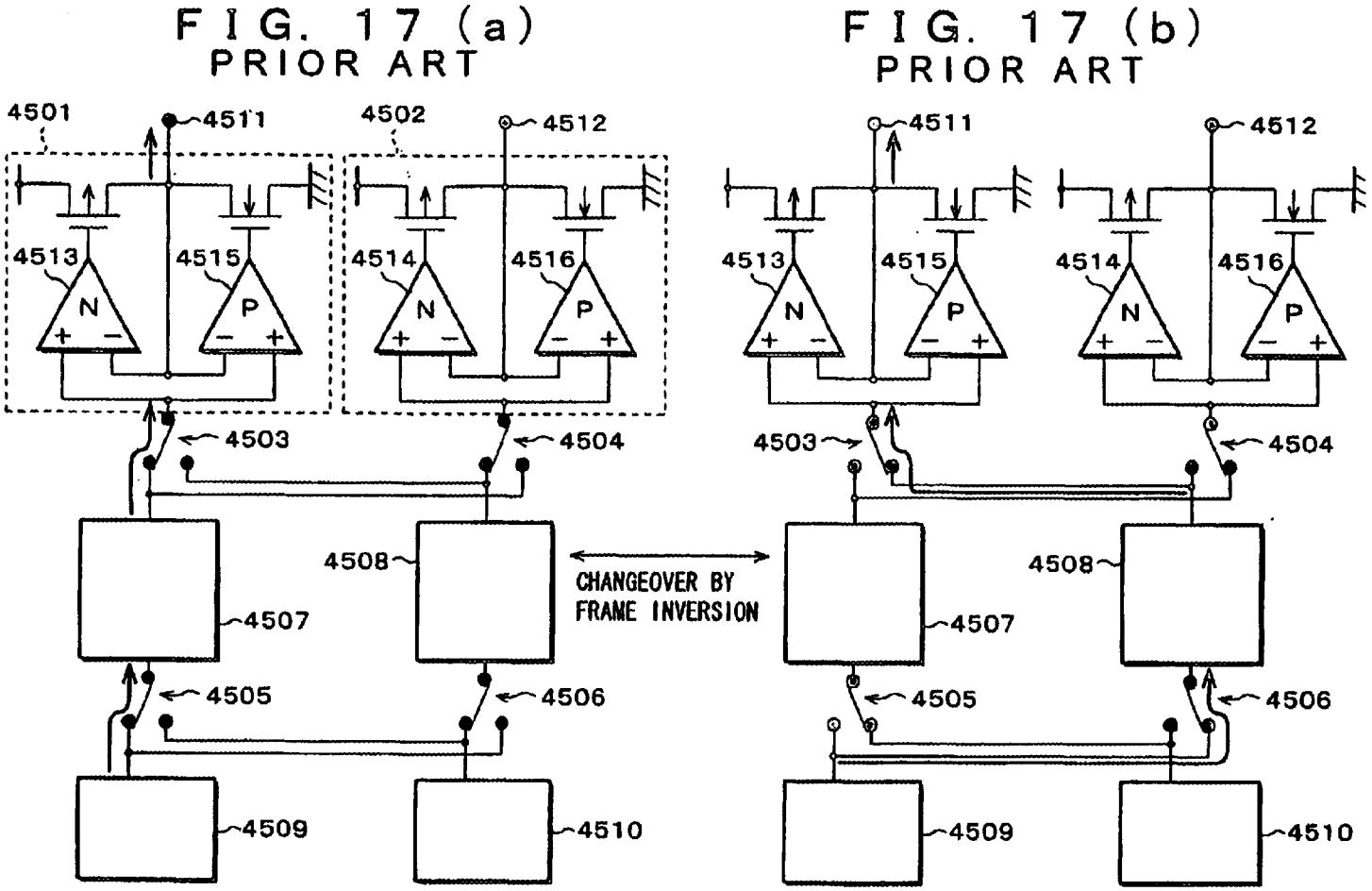
FIGS. 17(*a*) and 17(*b*) are block diagrams showing the structure of an output circuit in the source driver IC that carries out the dot inversion driving of the first conventional art.
Figure 18:
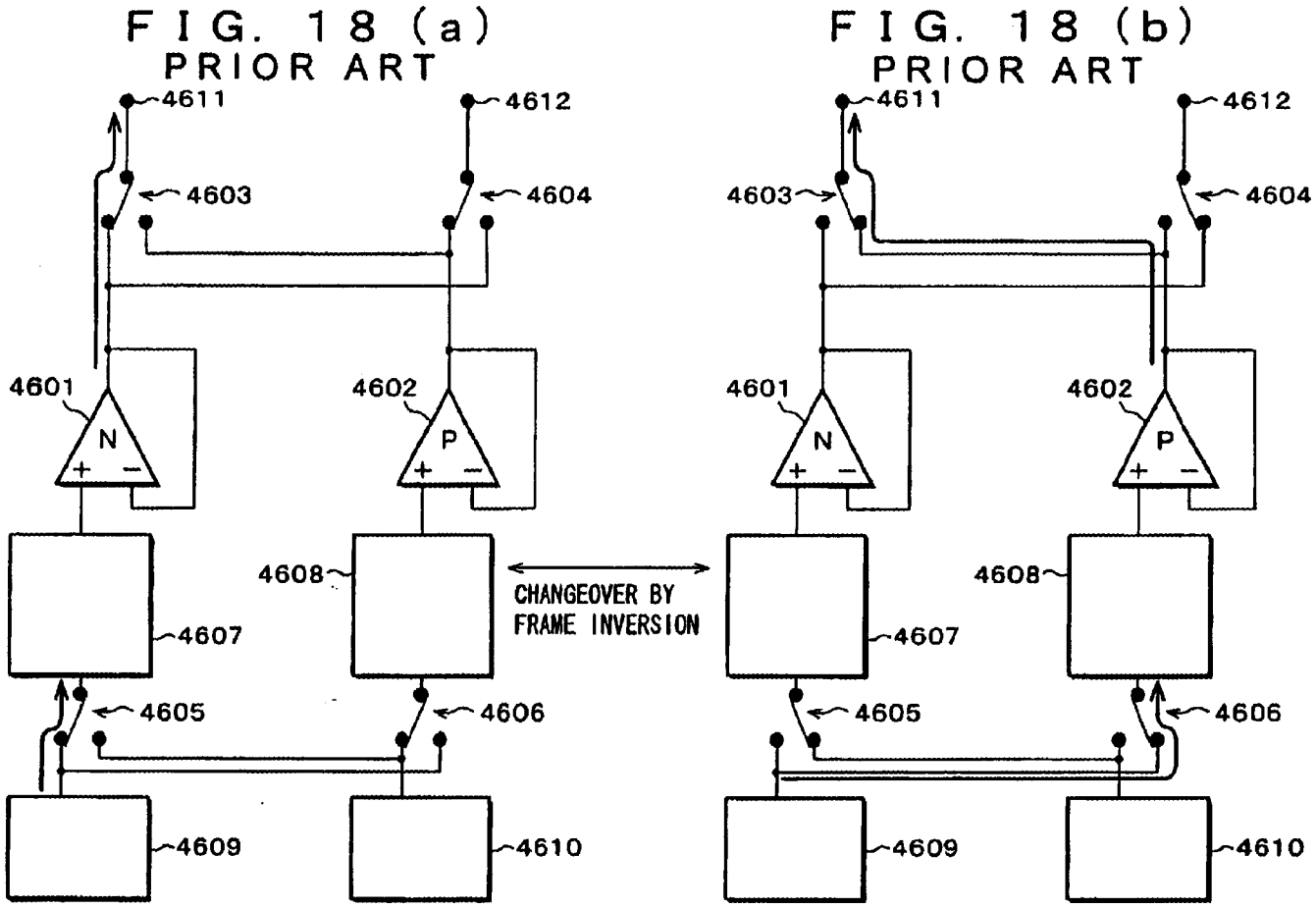
FIGS. 18(*a*) and 18(*b*) are block diagrams showing the structure of an output circuit in the source driver IC that carries out the dot inversion driving of the second conventional art.
Figure 19:
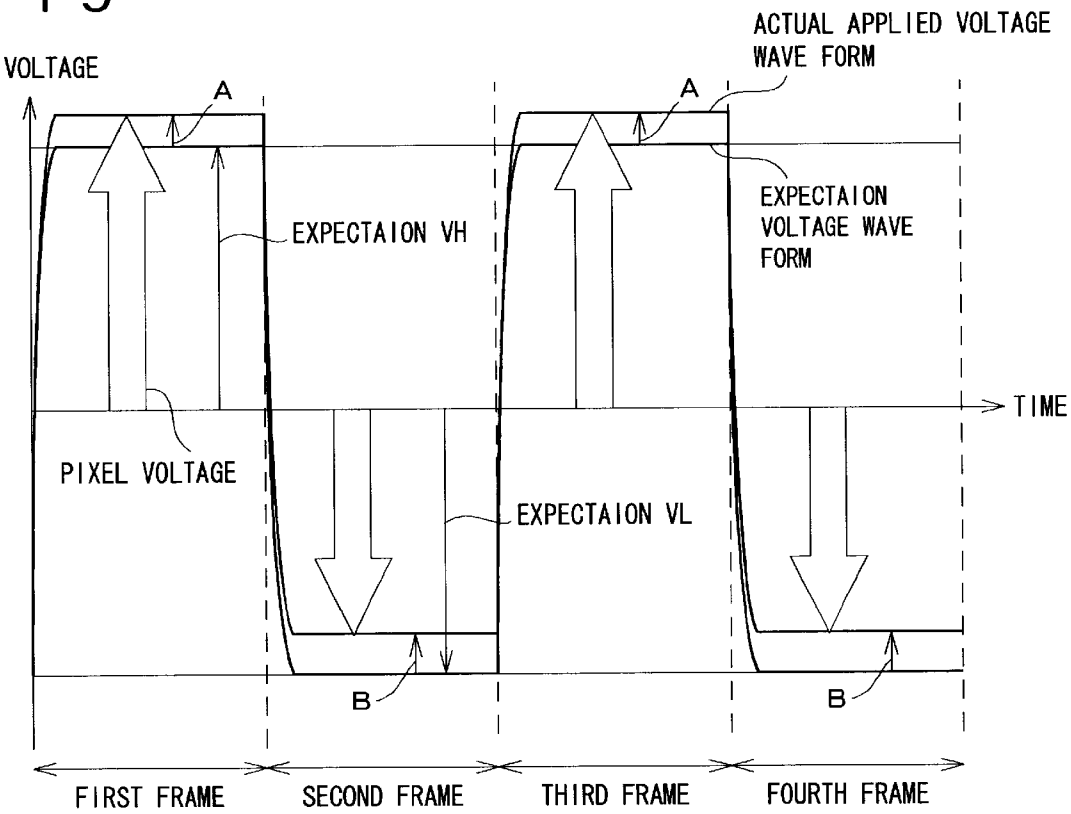
FIG. 19 is the wave form diagram showing an example of the wave form of the liquid crystal driving voltage in the case where a conventional operational amplifier happens to have an offset voltage.
Figure 20:
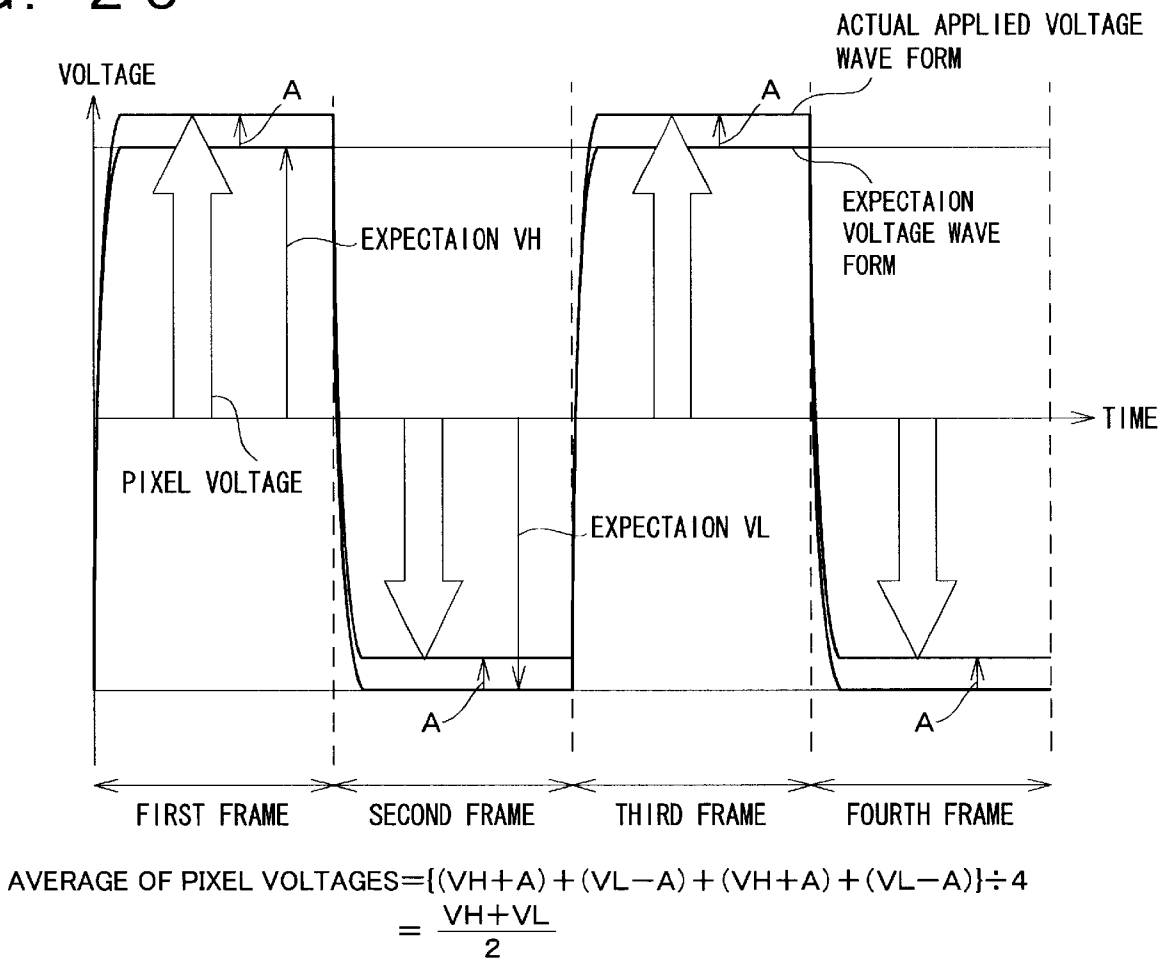
FIG. 20 is the wave form diagram showing the wave form of the liquid crystal driving voltage in the case of the structure shown in FIGS. 17(*a*) and 17(*b*).
Figure 21:
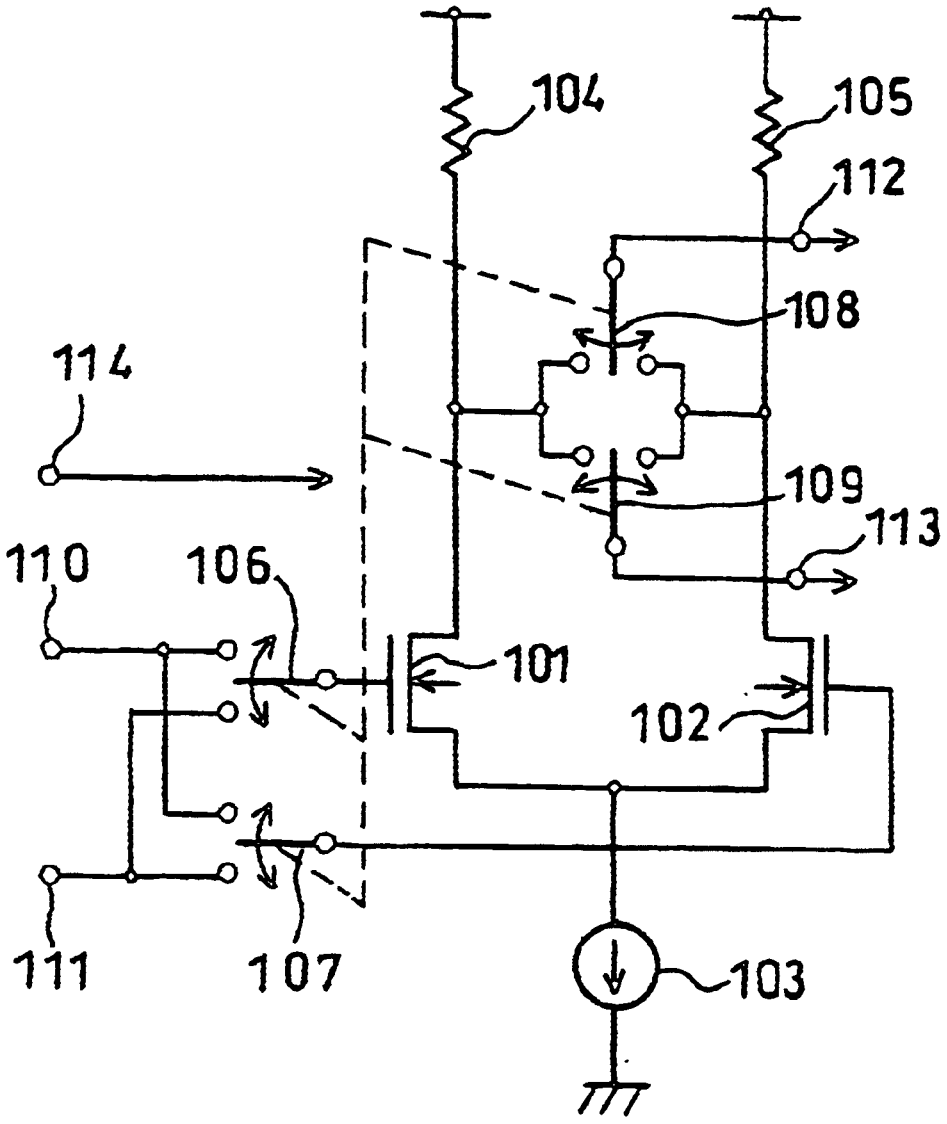
FIG. 21 PRIOR ART
FIG. 21 is a circuit diagram showing an example of the structure of a differential amplifier circuit in accordance with the third conventional art.
Figure 22:
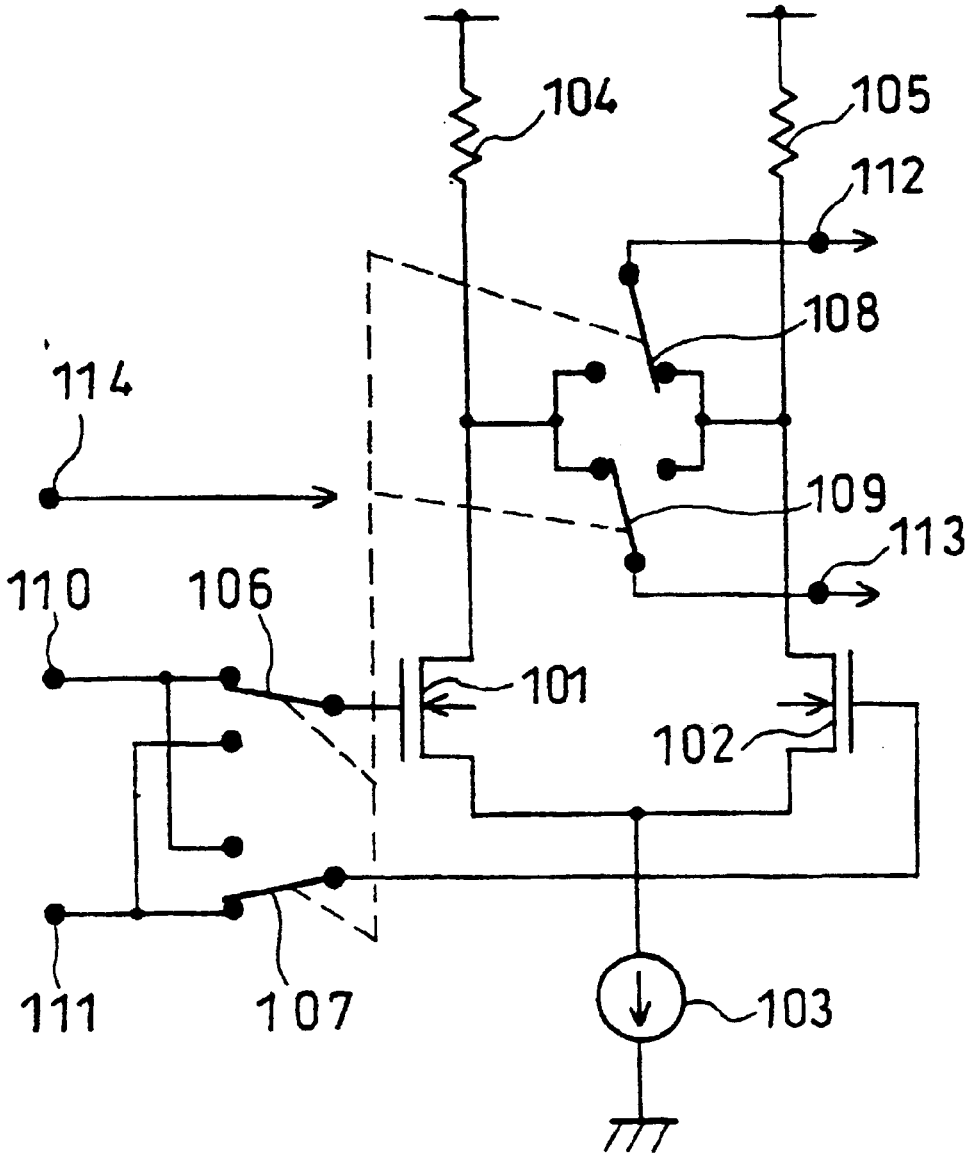
FIG. 22 is an explanatory diagram showing an operation of the differential amplifier circuit shown in FIG. 21.
Figure 23:
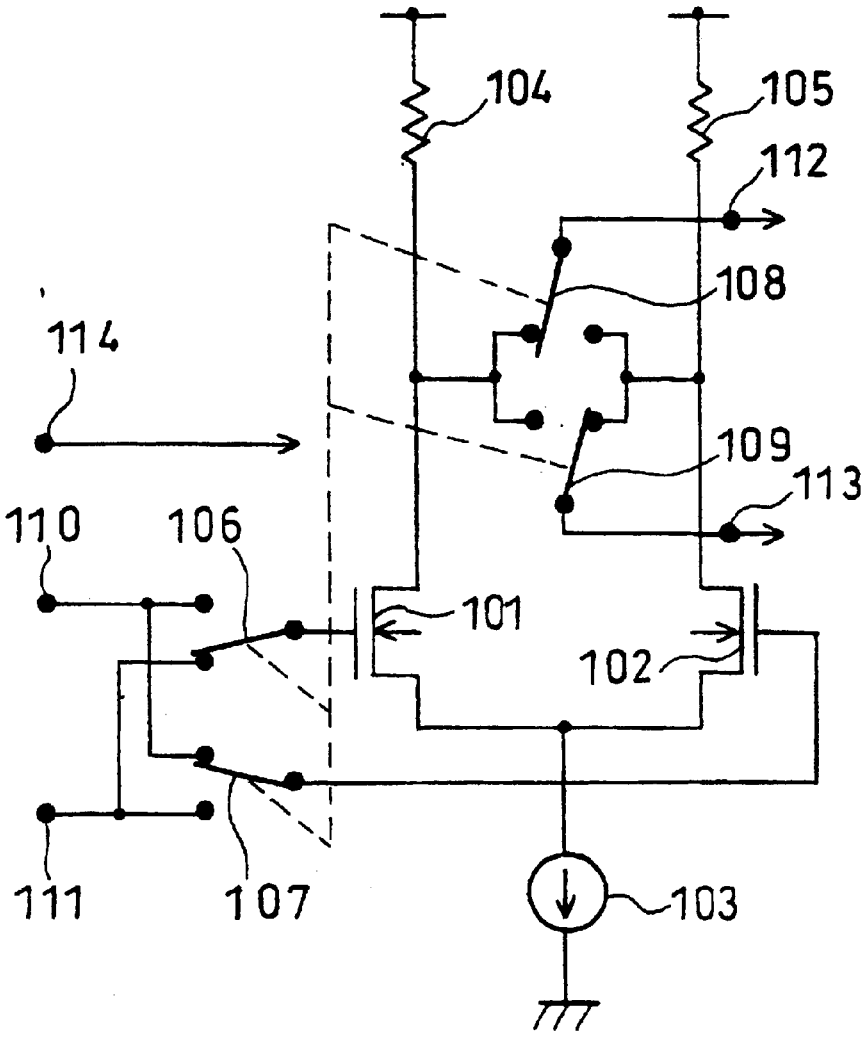
FIG. 23 is an explanatory diagram showing another operation of the differential amplifier circuit shown in FIG. 21.
Figure 24:
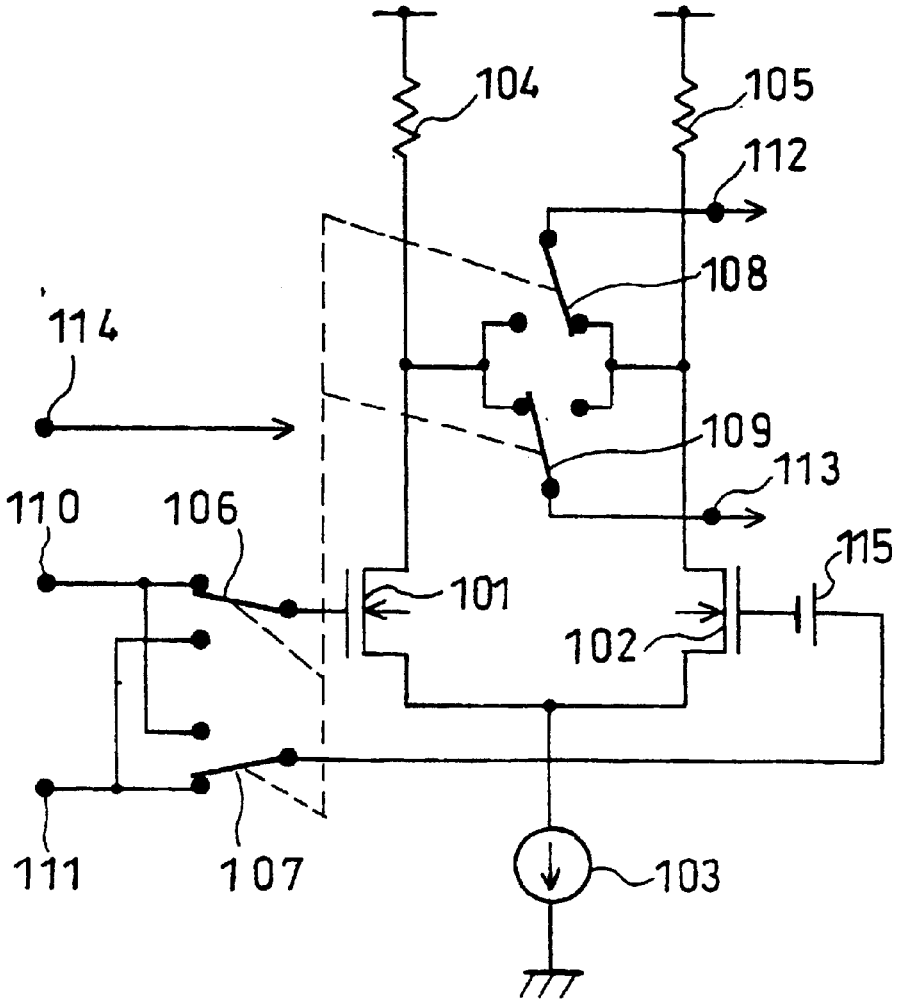
FIG. 24 is an explanatory diagram showing the operation of the case where the discrepancy of characteristics that happens to occur due to the reason of the manufacturing process occurs between the transistors that constitute the differential amplifier circuit shown in FIG. 22 and/or between the load resistors.
Figure 25:
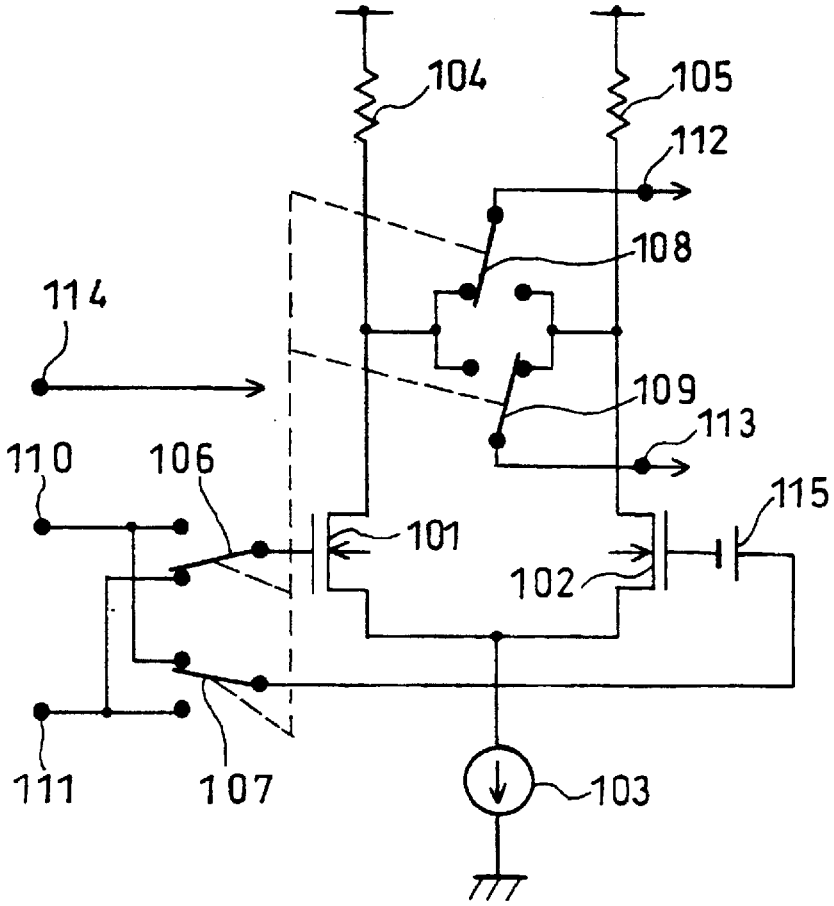
FIG. 25 is an explanatory diagram showing the operation of the case where the discrepancy of characteristics that happens to occur due to the reason of the manufacturing process occurs between the transistors that constitute the differential amplifier circuit shown in FIG. 23 and/or between the load resistors.
Figure 26:
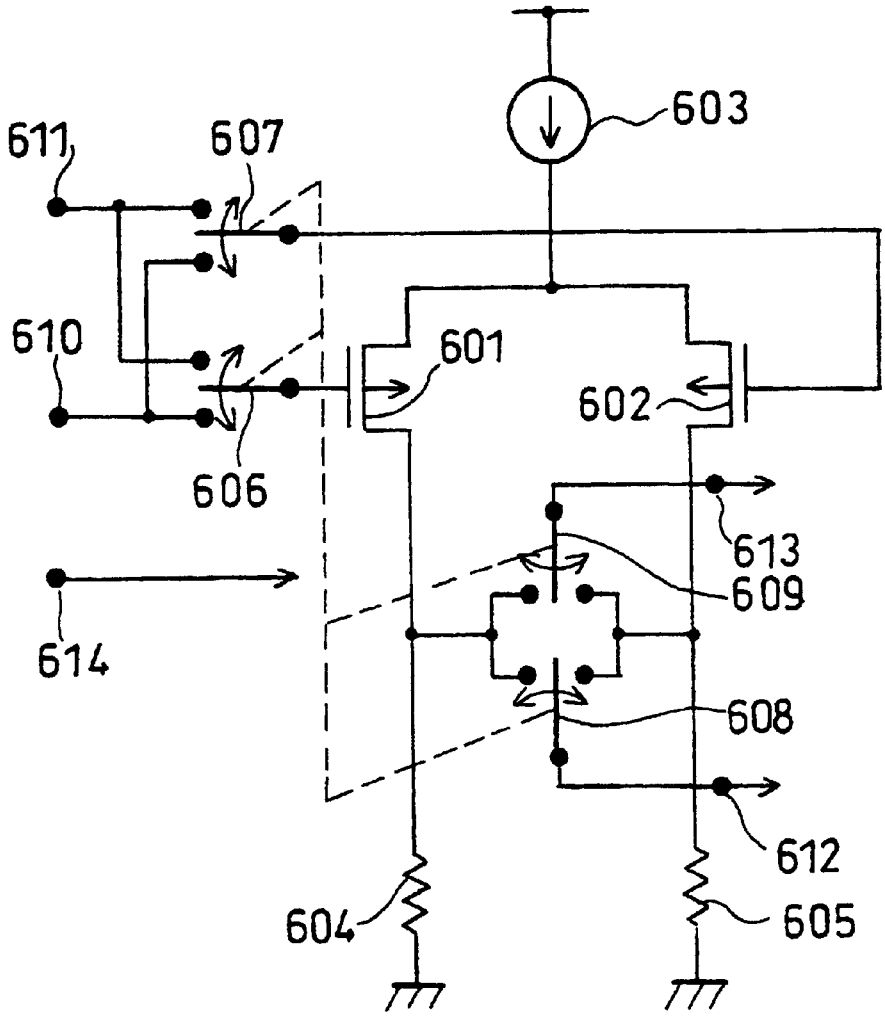
FIG. 26 is a circuit diagram showing another example of the structure of a differential amplifier circuit in accordance with the second conventional art.
Figure 27:
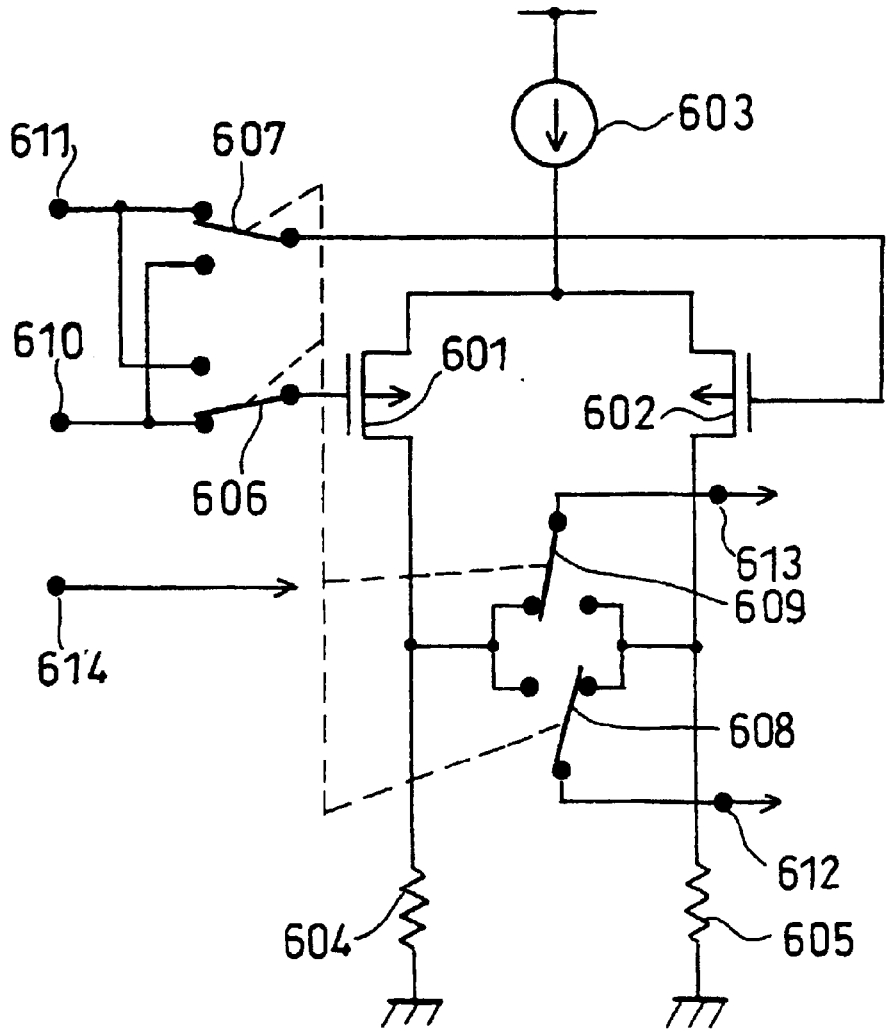
FIG. 27 is an explanatory diagram showing an operation of the differential amplifier circuit shown in FIG. 26.
Figure 28:
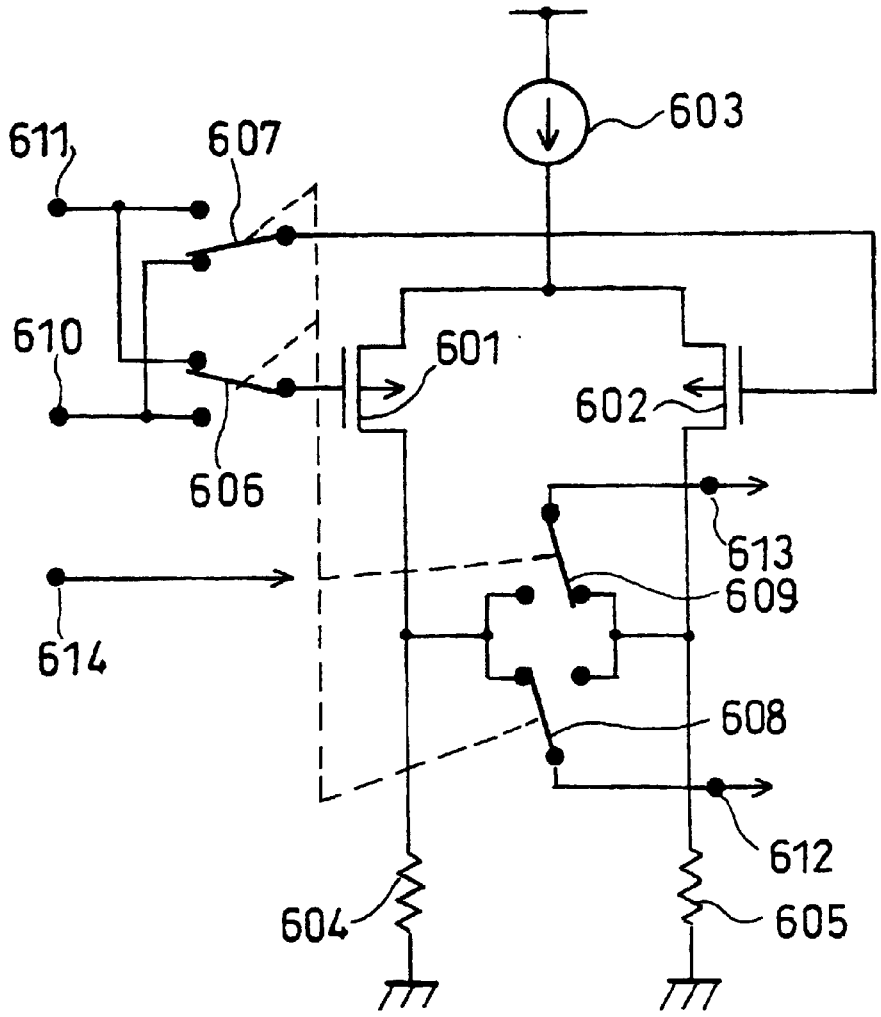
FIG. 28 is an explanatory diagram showing another operation of the differential amplifier circuit shown in FIG. 26.
Figure 29:
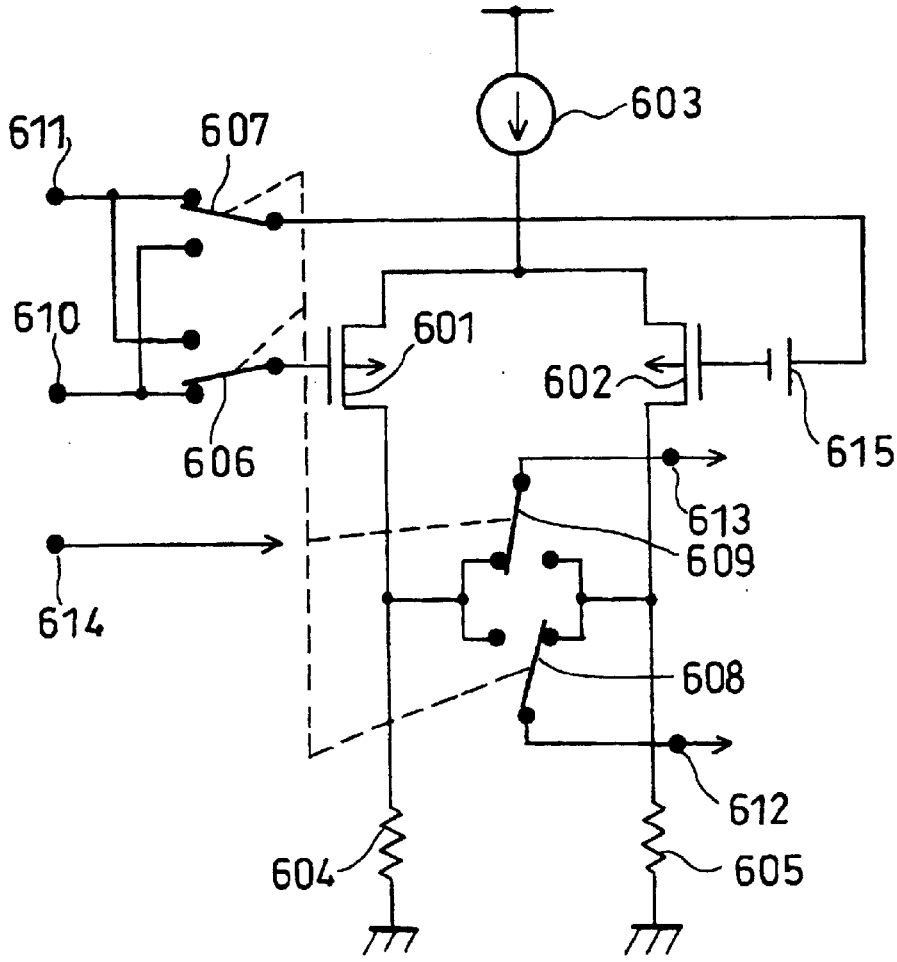
FIG. 29 is an explanatory diagram showing the operation of the case where the discrepancy of characteristics that happens to occur due to the reason of the manufacturing process occurs between the transistors that constitute the differential amplifier circuit shown in FIG. 27 and/or between the load resistors.
Figure 30:
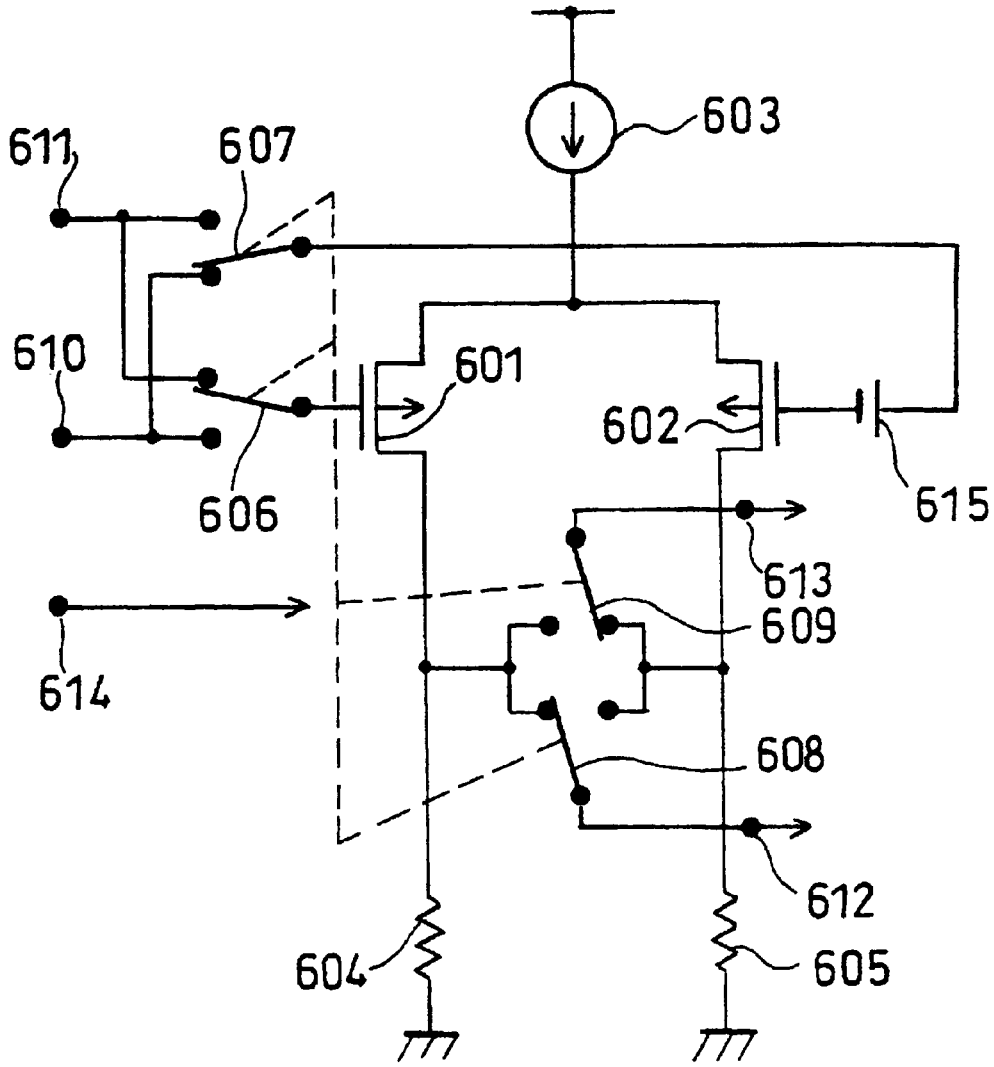
FIG. 30 is an explanatory diagram showing the operation of the case where the discrepancy of characteristics that happens to occur due to the reason of the manufacturing process occurs between the transistors that constitute the differential amplifier circuit shown in FIG. 28 and/or between the load resistors.
Figure 31:
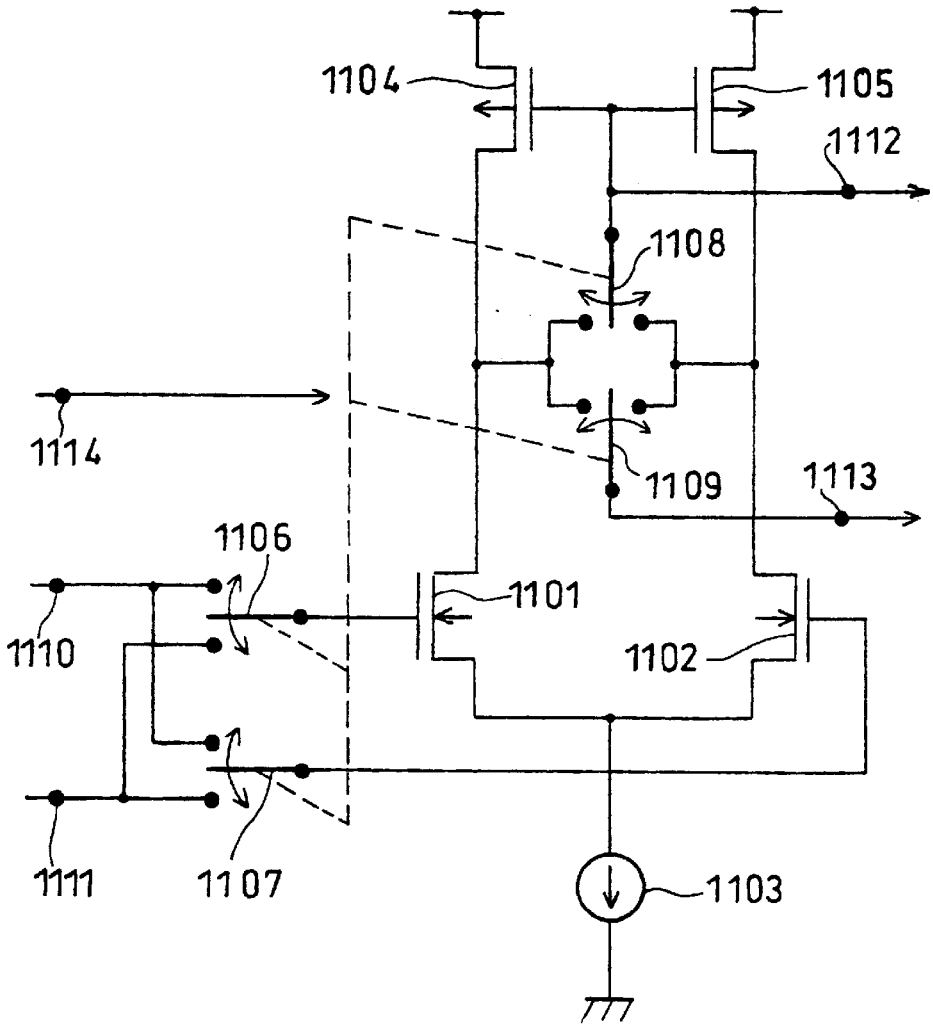
FIG. 31 is a circuit diagram showing a structure of the circuit in which the load element of the differential amplifier circuit shown in FIG. 21 is replaced with the active load having a current mirror structure.
Figure 32:
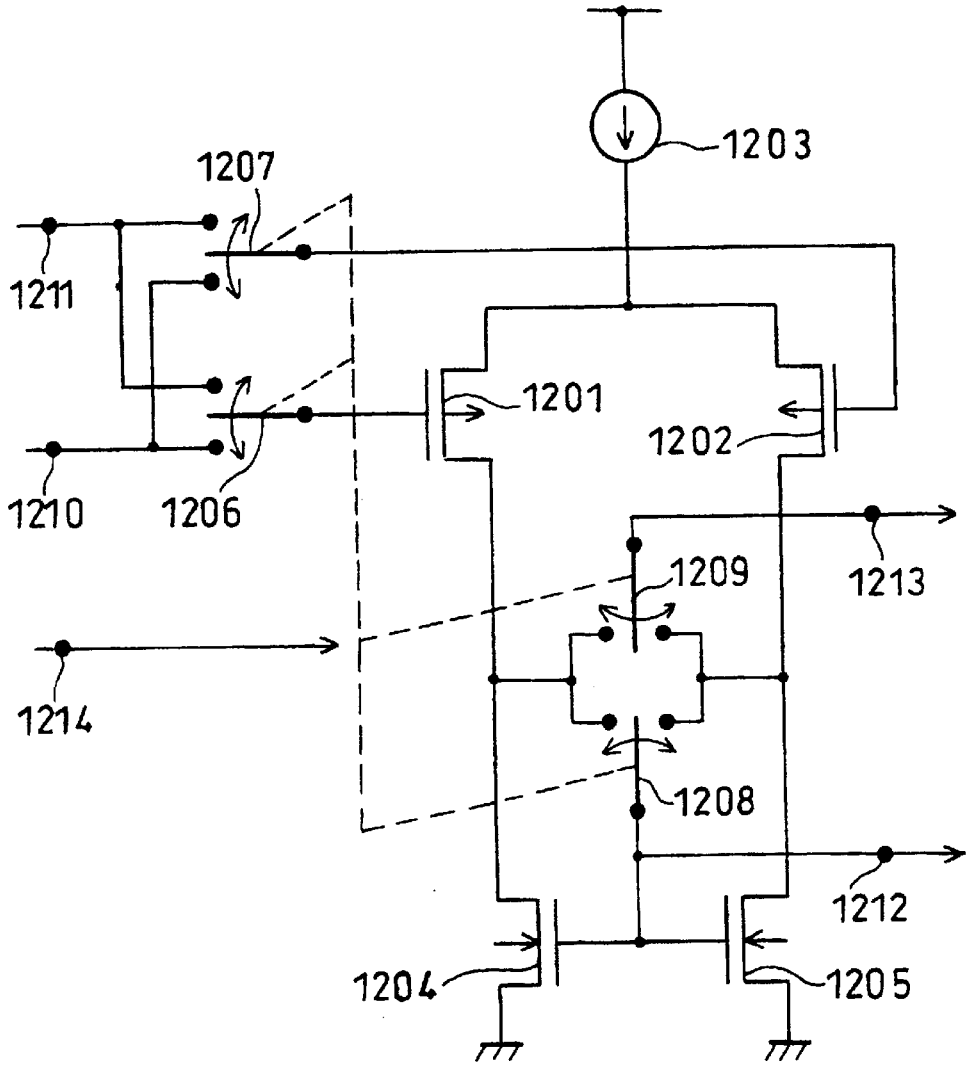
FIG. 32 is a circuit diagram showing a structure of the circuit in which the load element of the differential amplifier circuit shown in FIG. 26 is replaced with the active load having a current mirror structure.
Figure 33:
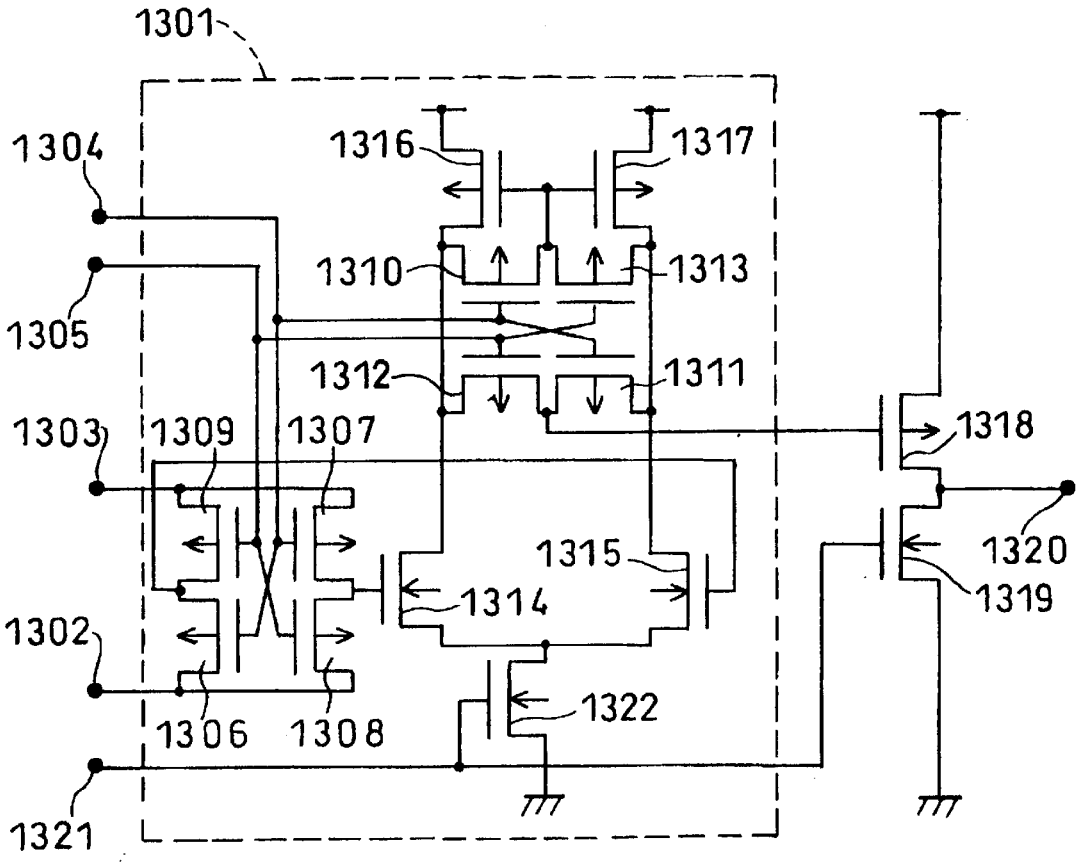
FIG. 33 is a circuit diagram showing an example which embodies a differential amplifier circuit equivalent to that shown in FIG. 31, switches, and an output section.
Figure 34:
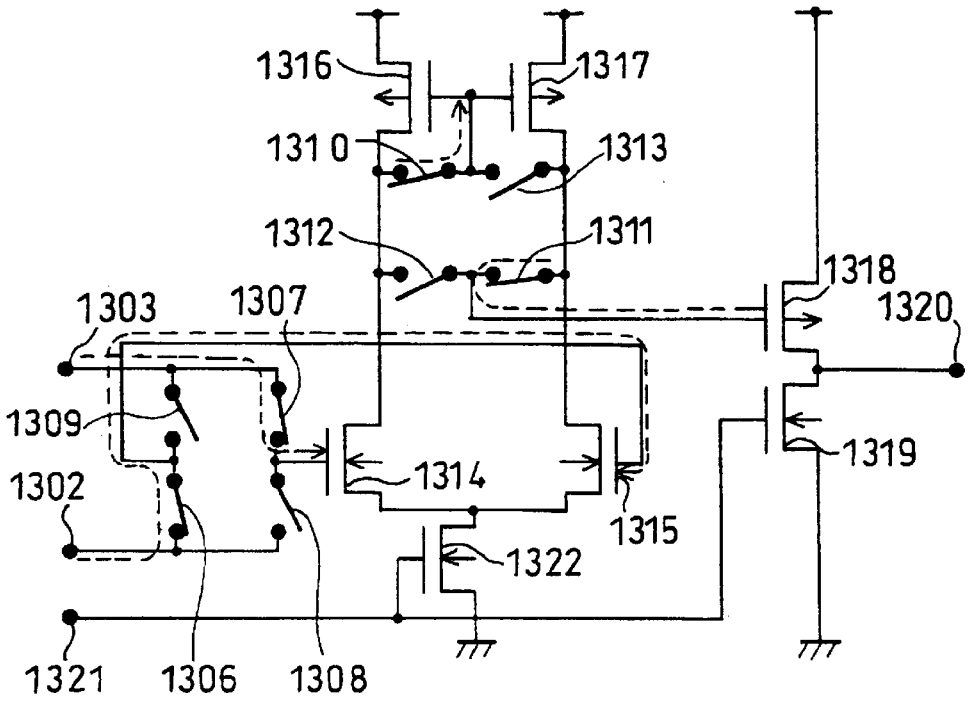
FIG. 34 is a circuit diagram showing an operation of an operational amplifier shown in FIG. 33.
Figure 35:
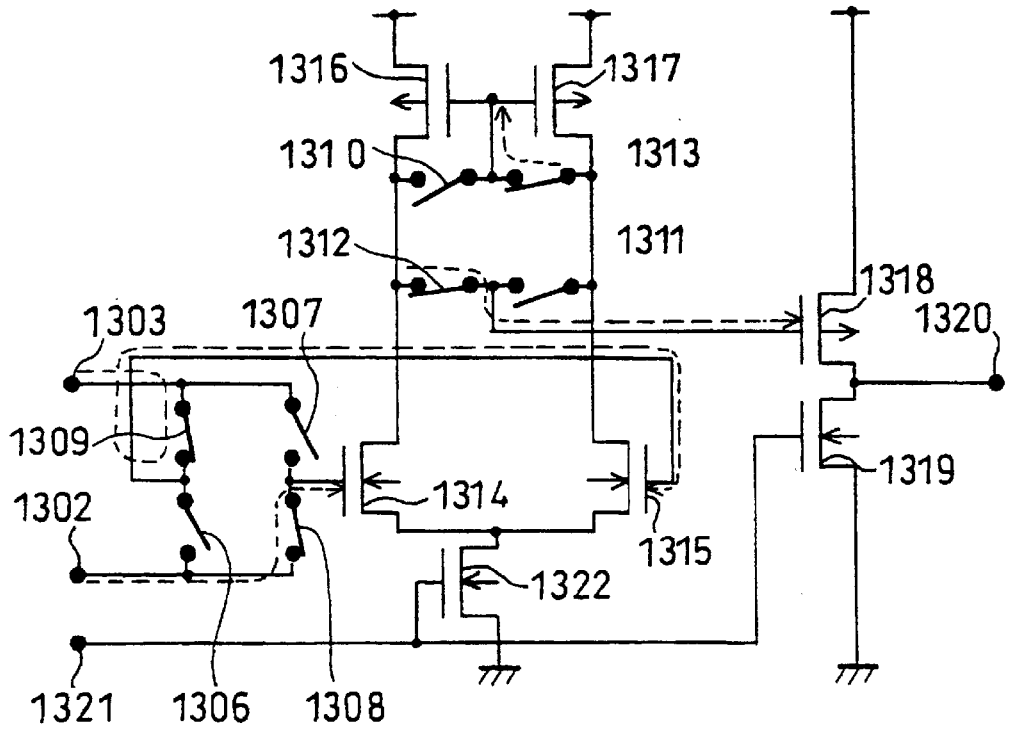
FIG. 35 is a circuit diagram showing another operation of the operational amplifier shown in FIG. 33.
Figure 36:
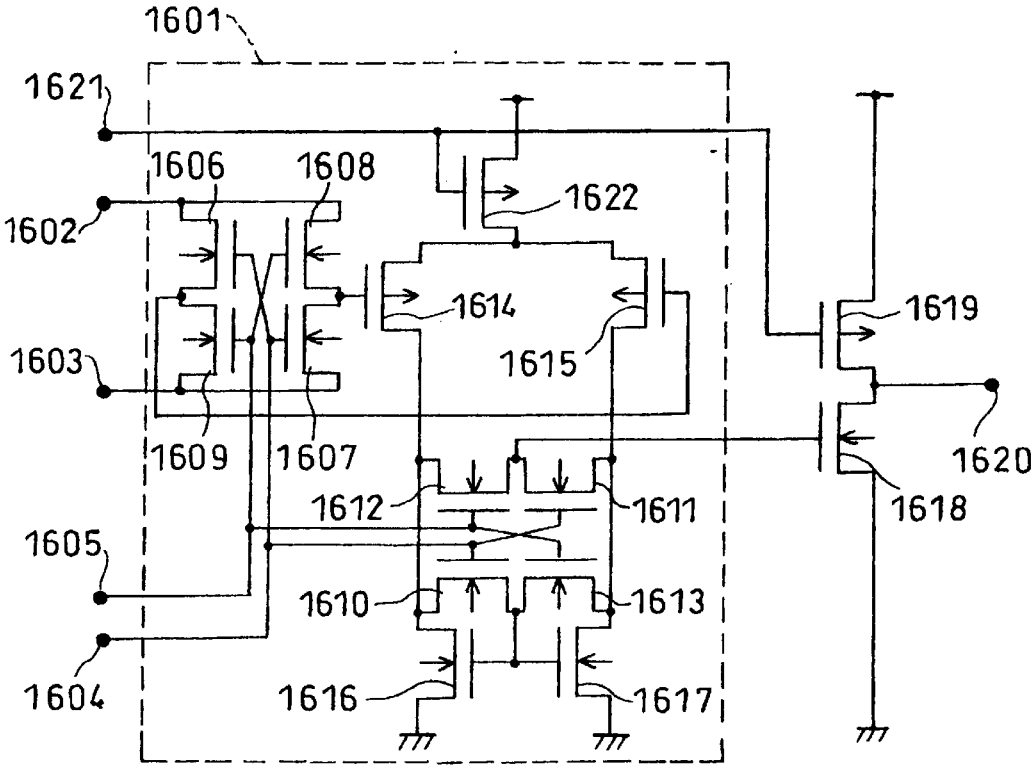
FIG. 36 is a circuit diagram showing an example which embodies a differential amplifier circuit equivalent to that shown in FIG. 32, switches, and an output section.
Figure 37:
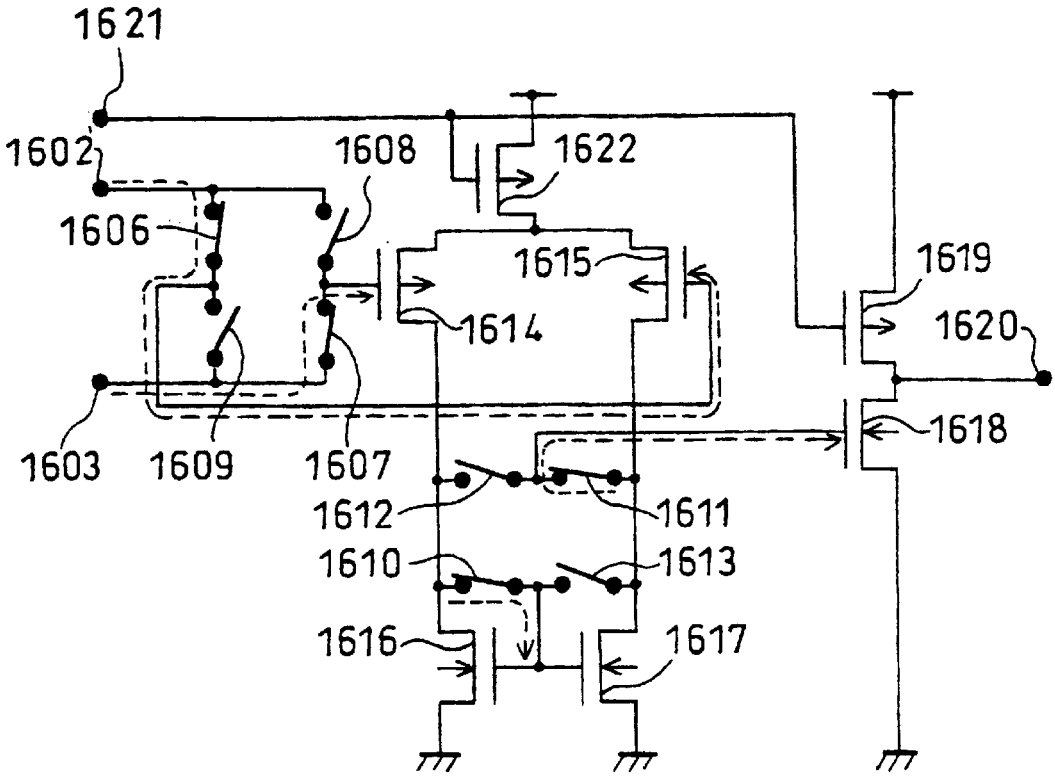
FIG. 37 is a circuit diagram showing an operation of an operational amplifier shown in FIG. 36.
Figure 38:
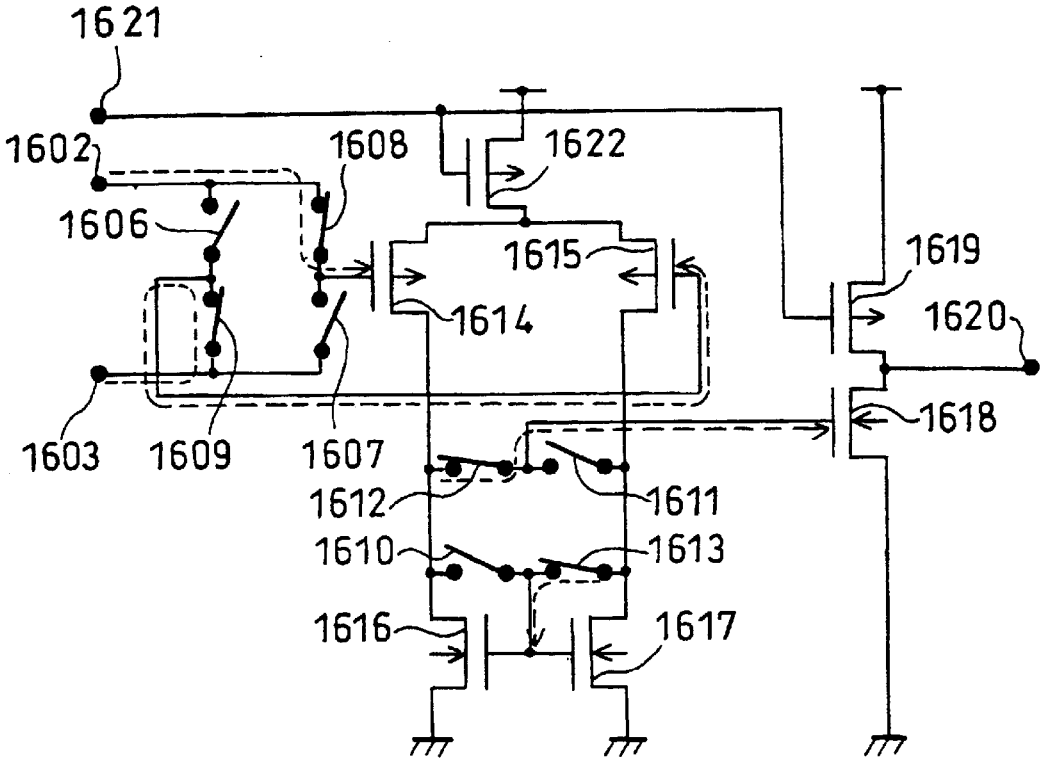
FIG. 38 is a circuit diagram showing another operation of the operational amplifier shown in FIG. 36.
Figure 39:
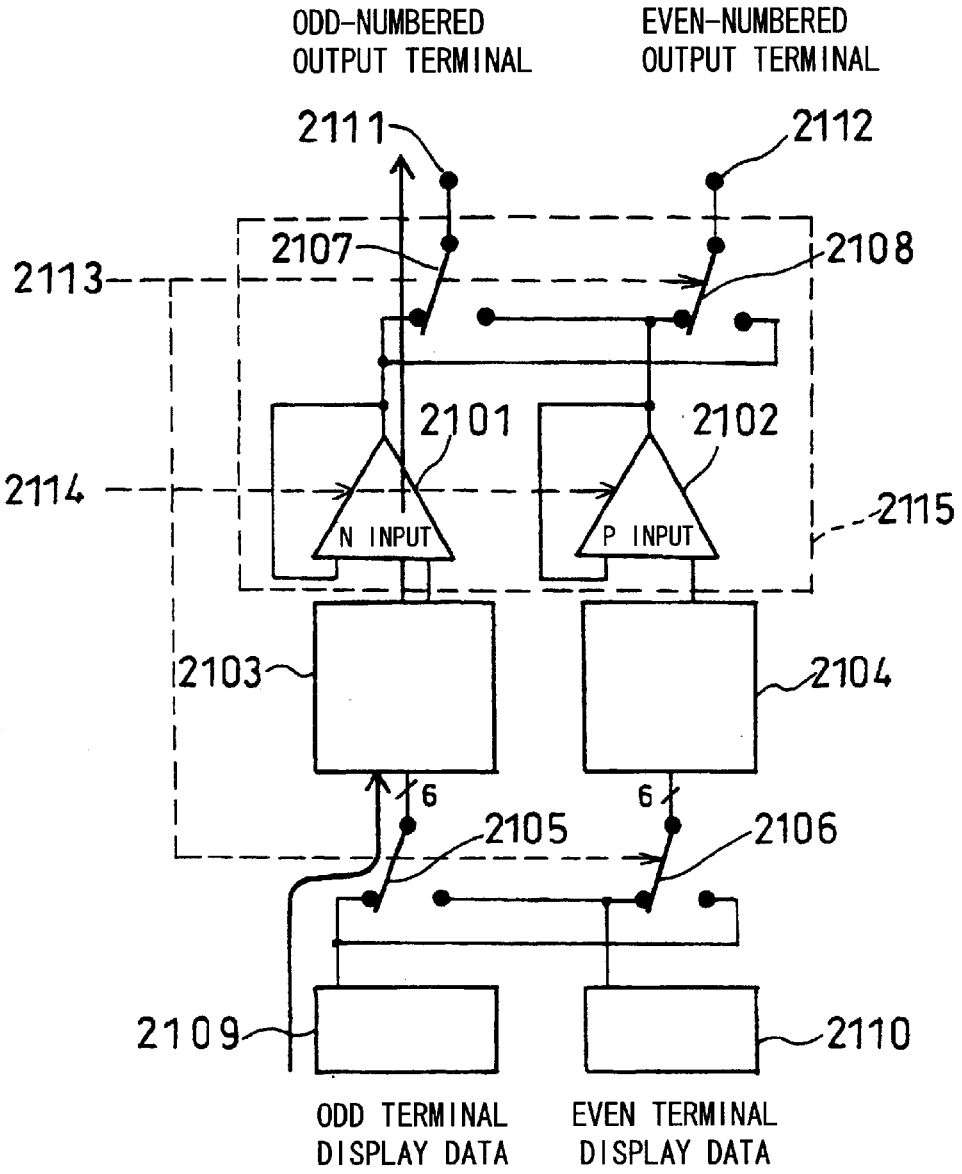
FIG. 39 is an output block diagram showing a liquid crystal driving circuit that adopts the differential amplifier circuit and carries out the dot inversion driving, and shows the case where a driving voltage having positive polarity is outputted via an odd-numbered output terminal while a driving voltage having negative polarity is outputted via an even-numbered output terminal.
Figure 40:
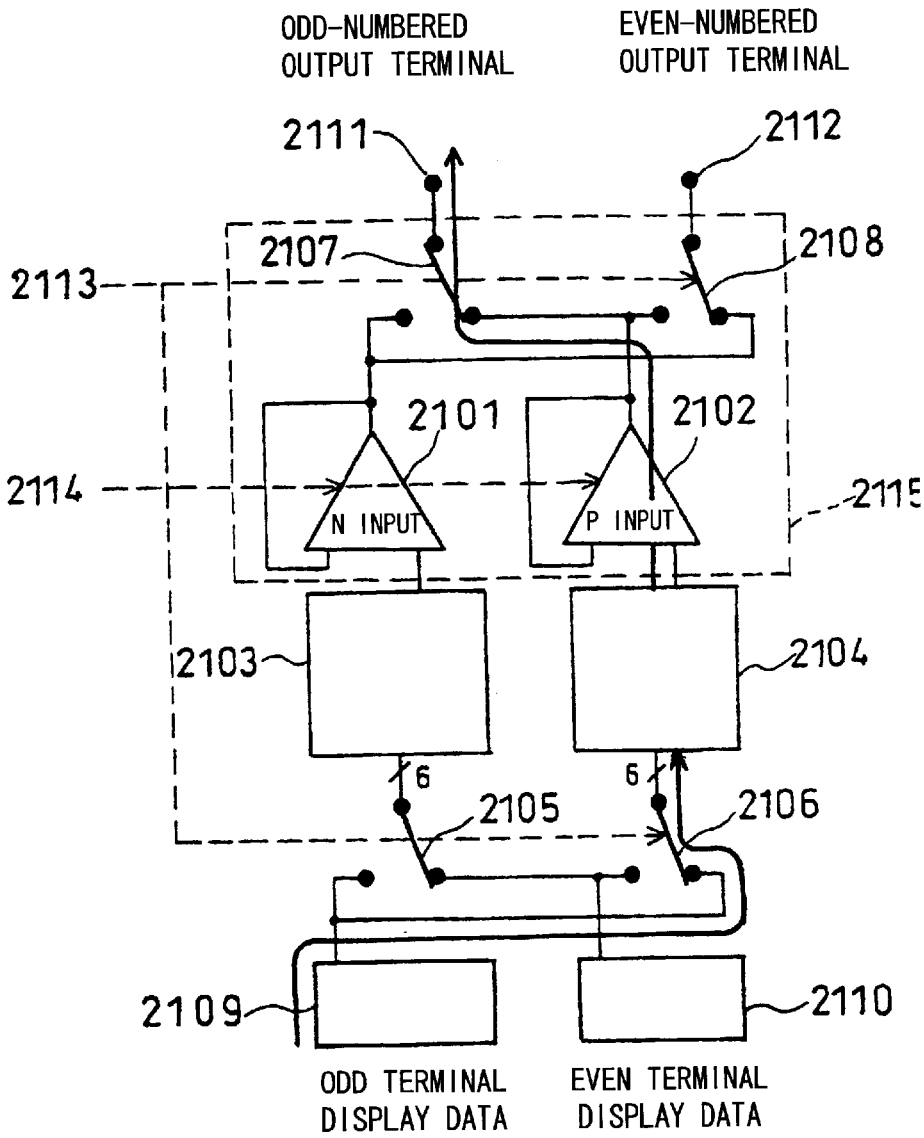
FIG. 40 is an output block diagram showing a liquid crystal driving circuit that adopts the differential amplifier circuit and carries out the dot inversion driving, and shows the case where a driving voltage having negative polarity is outputted via an odd-numbered output terminal while a driving voltage having positive polarity is outputted via an even-numbered output terminal.
Figure 41:
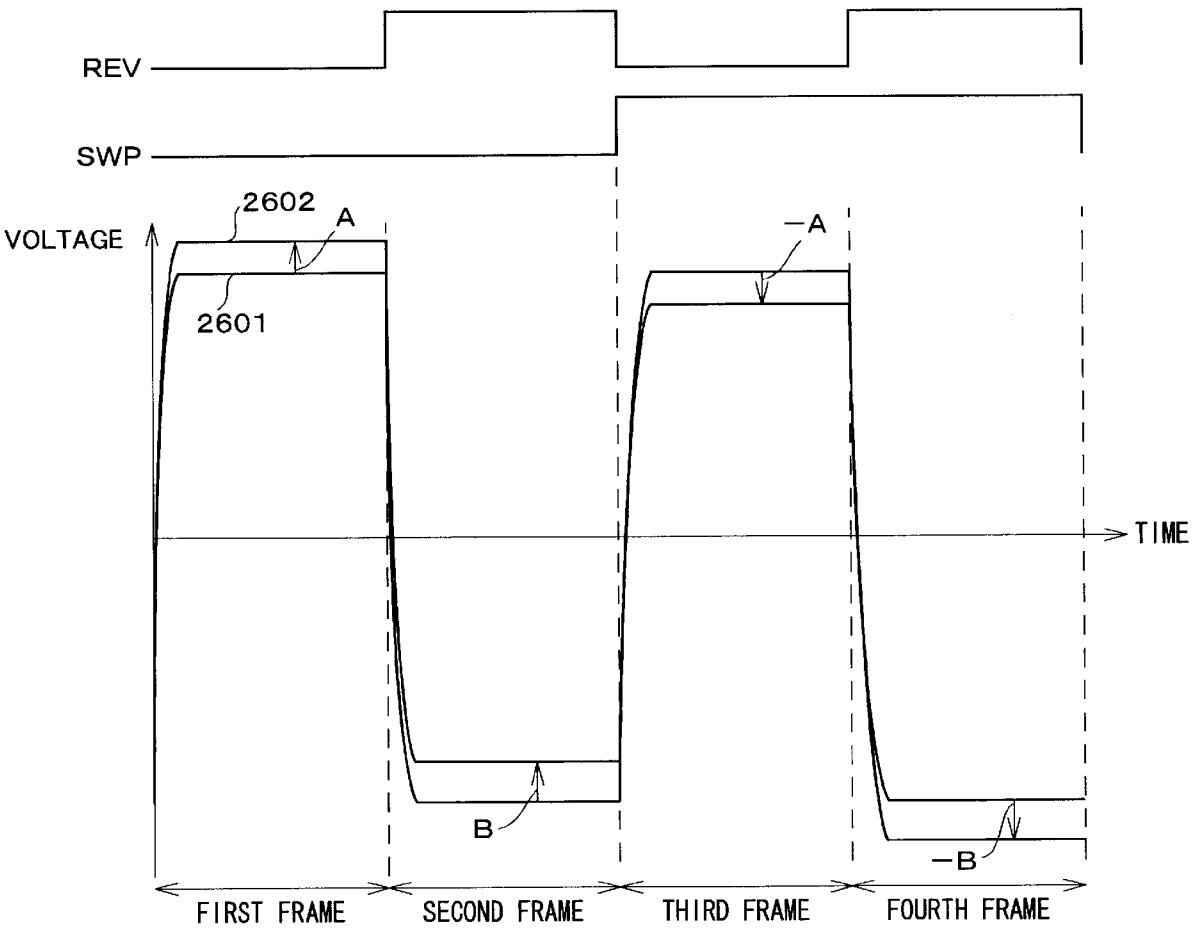
FIG. 41 is an explanatory diagram showing the relation among an alternation switch changeover signal, a switch changeover signal of the operational amplifier, and an output signal.

A shift register circuit 4403, a sampling memory circuit 4404, a hold memory 4405, a level shifter circuit 4406, a D/A converter circuit 4407, a reference voltage generation circuit 4402, and an input latch circuit 4401 have the same functions as those shown in FIG. 16, respectively. Accordingly, the explanations thereof are omitted here. An output circuit 4408 has a circuit configuration in which an operational amplifier for outputting a voltage having positive polarity and an operational amplifier for outputting a voltage having negative polarity are provided, separately.

Figure 1:
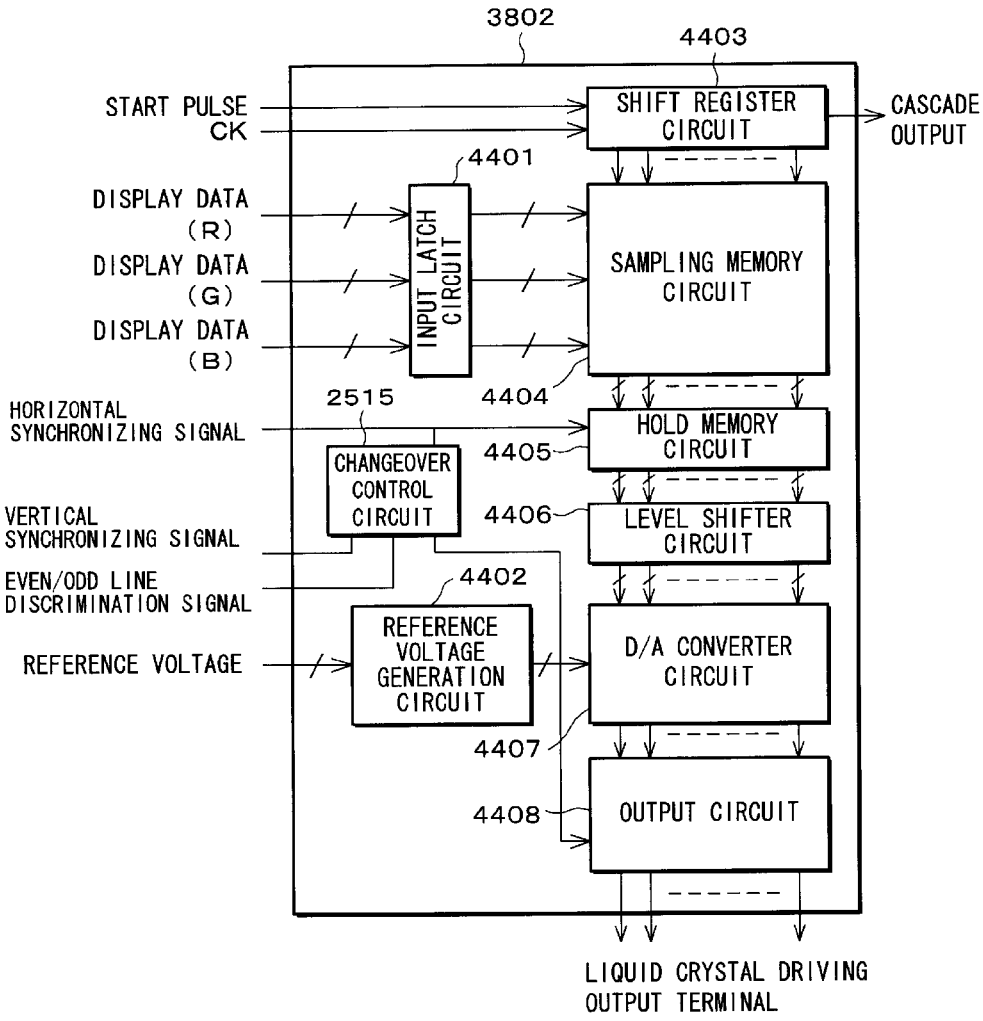
FIG. 1 is a block diagram showing an example of a main part in a driving apparatus of liquid crystal display apparatus in accordance with the present invention.
Figure 2:
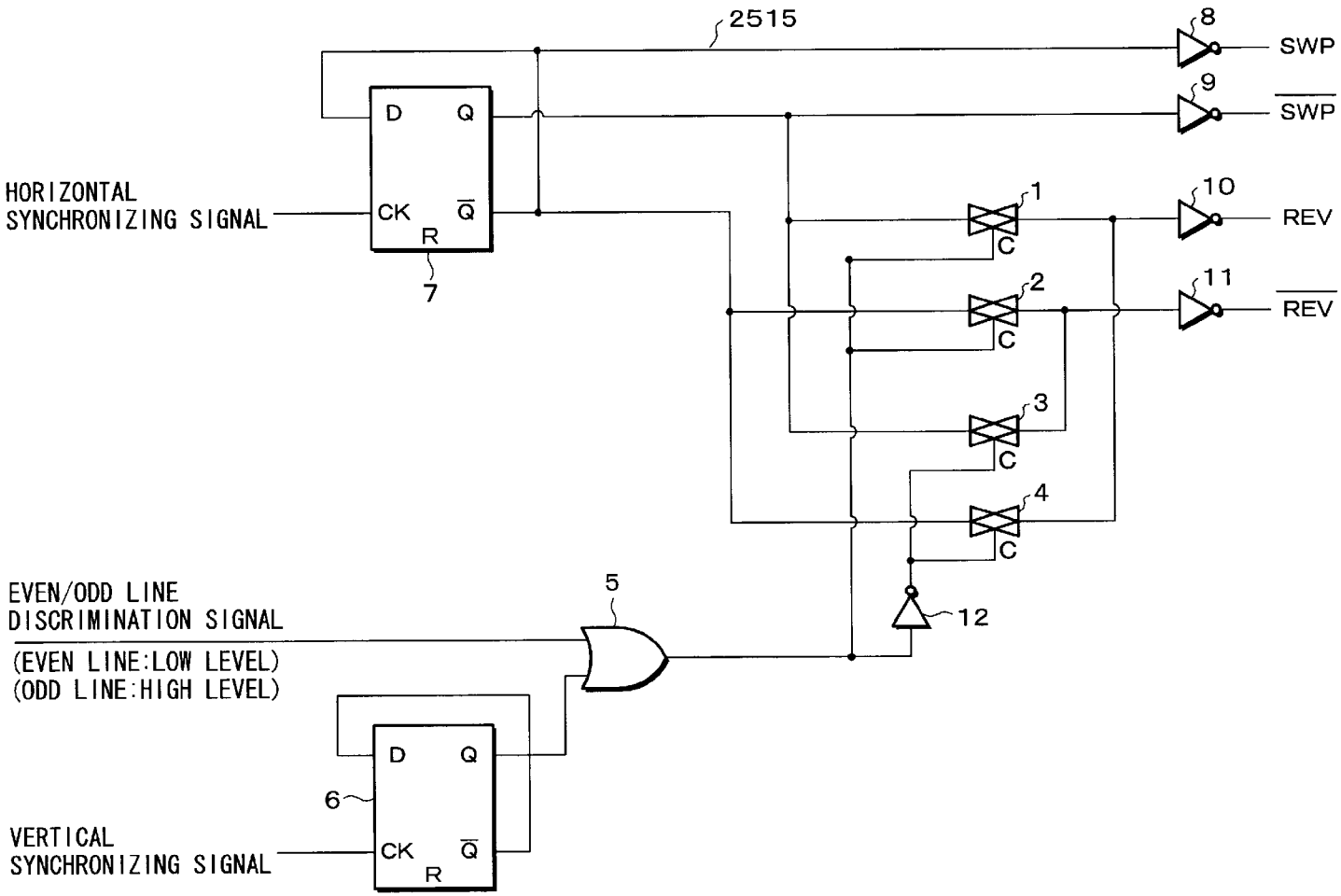
FIG. 2 is a circuit diagram showing an example of a circuit configuration of a changeover control circuit.

FIG. 2 shows an example of a circuit configuration of a changeover control circuit 2515 shown in FIG. 1. The changeover control circuit 2515 includes an SWP/REV changeover switch circuit (later described). The SWP indicates a switch changeover signal for the above two operational amplifiers, and the REV indicates an alternation switch changeover signal.

Figure 3:
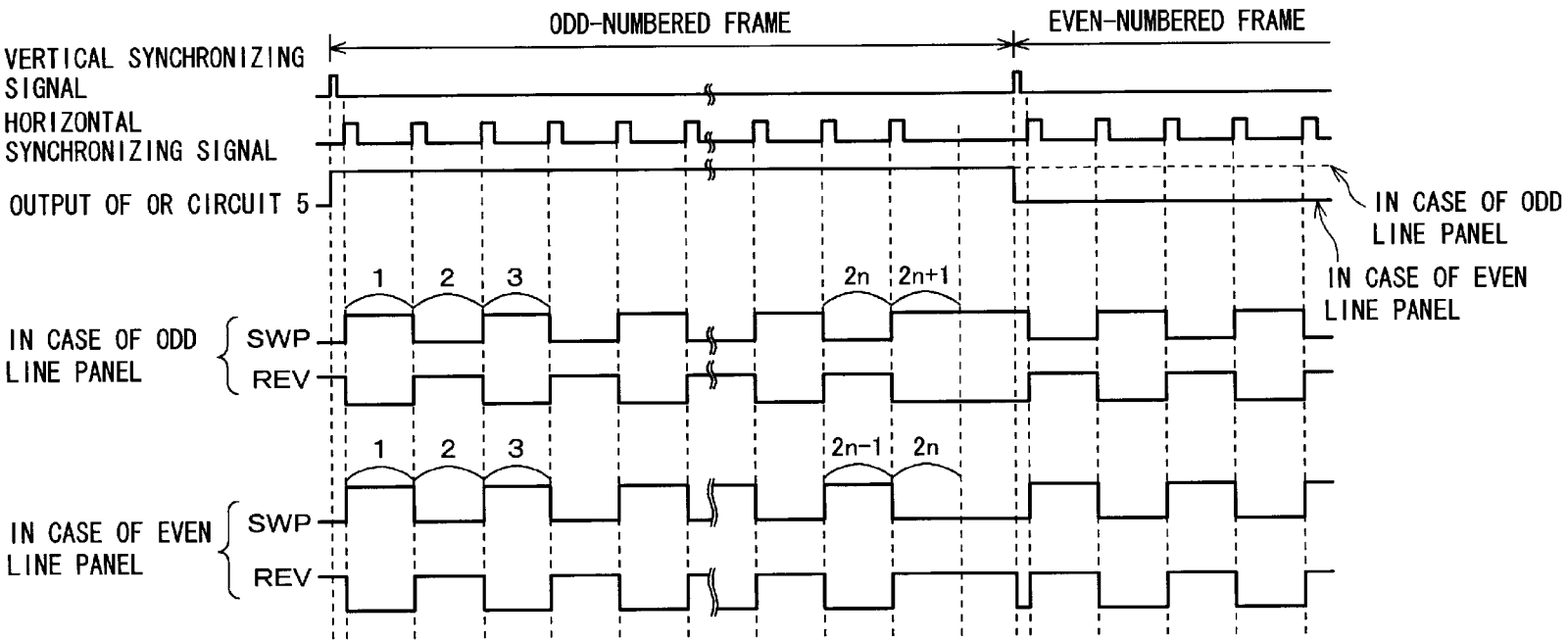
FIG. 3 is a diagram showing wave forms of main parts of the changeover control circuit.
Figure 42:
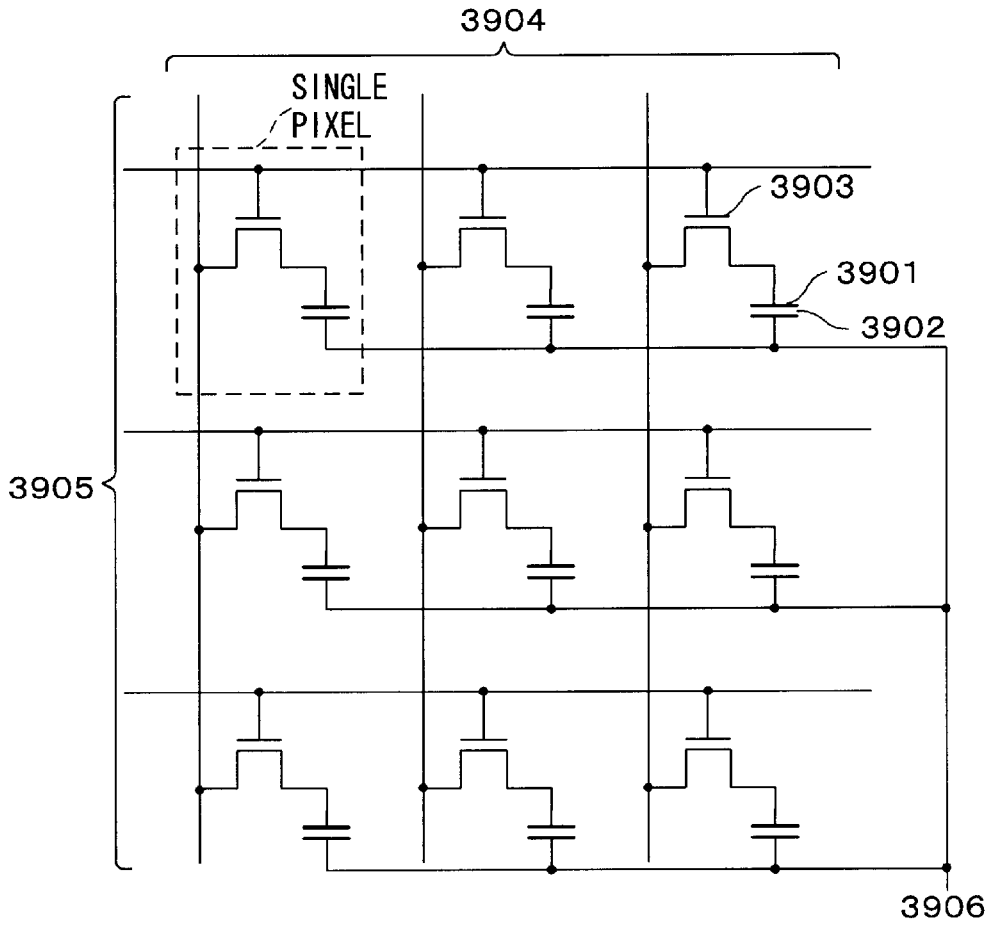
FIG. 42 is an explanatory diagram showing a structure of a conventional TFT liquid crystal panel.

FIG. 3 shows the input signal wave form and the output signal wave form of the changeover control circuit 2515. FIGS. 4 and 5 show how offset voltages, outputted from the output circuit 4408 disperse. Note that FIG. 4 shows the case where the number of the horizontal lines, which is the number of the row lines corresponding to the gate signal lines 3905 shown in FIG. 42, is an even number (i.e., an even number line panel), and that FIG. 5 shows the case where the number of the horizontal lines is an odd number (i.e., an odd number line panel).

According to FIG. 4, the display is carried out provided that the number of the row lines is eight. According to FIG. 5, the display is carried out provided that the number of the row lines is seven. According to FIGS. 4 and 5, the displays are respectively carried out provided that the number of the column lines is eight. This is for convenience sake of explanation. Namely, the present invention is not limited to this.

The changeover control circuit 2515 is basically a circuit that divides the frequency of the horizontal synchronizing signal into ½. The changeover control circuit 2515 can be realized by a simple circuit configuration in which an input terminal D of a D-type flip-flop 7 is connected with an output terminal /Q, the horizontal synchronizing signal is applied to a clock input terminal CK, a signal of the output terminal /Q is outputted as the switch changeover signal SWP via an inverter circuit 8, and a signal of an output terminal Q is outputted as the switch changeover signal /SWP via an inverter circuit 9, for example, as shown in FIG. 2.

With the circuit configuration, the switch changeover signal SWP of the operational amplifiers for outputting the voltages is generated in synchronization with the rising of the horizontal synchronizing signal. More specifically, the switch changeover signal SWP changes from a low level to a high level or vice versa in synchronization with the rising of the horizontal synchronizing signal. Note that the /SWP is an inverted signal of the SWP.

The alternation switch changeover signal REV is a signal that also changes in synchronization with the rising of each horizontal synchronizing signal. More specifically, the alternation switch changeover signal REV changes from a low level to a high level or vice versa in synchronization with the rising of the horizontal synchronizing signal. Note that the /REV is an inverted signal of the REV. To generate the alternation switch changeover signal REV based on the switch changeover signal SWP is the easiest way. This is dealt with by the following description.

The way to generate the alternation switch changeover signal REV varies depending on whether the liquid crystal display panel is of an even number line panel in which the number of the horizontal lines is an even number or of an odd number line panel in which the number of the horizontal lines is an odd number. The alternation switch changeover signal REV is generated by switching the switch changeover signal SWP. The following description concretely deals with the generation thereof.

More specifically, in the case of the even number line panel, in the first frame which is the odd-numbered frame (see frame ① shown in FIG. 4), an inverted signal /SWP of the switch changeover signal SWP is used as the alternation switch changeover signal REV, and the switch changeover signal SWP is used as the alternation switch changeover signal /REV. In the second frame which is the even-numbered frame (see frame ② shown in FIG. 4), the switch changeover signal SWP is used as the alternation switch changeover signal REV, and the switch changeover signal /SWP is used as the alternation switch changeover signal /REV. Such operations are alternately repeated with respect to the respective first and second frames.

In contrast, in the case of the odd number line panel, always, the switch changeover signal SWP is used as the alternation switch changeover signal /REV, and the switch changeover signal /SWP is used as the alternation switch changeover signal REV.

Each generation of the alternation switch changeover signals can be easily realized by providing an output section (stage) of the generation circuit for the signals SWP and /SWP shown in FIG. 2 with (a) switch means for carrying out the changeover so as to obtain the above signal states in accordance with a discrimination signal that discriminates whether the liquid crystal display panel is of an even number line panel (for example, a low level) or of an odd number line panel (for example, a high level), and (b) means for switching the switch means in accordance with the first and second frames in the case of the even number line panel, the means being easily able to be realized by applying the vertical synchronizing signal (instead of the horizontal synchronizing signal) to the clock input terminal CK of the D-type flip-flop in the ½ frequency divider circuit shown of FIG. 2. It is preferable that analog switches such as MOS transistors and transmission gates are used as the switch means.

FIG. 2 shows an example in which the switch means is realized by transmission gates 1 through 4. The transmission gate 1 is provided between the output terminal Q of the D-type flip-flop 7 and the inverter circuit 10. The transmission gate 2 is provided between the output terminal /Q of the D-type flip-flop 7 and the inverter circuit 11. The transmission gate 3 is provided between the output terminal Q of the D-type flip-flop 7 and the inverter circuit 11. The transmission gate 4 is provided between the output terminal /Q of the D-type flip-flop 7 and the inverter circuit 10. The alternation switch changeover signal REV is outputted via the output terminal of the inverter circuit 10. The alternation switch changeover signal /REV is outputted via the output terminal of the inverter circuit 11.

The transmission gates 1 and 2 receive an output signal of an OR circuit 5 (later described) via respective control terminals C. The respective control terminals C of the transmission gates 3 and 4 receive the output signal of the OR circuit 5 via an inverter circuit 12. The transmission gates 1 through 4 become electrically conductive (in a closed state) when a voltage of high level is applied to the control terminal C, and become electrically nonconductive (in an opened state) when a voltage of low level is applied to the control terminal C. Thus, the foregoing operations are carried out.

Note that the even/odd line discrimination signal is applied to one of the input terminals of the OR circuit 5, and another input terminal of the OR circuit 5 is connected with an output terminal Q of a D-type flip-flop 6. The D-type flip-flop 6 receives the vertical synchronizing signal via its clock input terminal CK. In the D-type flip-flop 6. In the D-type flip-flop 6, an output terminal /Q is connected with an input terminal D.

According to the circuit configuration shown in FIG. 2, when the even/odd line discrimination signal is a high level (i.e., in the case of odd number line panel), irrespective of the output signal from the D-type flip-flop 6, the output signal of the OR circuit 5 is always a high level (see FIG. 3). This allows the transmission gates 1 and 2 to be electrically conductive, thereby resulting in that the switch changeover signal SWP is used as the alternation switch changeover signal /REV and the switch changeover signal /SWP is used as the alternation switch changeover signal REV.

In contrast, when the even/odd line discrimination signal is a low level (i.e., in the case of even number line panel), the output signal of the OR circuit 5 varies depending on whether the first frame (see the frame shown ① in FIG. 4) or the second frame (see the frame ② shown in FIG. 4), as shown in FIG. 3.

In the first frame (an odd-numbered frame), the level of the output terminal Q of the D-type flip-flop 6 changes from low level to high level in synchronization with the rising of the vertical synchronizing signal, thereby resulting in that the output signal of the OR circuit 5 becomes a high level. This causes the transmission gates 1 and 2 to receive a voltage of high level via their control terminals C so as to be electrically conductive, respectively. This results in that the switch changeover signal SWP is used as the alternation switch changeover signal /REV and the switch changeover signal /SWP is used as the alternation switch changeover signal REV. Namely, the switch changeover signal and the alternation switch changeover signal have a reverse polarity (reverse-phase) relation, as shown in FIG. 3.

In contrast, in the second frame (an even-numbered frame), the level of the output terminal Q of the D-type flip-flop 6 changes from high level to low level in synchronization with the rising of the vertical synchronizing signal, thereby resulting in that the output signal of the OR circuit 5 becomes a low level. This causes the transmission gates 3 and 4 to receive a voltage of high level via their control terminals C so as to be electrically conductive, respectively. This results in that the switch changeover signal /SWP is used as the alternation switch changeover signal /REV, and the switch changeover signal SWP is used as the alternation switch changeover signal REV. Namely, the switch changeover signal and the alternation switch changeover signal have a same polarity relation, as shown in FIG. 3.

In FIG. 2, the wirings with respect to reset terminals R of the respective D-type flip-flops 6 and 7 that are ½ frequency divider circuit are omitted. However, in the case of a circuit configuration in which a plurality of source drivers are provided, it is preferable to apply a reset signal to the respective reset terminals R for every turning on the power source or for every two frames as shown in FIG. 2 so that the switch changeover signal SWP and the alternation switch changeover signal REV are of the same phase.

FIG. 2 shows the circuit configuration for the generation of the switch changeover signal SWP and the alternation switch changeover signal REV. The present invention, however, is not limited to this. For example, a controller realized by a microcomputer may be programmed so that the switch changeover signal SWP and the alternation switch changeover signal REV are outputted in accordance with the above-described timing.

Figure 7:
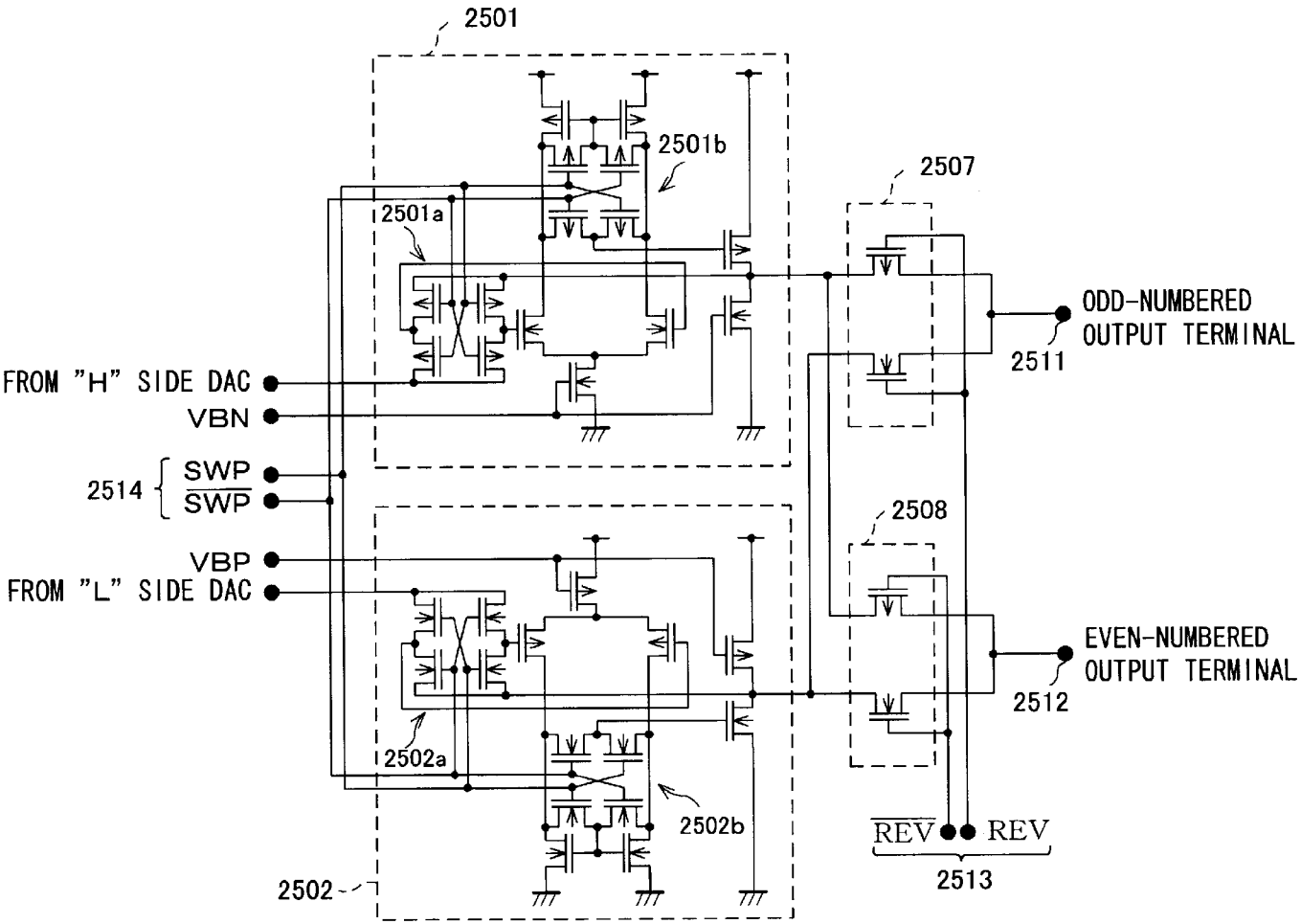
FIG. 7 shows both of the present invention and the conventional art, and is a circuit diagram showing an example of a concrete structure of a differential amplifier circuit.
Figure 12:
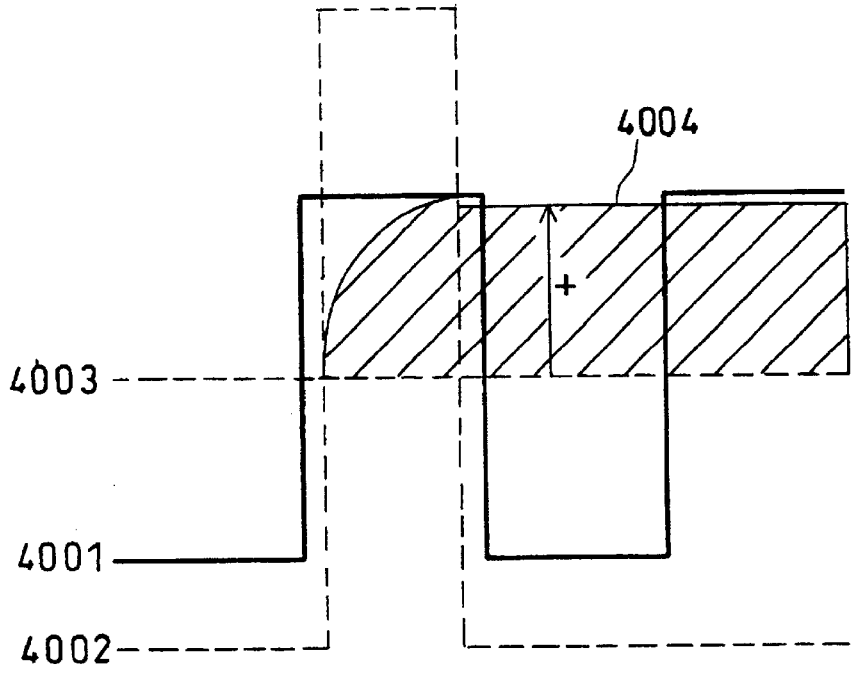
FIG. 12 is a diagram showing one example of a conventional liquid crystal wave forms, and shows the case where the TFT is turned on in response to the output signal of the gate driver when the output voltage of the source driver is greater than the voltage of the opposite electrode so that a voltage having positive polarity with respect to the opposite electrode is applied to the pixel electrode.
Figure 13:
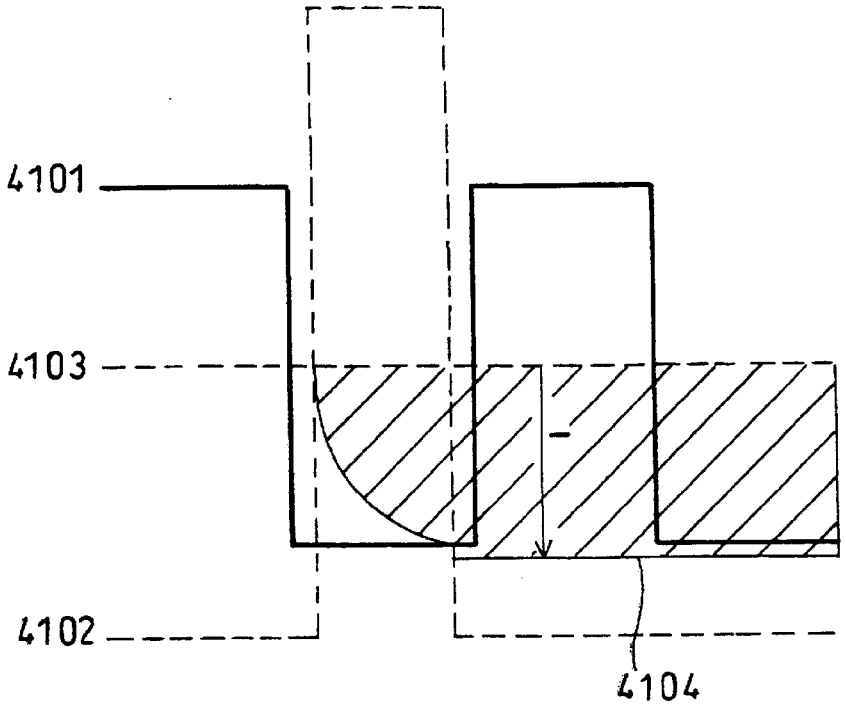
FIG. 13 is the wave form diagram showing an example of a conventional liquid crystal driving wave form, and shows that an output signal of the gate driver causes the TFT to be turned on when an output voltage of the source driver is smaller than the voltage of the opposite electrode so that a voltage showing a negative polarity with respect to the opposite electrode is applied to the pixel electrode.
Figure 14:
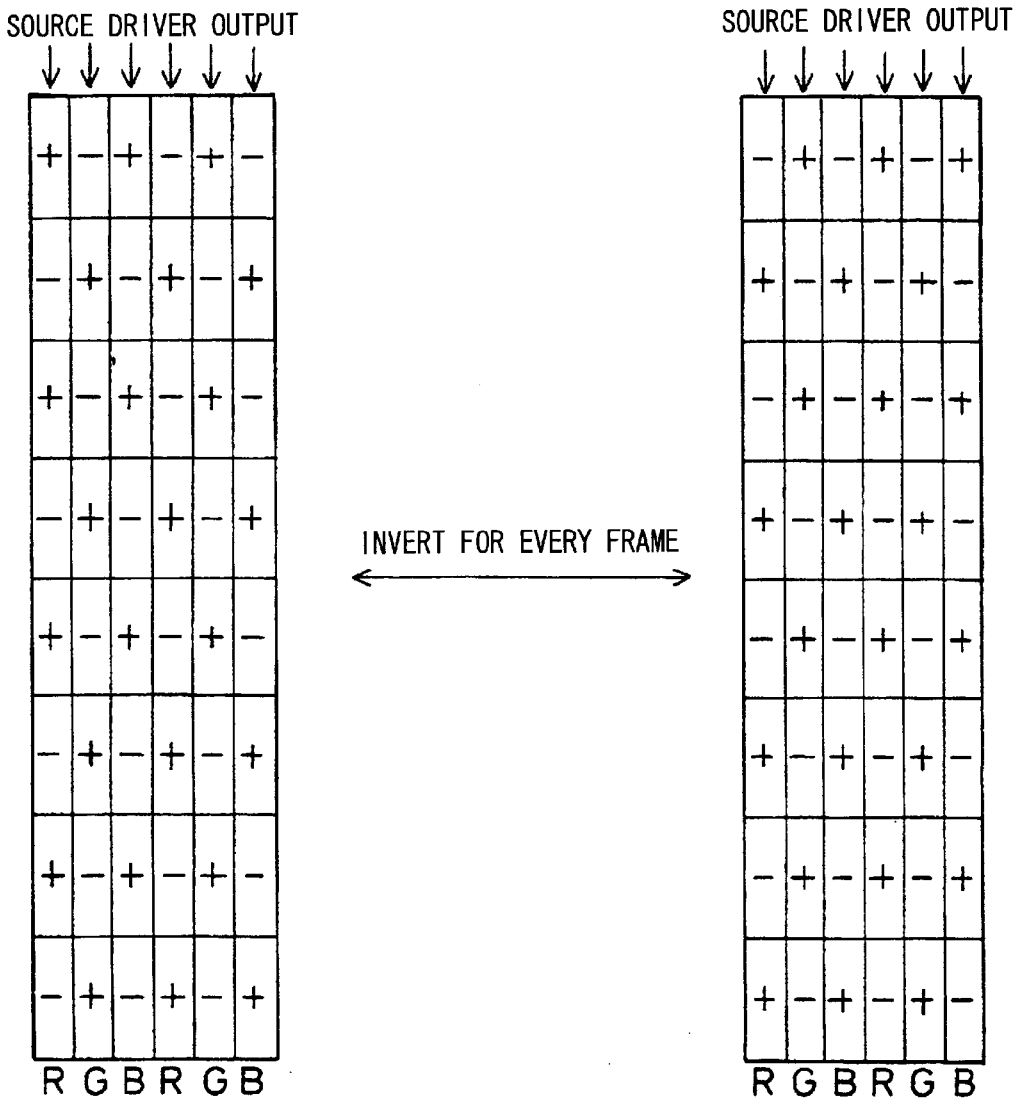
FIG. 14 is an explanatory diagram showing a conventional example of polarity arrangement of the alternation on a liquid crystal panel during the alternation of a liquid crystal driving voltage.
Figure 15:
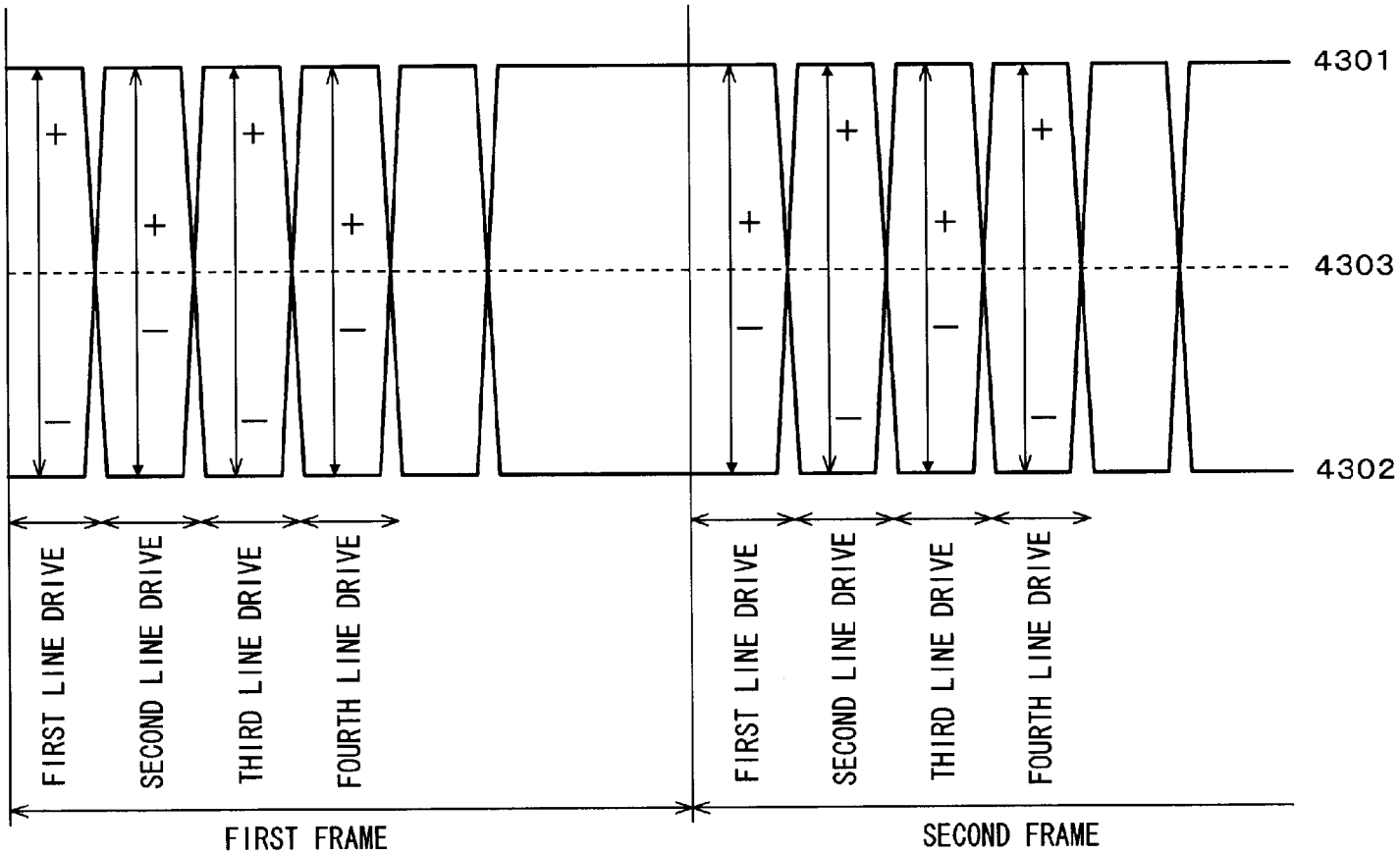
FIG. 15 is an explanatory diagram showing the wave form diagram of the source driver in a conventional dot inversion driving.

In FIG. 7, "from "H" side DAC" indicates that an output signal from the positive-polarity D/A converter circuit 2103 is applied, and "from "L" side DAC" indicates that an output signal from the negative-polarity D/A converter circuit 2104 is applied, respectively.

When the operational amplifier shown in FIG. 7 receives the switch changeover signals SWP and /SWP and the alternation switch changeover signals REV and /REV, the offset voltages contained in the output signals to be outputted in accordance with the above four signals via the output terminals, respectively are expressed as Table 1.

Note that symbols VBN and VBP indicate bias voltage input terminals used for giving operating points of the operational amplifiers, respectively. It is assumed that appropriate bias voltages are applied via the terminals VBN and VBP so that no distortion occurs in the amplification of the operational amplifier.

In a row line indicated as ① of the frame (the first frame (the odd-numbered frame) indicated as ① shown in FIG. 4 that shows the even number line panel, when the alternation switch changeover signal REV is a low level (L) and the switch changeover signal SWP is a high level (H), (a) a signal including an offset voltage −A is applied to the odd-numbered pixels in the row line ① and (b) a signal including an offset voltage −B is applied to the even-numbered pixels in the row line ①.

In a row indicated as ②, the alternation switch changeover signal REV is inverted to be a high level (H) and the switch changeover signal SWP is inverted to be a low level (L). This causes the odd-numbered pixels to receive a signal including an offset voltage +B and the even-numbered pixels to receive a signal including an offset voltage +A, in the row line ②. Thereafter, the similar operations are carried out with respect to the following row lines ③ through ⑧, the row line ⑧ being the bottom one (the lowest row line).

Then, in a row line indicated as ① of the frame (the second frame (the odd-numbered frame) indicated as ② shown in FIG. 4, the switch changeover signal SWP becomes a high level (H), (a) a signal including an offset voltage −B is applied to the odd-numbered pixels in the row line ① and (b) a signal including an offset voltage −A is applied to the even-numbered pixels.

In a row line indicated as ①, the alternation switch changeover signal REV is inverted to be a low level (L) and the switch changeover signal SWP is inverted to be a low level (L). This causes the odd-numbered pixels to receive a signal including an offset voltage +A and the even-numbered pixels to receive a signal including an offset voltage +B, in the row line ②. Thereafter, the similar operations are carried out with respect to the following row lines ③ through ⑧, the row line ⑧ being the bottom one (the lowest row line).

The above operations are repeated with respect to the frames ① and ② (i.e., the frames ①→②→①→②→①→②→). Thus, the foregoing operations are repeated. FIG. 4 shows how the offset voltages, contained in the voltages applied to the respective pixels in the even number line panel, disperse in accordance with the above operations.

FIG. 8 is an explanatory diagram showing a resultant of extraction of only the voltages having positive polarity (the offset voltages +A and −A generated in the operational amplifier whose input section (stage) is made of N-channel MOS transistors are contained in the signal.) from the dispersion (distribution) state of the offset voltages shown in FIG. 4.

FIG. 9 is an explanatory diagram showing a resultant of extraction of only the voltages having negative polarity (the offset voltages +B and −B generated in the operational amplifier whose input section (stage) is made of P-channel MOS transistors are contained in the signal.) from the dispersion state of the offset voltages shown in FIG. 4.

In any one of the above cases, when an offset voltage +A (−B) is applied to a certain pixel, an offset voltage −A (+B) is applied to the four pixels that are provided diagonally up to right and left and diagonally down to right and left with respect to such a certain pixel. The similar result is obtained in the case of the odd number panel lines (see FIGS. 5, 10, and 11). The output relation based on the signal state of the switch changeover signal SWP and the alternation switch changeover signal REV is the same as that of the even number panel lines. Accordingly, the description thereof is omitted here.

Thus, an offset voltage having negative polarity (−A, −B) is sure to be applied to the four pixels that are provided diagonally up to right and left and diagonally down to right and left with respect to a pixel to which an offset voltage having positive polarity (+A, +B); whose absolute value is the same as that of the offset voltage having negative polarity and whose polarity is reversed to the offset voltage having negative polarity, or vice versa. As mentioned above, it is possible to provide a liquid crystal display panel having finely divided pixels and high precision. When arranging the offset voltages so that an offset voltage to be applied to a pixel has a polarity which is reversed to that of respective offset voltages applied to its surrounding pixels (correctly speaking, the pixels provided diagonally up to right and left and diagonally down to right and left with respect to the central pixel) so that the deviations are uniformly dispersed in space. This allows that so-called display unevenness is indiscernible by the sense of sight.

The driving method of the liquid crystal display panel that has been described, i.e., the driving method in which an offset voltage to be applied to a pixel has a polarity which is reversed to that of the respective offset voltages applied to the pixels provided diagonally up to right and left and diagonally down to right and left with respect to such a pixel in a single frame is only an example. The present invention is not limited to this, accordingly. It should be noted that the driving method of the present invention may be changed and modified in various manners as long as they fall within the scope of the present invention.

For example, although the horizontal synchronizing signal (i.e., the latch signal) is used in the changeover control circuit 2515 shown in FIG. 2, the similar circuit configuration can be realized even when the start pulse signal that is outputted in accordance with substantially the same timing as the horizontal synchronizing signal is used instead. In this case, the start pulse signal indicates a signal that has not passed through the shift register circuit 4403 in the source driver, i.e., that has just been outputted from the controller 3804.

As to the changeover control signal of FIG. 2 the foregoing description deals with the case where the changeover control signal is generated in the source driver. Instead, the circuit configuration may be possible in which the changeover control circuit is provided in the controller 3804 shown in FIG. 6 so that the switch changeover signal SWP and the alternation switch changeover signal REV are outputted to the source driver. The circuit configuration may also be possible in which the controller or the source driver is provided with a ½ frequency divider circuit section for the horizontal synchronizing signal or a ½ frequency divider circuit section for the vertical synchronizing signal and a changeover switch section that is collateral with respect to the respective ½ frequency divider circuit sections.

As has been mentioned above, a liquid crystal driving apparatus in accordance with the present invention (1) controls, for every line driving, a differential amplifier circuit that is provided with (a) first and second amplifier circuits that amplifies the a noninverted input signal and an inverted input signal, (b) controller means that selectively switches between the noninverted input signal and the inverted input signal and outputs it to the first and second amplifier circuits and that outputs the noninverted input signal that has been amplified by one of the first and second amplifier circuits as an inverted output signal while the inverted input signal that has been amplified by another one of the first and second amplifier circuits as a noninverted output signal, (2) is arranged so that an offset occurred in the noninverted output signal and an offset occurred in the inverted output signal have a same absolute value and have polarities which are reversed to each other because the noninverted input signal and the inverted input signal are controlled by the controller, the noninverted input signal that has been amplified by one of the first and second amplifier circuits as the inverted output signal while the inverted input signal that has been amplified by another one of the first and second amplifier circuits as the noninverted output signal, and (3) switches a switch changeover signal SWP and an alternation switch changeover signal REV of operational amplifiers for every horizontal synchronizing signal so that pixels that are provided diagonally up to right and left and diagonally down to right and left with respect to a pixel to which an offset voltage (+A, +B) having positive polarity is added by offset voltages (−A, −B) having negative polarity that has the same absolute value as that of the offset voltage (+A, +B), or vice versa.

With the arrangement, since the size of one pixel is small enough, it is possible that so-called display unevenness is indiscernible by the sense of sight. This allows to realize a liquid crystal display with extremely good display quality. The present invention shows the effect when coping with the case where the frame frequency is lowered or the case where the response speed of the liquid crystal material becomes faster. Further, as has been described before, the merit on the low power consumption is maintained when the liquid crystal driving apparatus is adapted to an apparatus in which the number of the operational amplifiers whose power consumption is large is reduced.

Another liquid crystal driving apparatus of liquid crystal display apparatus, in accordance with the present invention, which drives the liquid crystal display apparatus in a dot inversion manner and is provided with an output section constituted by first and second differential amplifier sections that amplifies a noninverted display input signal and an inverted display input signal which are switched by first switching means and the amplified signals are further switched by second switching means so as to be outputted, is characterized by further comprising control means for switching the first and second switching means for every horizontal synchronizing period in a single frame (a) in synchronization with each horizontal synchronizing signal that scans the liquid crystal display apparatus or (b) in synchronization with a signal that is outputted for every horizontal synchronizing period.

It is preferable that the control means further includes means for discriminating whether the liquid crystal display apparatus is an even number line panel or an odd number line panel and for switching in accordance with a discriminated result (a) a controlling in which the switching between the first and second switching means in accordance with an inverted switching signal and the switching between the first and second switching means in accordance with a noninverted switching signal are alternately carried out for every frame and and (b) a controlling in which only the switching between the first and second switching means is carried out in accordance with the inverted switching signal.

A driving method of liquid crystal display apparatus, in accordance with the present invention, which drives the liquid crystal display apparatus in a dot inversion manner and is provided with an output section constituted by first and second differential amplifier sections that amplifies a noninverted display input signal and an inverted display input signal which are switched by first switching means and the amplified signals are further switched by second switching means so as to be outputted, is characterized by comprising the steps of: switching the first and second switching means for every horizontal synchronizing period in a single frame (a) in synchronization with each horizontal synchronizing signal that scans the liquid crystal display apparatus or (b) in synchronization with a signal that is outputted for every horizontal synchronizing period, whereby, when each deviation contained in output signals of the first and second differential amplifier sections is added to a signal voltage and is applied to a pixel (central pixel) of the liquid crystal display apparatus, deviations that have the same absolute value as that of the central pixel and that have the polarity which is reversed to that of the central pixel are applied to four pixels that are provided diagonally up to right and left and diagonally down to right and left with respect to the central pixel among other surrounding pixels.

It is preferable that the steps are further includes: discriminating whether the liquid crystal display apparatus is an even number line panel or an odd number line panel; and switching in accordance with a discriminated result (a) a controlling in which the switching between the first and second switching means in accordance with an inverted switching signal and the switching between the first and second switching means in accordance with a noninverted switching signal are alternately carried out for every frame and and (b) a controlling in which only the switching between the first and second switching means is carried out in accordance with the inverted switching signal.

A driving apparatus of liquid crystal display apparatus in accordance with the present invention is characterized by having a changeover control circuit that switches the output signals of the first and second amplifier circuits so that an offset voltage applied to a pixel has a polarity that is reversed to a polarity of respective offset voltages applied to its surrounding pixels.

With the present invention, the output signals of the first and second amplifier circuits are suitably switched so that an offset voltage applied to a pixel has a polarity that is reversed to a polarity of respective offset voltages applied to its surrounding pixels. This allows that the offset voltages (the deviations) are uniformly dispersed in space, thereby resulting in that so-called display unevenness is discernible by the sense of sight.

According to the present invention, instead of canceling the offset voltages in a several frames, the offset voltage of a pixel is canceled by the offset voltages of its surrounding pixels, thereby making the display unevenness indiscernible. This allows to cope with the case where development is further made to obtain a liquid crystal display panel having much finely divided pixels and much higher precision, thereby ensuring to provide a driving apparatus of liquid crystal display apparatus with excellent high reliability.

It is preferable in the driving apparatus that the changeover control circuit switches the respective first and second changeover circuits so that an offset voltage applied to a pixel has a polarity that is reversed to a polarity of pixels that are provided diagonally up to right and left and diagonally down to right and left with respect to such a pixel among surrounding pixels and has a same absolute value as absolute values of the pixels diagonally provided. In this case, the offset voltage of a pixel (a central pixel) is canceled by the four pixels that are provided diagonally up to right and left and diagonally down to right and left with respect to the central pixel among other surrounding pixels and that have the polarity that is reversed to that of such a pixel and have the same absolute value as that of such a pixel. This ensures to further improve the display unevenness.

It is preferable that the changeover control circuit switches the first and second changeover circuits for every horizontal synchronizing period in a single frame, in synchronization with a horizontal synchronizing signal or a signal that is outputted for every horizontal synchronizing period.

It is preferable that the changeover control circuit discriminates whether the liquid crystal display apparatus is an even number line panel or an odd number line panel, and selectively switches in accordance with a discriminated result (a) a controlling in which the switching between the first and second switching means in accordance with an inverted switching signal and the switching between the first and second switching means in accordance with a noninverted switching signal are alternately carried out for every frame and (b) a controlling in which only the switching between the first and second switching means is carried out in accordance with the inverted switching signal.

The changeover control circuit can be realized by the following circuit configuration, for example. More specifically, it is preferable that the changeover control circuit is provided with (a) a first frequency divider circuit that divides into ½ a frequency of a signal which is outputted for every horizontal synchronizing signal or for every horizontal synchronizing period and outputs it as the changeover signal to the first switching circuit, (b) a second frequency divider circuit that divides into ½ a frequency of the vertical synchronizing signal, (c) a switch control signal generation circuit that, according to an output signal of the second frequency divider circuit and a discrimination signal for discriminating whether the number of horizontal lines is an even number or an odd number, generates a first switch control signal in a case of the odd number, generates the first switch control signal in an odd-numbered frame in a case of the even number, and generates a second switch control signal in an even-numbered frame in a case of the even number, (d) a first switch circuit that receives the first switch control signal and is closed so as to output an inverted signal of the changeover signal as the alternation signal, and (e) a second switch circuit that receives the second switch control signal and is closed so as to output a noninverted signal of the changeover signal as the alternation signal.

According to the arrangement, the frequency of the signal which is outputted for every horizontal synchronizing signal or for every horizontal synchronizing period is divided into ½ by the first frequency divider circuit and is used as the changeover signal for the first switching circuit. The frequency of the vertical synchronizing signal is divided into ½ by the second frequency divider circuit and is outputted to the switch control signal generation circuit. The discrimination signal discriminating whether the number of horizontal lines is an even number or an odd number is applied to the switch control signal generation circuit.

According to the signals that have been inputted, the switch control signal generation circuit generates the first switch control signal when the number of horizontal lines is an odd number, and generates the different switch control signals for every frame (the second and first switch control signals are alternately generated for every frame.) when the number of horizontal lines is an even number. Namely, the switch control signal generation circuit generates the first switch control signal in the odd-numbered frame when the number of horizontal lines is an even number, and generates the second switch control signal in the even-numbered frame.

When the number of the horizontal lines is the odd number, since the first switch control signal is applied to the first switch circuit, the first switch circuit becomes in the closed state. This causes that the inverted signal of the changeover signal is outputted to the second changeover circuit as the alternation signal.

In contrast, when the number of the horizontal lines is the even number, since the first switch control signal is applied to the first switch circuit in the odd-numbered frame, the first switch circuit becomes in the closed state. This causes that the inverted signal of the changeover signal is outputted to the second changeover circuit as the alternation signal. When the number of the horizontal lines is the even number, since the second switch control signal is applied to the second switch circuit in the even-numbered frame, the second switch circuit becomes in the closed state. This causes that the noninverted signal of the changeover signal is outputted to the second changeover circuit as the alternation signal.

As described above, without complicating the structure, it is possible to easily generate an alternation signal for switching the second changeover circuit in accordance with a signal for switching the first changeover circuit.

A driving method of liquid crystal display apparatus in accordance with the present invention is characterized in that the changeover signal and the alternation signal are controlled so that an offset voltage applied to a certain pixel has a polarity that is reversed to a polarity of pixels that are provided diagonally up to right and left and diagonally down to right and left with respect to the certain pixel among other surrounding pixels and has a same absolute value as absolute values of the pixels diagonally provided.

With the driving method, by controlling the changeover signal and the alternation signal, an offset voltage applied to the certain pixel has a polarity that is reversed to a polarity of the four pixels that are provided diagonally up to right and left and diagonally down to right and left among other surrounding pixels and has a same absolute value as absolute values of the pixels diagonally provided. This allows the offset voltage of a pixel to be canceled by the four surrounding pixels, so that the display unevenness can be improved.

The following is preferable. More specifically, the changeover signal is controlled in accordance with a horizontal synchronizing signal or a signal that is outputted for every horizontal synchronizing period, an inverted signal and a noninverted signal of the changeover signal are respectively generated in accordance with a vertical synchronizing signal and a discrimination signal that discriminates whether the number of horizontal lines is an odd number or an even number. When it is discriminated that the number of the horizontal lines is an even number, the inverted signal and the noninverted signal of the changeover signal are alternately switched for every frame, respectively, and outputted as the alternation signal. In contrast, when it is discriminated that the number of the horizontal lines is an odd number, only the inverted signal is outputted as the alternation signal. In this case, the alternation signal can be generated in accordance with the changeover signal without any complicated structure.

There are described above novel features which the skilled man will appreciate give rise to advantages. These are each independent aspects of the invention to be covered by the present application, irrespective of whether or not they are included within the scope of the following claims.

What is claimed is:

1. A driving apparatus of liquid crystal display apparatus in which first and second amplifier circuits are provided, a noninverted input signal and an inverted input signal are switched, and output signals of the first and second amplifier circuits are respectively switched and outputted to pixels that are provided in a matrix manner, comprising:

a changeover control circuit that switches the output signals of the first and second amplifier circuits so that an offset voltage applied to a pixel has a polarity that is reversed to a polarity of respective offset voltages applied to pixels that are provided diagonally up to right and left and diagonally down to right and left with respect to such a pixel among surrounding pixels.

2. A driving apparatus of liquid crystal display apparatus, comprising:

first and second amplifier circuits that amplify a noninverted input signal and an inverted input signal;

a first changeover circuit that selectively switches and output the noninverted and inverted input signals to the first and second amplifier circuits;

a second changeover circuit that selectively switches output signals of the first and second amplifier circuits in accordance with an alternation signal and output the output signals, that have been switched, to pixels that are provided in a matrix manner;

a changeover control circuit that switches the respective first and second changeover circuits so that an offset voltage applied to a pixel has a polarity that is reversed to a polarity of pixels that are provided diagonally up to right and left and diagonally down to right and left with respect to such a pixel among surrounding pixels and has a same absolute value as absolute values of the respective pixels diagonally provided.

3. The driving apparatus of liquid crystal display apparatus as set forth in claim 2, wherein the changeover control circuit switches the first and second changeover circuits for every horizontal synchronizing period in a single frame, in synchronization with a horizontal synchronizing signal or a signal that is outputted for every horizontal synchronizing period.

4. The driving apparatus of liquid crystal display apparatus as set forth in claim 3, wherein the changeover control circuit discriminates whether the number of the horizontal lines is an even number or an odd number, and selectively switches in accordance with a discriminated result (a) a controlling in which a switching between the first and second changeover circuits in accordance with an inverted switching signal and a switching between the first and second changeover circuits in accordance with a noninverted switching signal are alternately carried out for every frame and (b) a controlling in which only the switching between the first and second switching means is carried out in accordance with the inverted switching signal.

5. The driving apparatus of liquid crystal display apparatus as set forth in claim 2, wherein the changeover control circuit includes:

a first frequency divider circuit that divides into ½ a frequency of a signal which is outputted for every horizontal synchronizing signal or for every horizontal synchronizing period and output it as the changeover signal to the first switching circuit;

a second frequency divider circuit that divides into ½ a frequency of the vertical synchronizing signal;

a switch control signal generation circuit that, according to an output signal of the second frequency divider circuit and a discrimination signal discriminating whether the number of the horizontal lines is an even number or an odd number, (a) generates a first switch control signal in a case of the odd number, (b) generates the first switch control signal in an odd-numbered frame in a case of the even number, and (c) generates a second switch control signal in an even-numbered frame in a case of the even number;

a first switch circuit that receives the first switch control signal and is closed so as to output an inverted signal of the changeover signal as the alternation signal; and a second switch circuit that receives the second switch control signal and is closed so as to output a noninverted signal of the changeover signal as the alternation signal.

6. The driving apparatus of liquid crystal display apparatus as set forth in claim 4, wherein the changeover control circuit includes:

a first frequency divider circuit that divides into ½ a frequency of a signal which is outputted for every horizontal synchronizing signal or for every horizontal synchronizing period and output it as the changeover signal to the first switching circuit;

a second frequency divider circuit that divides into ½ a frequency of the vertical synchronizing signal;

a switch control signal generation circuit that, according to an output signal of the second frequency divider circuit and a discrimination signal discriminating whether the number of the horizontal lines is an even number or an odd number, (a) generates a first switch control signal in a case of the odd number, (b) generates the first switch control signal in an odd-numbered frame in a case of the even number, and (c) generates a second switch control signal in an even-numbered frame in a case of the even number;

a first switch circuit that receives the first switch control signal and is closed so as to output an inverted signal of the changeover signal as the alternation signal; and a second switch circuit that receives the second switch control signal and is closed so as to output a noninverted signal of the changeover signal as the alternation signal.

7. A driving method of liquid crystal display apparatus in which first and second amplifier circuits are provided, a noninverted input signal and an inverted input signal are switched in accordance with a changeover signal, and output signals of the first and second amplifier circuits are respectively switched in accordance with an alternation signal and outputted to pixels that are provided in a matrix manner, comprising the step of:

controlling the changeover signal and the alternation signal so that an offset voltage applied to a pixel has a polarity that is reversed to a polarity of pixels that are provided diagonally up to right and left and diagonally down to right and left with respect to such a pixel among other surrounding pixels and has a same absolute value as absolute values of the pixels diagonally provided.

8. The driving method of liquid crystal display apparatus as set forth in claim 7, further comprising the steps of:

controlling the changeover signal in accordance with a horizontal synchronizing signal or a signal that is outputted for every horizontal synchronizing period;

generating an inverted signal and a noninverted signal of the changeover signal respectively in accordance with a vertical synchronizing signal and a discrimination signal that discriminates whether the number of horizontal lines is an odd number or an even number; and switching alternately for every frame the inverted signal and the noninverted signal of the changeover signal and outputting it as the alternation signal when it is discriminated that the number of the horizontal lines is an even number, while outputting only the inverted signal as the alternation signal when it is discriminated that the number of the horizontal lines is an odd number.

* * * * *